US007633478B2

(12) United States Patent
Morita

(10) Patent No.: US 7,633,478 B2
(45) **Date of Patent: *Dec. 15, 2009**

(54) POWER SUPPLY CIRCUIT, DISPLAY DRIVER, ELECTRO-OPTICAL DEVICE, ELECTRONIC INSTRUMENT, AND METHOD OF CONTROLLING POWER SUPPLY CIRCUIT

(75) Inventor: Akira Morita, Suwa (JP)

(73) Assignee: Seiko Epson Corporation (JP)

( * ) Notice: Subject to any disclaimer, the term of this patent is extended or adjusted under 35 U.S.C. 154(b) by 694 days.

This patent is subject to a terminal disclaimer.

(21) Appl. No.: 11/334,529

(22) Filed: Jan. 18, 2006

(65) Prior Publication Data

US 2006/0158412 A1 Jul. 20, 2006

(30) Foreign Application Priority Data

Jan. 20, 2005 (JP) ..... 2005-013215

(51) Int. Cl.
*G09G 3/36* (2006.01)

(52) U.S. Cl. ..... 345/95; 345/89

(58) Field of Classification Search ..... 345/87–107, 345/208–211, 53; 315/169.1, 169.2, 196; 327/108; 363/147; 349/19; 359/245, 265; 323/313

See application file for complete search history.

(56) References Cited

U.S. PATENT DOCUMENTS 6,456,267 B1 * 9/2002 Sato et al. ..... 345/87
6,756,958 B2 * 6/2004 Furuhashi et al. ..... 345/94
6,762,565 B2 * 7/2004 Kudo et al. ..... 315/169.1
6,778,158 B2 * 8/2004 Sun ..... 345/87
6,795,047 B2 * 9/2004 Kudo et al. ..... 345/96
6,819,311 B2 * 11/2004 Nose et al. ..... 345/96
7,002,541 B2 * 2/2006 Yanagi et al. ..... 345/92
7,015,890 B2 * 3/2006 Moon ..... 345/98
7,050,033 B2 * 5/2006 Chiu ..... 345/98
7,068,092 B2 * 6/2006 Yi et al. ..... 327/112
7,078,864 B2 * 7/2006 Kudo et al. ..... 315/169.1
7,084,852 B2 * 8/2006 Nishi et al. ..... 345/98
7,098,885 B2 * 8/2006 Kumada et al. ..... 345/96

(Continued)

FOREIGN PATENT DOCUMENTS

JP 08-076083 * 3/1996

(Continued)

*Primary Examiner*—Chanh Nguyen
*Assistant Examiner*—Adam J Snyder
(74) *Attorney, Agent, or Firm*—Harness, Dickey & Pierce, P.L.C.

(57) ABSTRACT

A power supply circuit including a high-potential-side voltage generation circuit and a low-potential-side voltage generation circuit which respectively generate a high-potential-side voltage and a low-potential-side voltage to be supplied to a common electrode, and alternately supplying the high-potential-side voltage and the low-potential-side voltage to the common electrode as a common electrode voltage so that polarity of the common electrode voltage is the same in consecutive first and second horizontal scan periods. When a precharge voltage of data lines in a precharge period in the first horizontal scan period is higher than the average voltage of the data lines set after the precharge period, the power supply circuit controls the supply capability of the common electrode voltage in a precharge period of the data lines in the second horizontal scan period.

66 Claims, 31 Drawing Sheets

U.S. PATENT DOCUMENTS

| | | | | |
|---|---|---|---|---|
| 7,110,274 | B1 * | 9/2006 | Endo et al. | 363/147 |
| 7,176,869 | B2 * | 2/2007 | Kumada et al. | 345/94 |
| 7,342,562 | B2 * | 3/2008 | Kawase et al. | 345/87 |
| 2004/0145583 | A1 | 7/2004 | Morita | |
| 2004/0169627 | A1 * | 9/2004 | Hong | 345/89 |
| 2004/0207329 | A1 * | 10/2004 | Kudo et al. | 315/196 |
| 2005/0017935 | A1 * | 1/2005 | Hirama | 345/87 |
| 2005/0083278 | A1 * | 4/2005 | Teraishi | 345/87 |
| 2005/0088394 | A1 * | 4/2005 | Chung | 345/96 |
| 2005/0088395 | A1 * | 4/2005 | Chung | 345/98 |
| 2005/0140400 | A1 * | 6/2005 | Yi et al. | 327/108 |
| 2005/0140625 | A1 * | 6/2005 | Kim et al. | 345/89 |
| 2005/0140637 | A1 * | 6/2005 | Yi | 345/98 |

FOREIGN PATENT DOCUMENTS

| | | |
|---|---|---|
| JP | 2004-184840 | 7/2004 |

* cited by examiner

FIG.27

| LINE VALUE | TRP1 | TRP2 | TRN1 | TRN2 | VREFN1 VREFN2 | OFFSET (+) | OFFSET (−) | CK |
|---|---|---|---|---|---|---|---|---|
| 0 | OFF | OFF | ON | OFF | ON | OFF | OFF | 1 |
| 4 | OFF | OFF | ON | OFF | ON | OFF | OFF | 1 |
| 8 | OFF | OFF | OFF | ON | ON | OFF | OFF | 1 |
| 12 | OFF | OFF | OFF | ON | ON | OFF | OFF | 1 |
| 16 | OFF | OFF | OFF | OFF | ON | OFF | OFF | 1 |
| 20 | OFF | OFF | OFF | OFF | ON | OFF | OFF | 1 |
| 24 | OFF | OFF | OFF | OFF | ON | OFF | OFF | 1 |
| 28 | OFF | OFF | OFF | OFF | OFF | OFF | ON | 1 |
| 32 | OFF | OFF | OFF | OFF | OFF | OFF | OFF | 1/2 |
| 36 | OFF | OFF | OFF | OFF | OFF | ON | OFF | 1 |
| 40 | OFF | OFF | OFF | OFF | ON | OFF | OFF | 1 |
| 44 | OFF | OFF | OFF | OFF | ON | OFF | OFF | 1 |
| 48 | OFF | OFF | OFF | OFF | ON | OFF | OFF | 1 |
| 52 | OFF | ON | OFF | OFF | ON | OFF | OFF | 1 |
| 56 | OFF | ON | OFF | OFF | ON | OFF | OFF | 1 |
| 60 | ON | OFF | OFF | OFF | ON | OFF | OFF | 1 |
| 63 | ON | OFF | OFF | OFF | ON | OFF | OFF | 1 |

FIG.28

| LINE VALUE | TRP1 | | TRP2 | | TRN1 | | TRN2 | | VREFN1 | | OFFSET (+) | | OFFSET (−) | |
|---|---|---|---|---|---|---|---|---|---|---|---|---|---|---|
| | ON | OFF | ON | OFF | ON | OFF | ON | OFF | ON | OFF | ON | OFF | ON | OFF |
| 0 | 0 | 0 | 0 | 5 | 0 | 0 | 0 | 0 | 0 | 9 | 0 | 0 | 0 | 0 |
| 4 | 0 | 0 | 0 | 3 | 0 | 0 | 0 | 0 | 0 | 8 | 0 | 0 | 0 | 0 |
| 8 | 0 | 0 | 0 | 0 | 0 | 0 | 0 | 2 | 0 | 7 | 0 | 0 | 0 | 0 |
| 12 | 0 | 0 | 0 | 0 | 0 | 0 | 0 | 4 | 0 | 6 | 0 | 0 | 0 | 0 |
| 16 | 0 | 0 | 0 | 0 | 0 | 0 | 0 | 0 | 0 | 5 | 0 | 0 | 0 | 0 |
| 20 | 0 | 0 | 0 | 0 | 0 | 0 | 0 | 0 | 0 | 4 | 0 | 0 | 0 | 0 |
| 24 | 0 | 0 | 0 | 0 | 0 | 0 | 0 | 0 | 0 | 3 | 0 | 0 | 0 | 0 |
| 28 | 0 | 0 | 0 | 0 | 0 | 0 | 0 | 0 | 0 | 0 | 0 | 0 | 0 | 4 |
| 32 | 0 | 0 | 0 | 0 | 0 | 0 | 0 | 0 | 0 | 0 | 0 | 0 | 0 | 0 |
| 36 | 0 | 0 | 0 | 0 | 0 | 0 | 0 | 0 | 0 | 0 | 0 | 4 | 0 | 0 |
| 40 | 0 | 0 | 0 | 0 | 0 | 0 | 0 | 0 | 0 | 3 | 0 | 0 | 0 | 0 |
| 44 | 0 | 0 | 0 | 0 | 0 | 0 | 0 | 0 | 0 | 4 | 0 | 0 | 0 | 0 |
| 48 | 0 | 0 | 0 | 0 | 0 | 0 | 0 | 0 | 0 | 5 | 0 | 0 | 0 | 0 |
| 52 | 0 | 0 | 0 | 0 | 0 | 2 | 0 | 0 | 0 | 6 | 0 | 0 | 0 | 0 |
| 56 | 0 | 0 | 0 | 0 | 0 | 4 | 0 | 0 | 0 | 7 | 0 | 0 | 0 | 0 |
| 60 | 0 | 2 | 0 | 0 | 0 | 0 | 0 | 0 | 0 | 8 | 0 | 0 | 0 | 0 |
| 63 | 0 | 4 | 0 | 0 | 0 | 0 | 0 | 0 | 0 | 9 | 0 | 0 | 0 | 0 |

POWER SUPPLY CIRCUIT, DISPLAY DRIVER, ELECTRO-OPTICAL DEVICE, ELECTRONIC INSTRUMENT, AND METHOD OF CONTROLLING POWER SUPPLY CIRCUIT

Japanese Patent Application No. 2005-13215, filed on Jan. 20, 2005, is hereby incorporated by reference in its entirety.

BACKGROUND OF THE INVENTION

The present invention relates to a power supply circuit, a display driver, an electro-optical device, an electronic instrument, and a method of controlling a power supply circuit.

As a liquid crystal display (LCD) panel (display panel in a broad sense) used in an electronic instrument such as a portable telephone, a simple matrix type LCD panel and an active matrix type LCD panel using a switch element such as a thin film transistor (hereinafter abbreviated as "TFT") have been known.

The simple matrix type LCD panel easily reduces power consumption in comparison with the active matrix type LCD panel. However, it is difficult to increase the number of colors and display a video in the simple matrix type LCD panel. The active matrix type LCD panel is suitable for increasing the number of colors and displaying a video. However, it is difficult to reduce power consumption of the active matrix type LCD panel.

In recent years, an increase in the number of colors and display of a video have been increasingly demanded for a portable electronic instrument such as a portable telephone in order to display a high-quality image. Therefore, the active matrix type LCD panel has been widely used instead of the simple matrix type LCD panel.

The simple matrix type LCD panel or the active matrix type LCD panel is driven so that the voltage applied to a liquid crystal forming a pixel is alternately changed. As such an alternating drive method, a line inversion drive and a field inversion drive (frame inversion drive) have been known. In the line inversion drive, the polarity of the voltage applied to the liquid crystal is reversed in scan line units. An N-line inversion drive is also known in which the line inversion drive is performed in units of two or more scan lines. In the field inversion drive, the polarity of the voltage applied to the liquid crystal is reversed in field (frame) units.

The voltage level applied to a pixel electrode forming a pixel can be decreased by changing a common electrode voltage (common voltage) supplied to a common electrode opposite to the pixel electrode corresponding to inversion drive timing.

The inversion drive increases power consumption since an electric charge is repeatedly charged and discharged. JP-A-2004-184840 discloses a technology of reducing power consumption by reutilizing an electric charge discharged from a data line of the LCD panel.

However, the pixel electrode, to which a data voltage supplied to the data line from a data driver is applied, is capacitively coupled with the common electrode. Therefore, the voltage level of the common electrode changes due to a change in the voltage supplied to the pixel electrode. A change in the voltage level of the common electrode causes deterioration of the image quality. Therefore, the power supply capability of a power supply circuit which supplies the common electrode voltage is determined taking into consideration the maximum value of the amount of electric charge which must be charged or discharged in order to prevent a change in the voltage level of the common electrode. Therefore, the power supply circuit unnecessarily consumes power when the power supply capability is not required.

The data driver which supplies the data voltage corresponding to grayscale data to the data line of the LCD panel may precharge the data line before supplying the data voltage to the data line. The voltage level of the data line can be promptly set at a desired data voltage by precharging the heavily-loaded data line, so that deterioration of the image quality can be prevented.

While deterioration of the image quality can be prevented by precharging the data line, the data voltage supplied to the data line from the data driver significantly affects current consumption during the data line precharge operation in the subsequent horizontal scan period. Specifically, the amount of the current consumption during the precharge operation in the subsequent horizontal scan period is increased or decreased depending on the data voltage in the preceding horizontal scan period. It was found that power consumption can be reduced by reducing the above-mentioned effect.

SUMMARY

According to a first aspect of the invention, there is provided a power supply circuit which supplies voltage to a common electrode which is opposite to each of a plurality of pixel electrodes, an electro-optical substance being interposed between the common electrode and the pixel electrodes, voltages of data lines being respectively supplied to the pixel electrodes, the power supply circuit comprising:

a high-potential-side voltage generation circuit which generates a high-potential-side voltage to be supplied to the common electrode; and a low-potential-side voltage generation circuit which generates a low-potential-side voltage to be supplied to the common electrode, the high-potential-side voltage and the low-potential-side voltage being alternately supplied to the common electrode as a common electrode voltage so that polarity of the common electrode voltage based on a given voltage is the same in consecutive first and second horizontal scan periods; and when a precharge voltage of the data lines in a precharge period in the first horizontal scan period is higher than an average voltage of the data lines set after the precharge period, the power supply circuit performing supply capability control of the common electrode voltage which changes at least one of current drive capability of the high-potential-side voltage generation circuit, an output voltage level of the high-potential-side voltage generation circuit, current drive capability of the low-potential-side voltage generation circuit, and an output voltage level of the low-potential-side voltage generation circuit, in a precharge period of the data lines in the second horizontal scan period.

According to a second aspect of the invention, there is provided a power supply circuit which supplies voltage to a common electrode which is opposite to each of a plurality of pixel electrodes, an electro-optical substance being interposed between the common electrode and the pixel electrodes, voltages of data lines being respectively supplied to the pixel electrodes, the power supply circuit comprising:

a high-potential-side voltage generation circuit which generates a high-potential-side voltage to be supplied to the common electrode; and a low-potential-side voltage generation circuit which generates a low-potential-side voltage to be supplied to the common electrode, the high-potential-side voltage and the low-potential-side voltage being alternately supplied to the common electrode as a common electrode voltage so that polarity of the common electrode voltage based on a given voltage is the same in consecutive first and second horizontal scan periods; and when a precharge voltage of the data lines in a precharge period in the first horizontal scan period is lower than an average voltage of the data lines set after the precharge period, the power supply circuit performing supply capability control of the common electrode voltage which changes at least one of current drive capability of the high-potential-side voltage generation circuit, an output voltage level of the high-potential-side voltage generation circuit, current drive capability of the low-potential-side voltage generation circuit, and an output voltage level of the low-potential-side voltage generation circuit, in a precharge period of the data lines in the second horizontal scan period.

According to a third aspect of the invention, there is provided a display driver comprising:

a driver circuit which supplies a drive voltage corresponding to grayscale data to the data lines electrically connected to the pixel electrodes; and any of the above-described power supply circuits which performs the supply capability control by using a total value corresponding to the grayscale data.

According to a fourth aspect of the invention, there is provided an electro-optical device comprising:

a plurality of scan lines;

a plurality of data lines;

a plurality of pixel electrodes, each of the pixel electrodes being specified by one of the scan lines and one of the data lines;

a common electrode which is opposite to each of the pixel electrodes, an electro-optical substance being interposed between the common electrode and the pixel electrodes;

a display driver which drives the data lines; and any of the above-described power supply circuits which alternately supplies the high-potential-side voltage and the low-potential-side voltage to the common electrode.

According to a fifth aspect of the invention, there is provided an electronic instrument comprising any of the above-described power supply circuits.

According to a sixth aspect of the invention, there is provided a method of controlling a power supply circuit including a high-potential-side voltage generation circuit and a low-potential-side voltage generation circuit, the high-potential-side voltage generation circuit generating a high-potential-side voltage to be supplied to a common electrode which is opposite to each of a plurality of pixel electrodes, an electro-optical substance being interposed between the common electrode and the pixel electrodes, voltages of data lines being respectively supplied to the pixel electrodes, and the low-potential-side voltage generation circuit generating a low-potential-side voltage to be supplied to the common electrode, the method comprising:

alternately supplying the high-potential-side voltage and the low-potential-side voltage to the common electrode as a common electrode voltage so that polarity of the common electrode voltage based on a given voltage is the same in consecutive first and second horizontal scan periods; and when a precharge voltage of the data lines in a precharge period in the first horizontal scan period is higher than an average voltage of the data lines set after the precharge period, performing supply capability control of the common electrode voltage which changes at least one of current drive capability of the high-potential-side voltage generation circuit, an output voltage level of the high-potential-side voltage generation circuit, current drive capability of the low-potential-side voltage generation circuit, and an output voltage level of the low-potential-side voltage generation circuit, in a precharge period of the data lines in the second horizontal scan period to increase an amount of positive electric charge to be removed from the common electrode.

According to a seventh aspect of the invention, there is provided a method of controlling a power supply circuit including a high-potential-side voltage generation circuit and a low-potential-side voltage generation circuit, the high-potential-side voltage generation circuit generating a high-potential-side voltage to be supplied to a common electrode which is opposite to each of a plurality of pixel electrodes, an electro-optical substance being interposed between the common electrode and the pixel electrodes, voltages of data lines being respectively supplied to the pixel electrodes, and the low-potential-side voltage generation circuit generating a low-potential-side voltage to be supplied to the common electrode, the method comprising:

alternately supplying the high-potential-side voltage and the low-potential-side voltage to the common electrode as a common electrode voltage so that polarity of the common electrode voltage based on a given voltage is the same in consecutive first and second horizontal scan periods; and when an average voltage of the data lines at completion of the first horizontal scan period is lower than a precharge voltage of the data lines, performing supply capability control of the common electrode voltage which changes at least one of current drive capability of the high-potential-side voltage generation circuit, an output voltage level of the high-potential-side voltage generation circuit, current drive capability of the low-potential-side voltage generation circuit, and an output voltage level of the low-potential-side voltage generation circuit to increase an amount of positive electric charge to be supplied to the common electrode.

BRIEF DESCRIPTION OF THE SEVERAL VIEWS OF THE DRAWING

FIG. 27 is a diagram showing an example of a power supply capability setting register.

FIG. 28 is a diagram showing another example of the power supply capability setting register.

DETAILED DESCRIPTION OF THE EMBODIMENT

Figure 1:
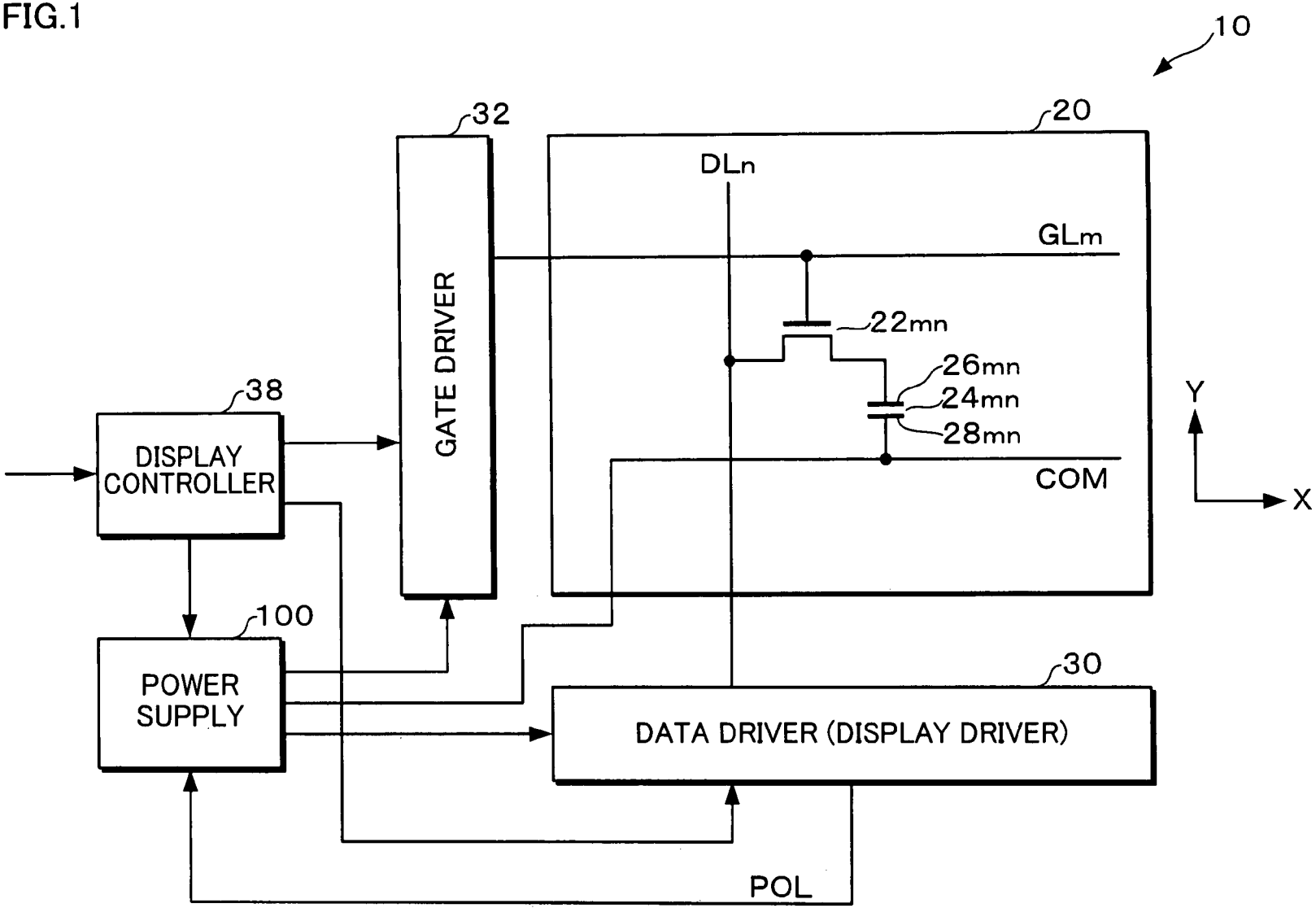
FIG. 1 is a block diagram showing a configuration example of a liquid crystal display device to which a power supply circuit according to one embodiment of the invention is applied.

The invention may provide a power supply circuit, a display driver, an electro-optical device, an electronic instrument which supply voltage to a common electrode without consuming a large amount of power and affecting the image quality when data lines are precharged, and a method of controlling the power supply circuit.

According to one embodiment of the invention, there is provided a power supply circuit which supplies voltage to a common electrode which is opposite to each of a plurality of pixel electrodes, an electro-optical substance being interposed between the common electrode and the pixel electrodes, voltages of data lines being respectively supplied to the pixel electrodes, the power supply circuit comprising:

a high-potential-side voltage generation circuit which generates a high-potential-side voltage to be supplied to the common electrode; and a low-potential-side voltage generation circuit which generates a low-potential-side voltage to be supplied to the common electrode, the high-potential-side voltage and the low-potential-side voltage being alternately supplied to the common electrode as a common electrode voltage so that polarity of the common electrode voltage based on a given voltage is the same in consecutive first and second horizontal scan periods; and when a precharge voltage of the data lines in a precharge period in the first horizontal scan period is higher than an average voltage of the data lines set after the precharge period, the power supply circuit performing supply capability control of the common electrode voltage which changes at least one of current drive capability of the high-potential-side voltage generation circuit, an output voltage level of the high-potential-side voltage generation circuit, current drive capability of the low-potential-side voltage generation circuit, and an output voltage level of the low-potential-side voltage generation circuit, in a precharge period of the data lines in the second horizontal scan period.

The average voltage of the data lines used herein may be referred to as the average value of a data voltage applied to the data line to which the voltage applied to the pixel electrode is supplied.

In this embodiment, the data line to which the voltage applied to the pixel electrode is supplied is set at the precharge voltage in the precharge period provided in each horizontal scan period, and the data voltage corresponding to the grayscale data is supplied to the data line. The common electrode in this embodiment is capacitively coupled with the pixel electrode. Since the transmissivity is changed according to the voltage between the common electrode and the pixel electrode, a change in the voltage applied to the pixel electrode causes a change in the voltage level of the common electrode so that the image quality is affected.

In this embodiment, the common electrode voltage is alternately supplied to the common electrode so that the polarity of the common electrode voltage based on a given voltage is the same in the consecutive first and second horizontal scan periods. When the precharge voltage of data lines in the precharge period in the first horizontal scan period is higher than the average voltage of the data lines set after the precharge period, the supply capability of the common electrode voltage is controlled in the precharge period in the second horizontal scan period.

This reduces the amount of current consumed during precharging in the second horizontal scan period in order to charge or discharge electric charge corresponding to the data voltage supplied to the data line to the first horizontal scan period. Therefore, the common electrode voltage supply capability can be determined without taking into consideration the maximum value of the amount of electric charge which must be charged into or discharged from the common electrode. Therefore, one embodiment of the invention prevents occurrence of a situation in which unnecessary power consumption occurs when a high voltage supply capability is not required. As a result, a power supply circuit which supplies voltage to the common electrode without consuming a large amount of power and affecting the image quality, even when the data lines are precharged, can be provided.

In this power supply circuit, the supply capability control may increase an amount of positive electric charge to be removed from the common electrode.

Since a change in the common electrode voltage in the precharge period in the second horizontal scan period can be reduced, the common electrode voltage supply capability can be determined without taking into consideration the maximum value of the amount of electric charge which must be charged into or discharged from the common electrode. Therefore, one embodiment of the invention prevents occurrence of a situation in which unnecessary power consumption occurs when a high voltage supply capability is not required.

According to one embodiment of the invention, there is provided a power supply circuit which supplies voltage to a common electrode which is opposite to each of a plurality of pixel electrodes, an electro-optical substance being interposed between the common electrode and the pixel electrodes, voltages of data lines being respectively supplied to the pixel electrodes, the power supply circuit comprising:

a high-potential-side voltage generation circuit which generates a high-potential-side voltage to be supplied to the common electrode; and a low-potential-side voltage generation circuit which generates a low-potential-side voltage to be supplied to the common electrode, the high-potential-side voltage and the low-potential-side voltage being alternately supplied to the common electrode as a common electrode voltage so that polarity of the common electrode voltage based on a given voltage is the same in consecutive first and second horizontal scan periods; and when a precharge voltage of the data lines in a precharge period in the first horizontal scan period is lower than an average voltage of the data lines set after the precharge period, the power supply circuit performing supply capability control of the common electrode voltage which changes at least one of current drive capability of the high-potential-side voltage generation circuit, an output voltage level of the high-potential-side voltage generation circuit, current drive capability of the low-potential-side voltage generation circuit, and an output voltage level of the low-potential-side voltage generation circuit, in a precharge period of the data lines in the second horizontal scan period.

The average voltage of the data lines used herein may be referred to as the average value of the data voltages applied to the data lines.

In this embodiment, the data line to which the voltage applied to the pixel electrode is supplied is set at the precharge voltage in the precharge period provided in each horizontal scan period, and the data voltage corresponding to the grayscale data is supplied to the data line. The common electrode in this embodiment is capacitively coupled with the pixel electrode. Since the transmissivity is changed according to the voltage between the common electrode and the pixel electrode, a change in the voltage applied to the pixel electrode causes a change in the voltage level of the common electrode so that the image quality is affected.

In this embodiment, the common electrode voltage is alternately supplied to the common electrode so that the polarity of the common electrode voltage based on a given voltage is the same in the consecutive first and second horizontal scan periods. When the precharge voltage of data lines in the precharge period in the first horizontal scan period is lower than the average voltage of the data lines set after the precharge period, the supply capability of the common electrode voltage is controlled in the precharge period in the second horizontal scan period.

This reduces the amount of current consumed during precharging in the second horizontal scan period in order to charge or discharge electric charge corresponding to the data voltage supplied to the data line to the first horizontal scan period. Therefore, the common electrode voltage supply capability can be determined without taking into consideration the maximum value of the amount of electric charge which must be charged into or discharged from the common electrode. Therefore, one embodiment of the invention prevents occurrence of a situation in which unnecessary power consumption occurs when a high voltage supply capability is not required. As a result, a power supply circuit which supplies voltage to the common electrode without consuming a large amount of power and affecting the image quality, even when the data lines are precharged, can be provided.

In this power supply circuit, the supply capability control may increase an amount of positive electric charge to be supplied to the common electrode.

Since a change in the common electrode voltage in the precharge period in the second horizontal scan period can be reduced, the common electrode voltage supply capability can be determined without taking into consideration the maximum value of the amount of electric charge which must be charged into or discharged from the common electrode. Therefore, one embodiment of the invention prevents occurrence of a situation in which unnecessary power consumption occurs when a high voltage supply capability is not required.

In this power supply circuit, in a grayscale output period in the second horizontal scan period after the precharge period, when the average voltage in the grayscale output period is higher than the precharge voltage, an amount of positive electric charge to be removed from the common electrode may be increased by the supply capability control.

In this power supply circuit, in a grayscale output period in the second horizontal scan period after the precharge period, when the average voltage in the grayscale output period is lower than the precharge voltage, an amount of positive electric charge to be supplied to the common electrode may be increased by the supply capability control.

In any of the above embodiments, since a change in the common electrode voltage in the grayscale output period can be reduced, the common electrode voltage supply capability can be determined without taking into consideration the maximum value of the amount of electric charge which must be charged into or discharged from the common electrode. Therefore, occurrence of a situation in which unnecessary power consumption occurs can be prevented when a high voltage supply capability is not required.

In this power supply circuit, the supply capability control may be performed based on grayscale data for the number of dots of one scan line.

The average voltage of the data lines can be estimated based on the grayscale data for the number of dots of one scan line. Therefore when the precharge voltage is determined in advance, the supply capability control of the common electrode voltage can be specified based on only the average voltage. Therefore, the supply capability of the common electrode voltage can be implemented by a very simplified configuration.

In this power supply circuit, the supply capability control may be performed based on a total value obtained by sequentially adding grayscale data for the number of dots of one scan line, the grayscale data of each dot corresponding to voltage applied to each of the pixel electrodes.

Since the total value obtained by sequentially adding the grayscale data for the number of dots of one scan line can be associated with the average voltage of the data lines or the voltage applied to the pixel electrode, the supply capability of the common electrode voltage is controlled according to the total value. Therefore, the common electrode voltage supply capability can be determined without taking into consideration the maximum value of the amount of electric charge which must be charged into or discharged from the common electrode. Therefore, it is possible to prevent occurrence of a situation in which unnecessary power consumption occurs when a high voltage supply capability is not required.

The power supply circuit may comprise:

a first conductivity type first auxiliary transistor having a source and a drain, a high-potential-side power supply voltage of the high-potential-side voltage generation circuit being supplied to the source, and the drain being connected to a signal line which is electrically connected to the common electrode, wherein the supply capability control is performed by controlling a gate voltage of the first auxiliary transistor according to the total value.

Since the capability of setting the high-potential-side voltage of the common electrode voltage can be increased according to the total value, unnecessary current consumption can be reduced.

The power supply circuit may comprise:

a second conductivity type second auxiliary transistor having a source and a drain, a low-potential-side power supply voltage of the low-potential-side voltage generation circuit being supplied to the source, and the drain being connected to a signal line which is electrically connected to the common electrode, wherein the supply capability control is performed by controlling a gate voltage of the second auxiliary transistor according to the total value.

Since the capability of setting the low-potential-side voltage of the common electrode voltage can be increased according to the total value, unnecessary current consumption can be reduced.

In this power supply circuit, the high-potential-side voltage generation circuit may include a first operational amplifier which outputs the high-potential-side voltage based on a high-potential-side input voltage.

In this power supply circuit, the supply capability control may be performed by changing at least one of current drive capability and a slew rate of the first operational amplifier according to the total value.

In this power supply circuit, the supply capability control may be performed by changing the high-potential-side input voltage according to the total value.

In this power supply circuit, the supply capability control may be performed by stopping or limiting an operating current of the first operational amplifier and electrically connecting an input and an output of the first operational amplifier according to the total value.

In any of the above embodiments, since the capability of generating the high-potential-side voltage of the common electrode voltage can be changed according to the total value, unnecessary current consumption can be reduced.

The power supply circuit may comprise:

a first charge-pump circuit which generates a high-potential-side power supply voltage of the high-potential-side voltage generation circuit by a charge-pump operation in synchronization with a first charge clock signal, wherein the supply capability control is performed by stopping the first charge clock signal or reducing frequency of the first charge clock signal according to the total value.

Since an accurate high-potential-side power supply voltage can be generated while consuming power only when the accuracy of the voltage level of the high-potential-side power supply voltage is necessary, unnecessary current consumption can be reduced.

In this power supply circuit, the low-potential-side voltage generation circuit may include a second operational amplifier which outputs the low-potential-side voltage based on a low-potential-side input voltage.

In this power supply circuit, the supply capability control may be performed by changing at least one of current drive capability and a slew rate of the second operational amplifier according to the total value.

In this power supply circuit, the supply capability control may be performed by changing the low-potential-side input voltage according to the total value.

In this power supply circuit, the supply capability control may be performed by stopping or limiting an operating current of the second operational amplifier and electrically connecting an input and an output of the second operational amplifier according to the total value.

In any of the above embodiments, since the capability of generating the low-potential-side voltage of the common electrode voltage can be changed according to the total value, unnecessary current consumption can be reduced.

The power supply circuit may comprise:

a second charge-pump circuit which generates a low-potential-side power supply voltage of the low-potential-side voltage generation circuit by a charge-pump operation in synchronization with a second charge clock signal, wherein the supply capability control is performed by stopping the second charge clock signal or reducing frequency of the second charge clock signal according to the total value.

Since an accurate low-potential-side power supply voltage can be generated while consuming power only when the accuracy of the voltage level of the low-potential-side power supply voltage is necessary, unnecessary current consumption can be reduced.

In this power supply circuit, the supply capability control may be performed in a period determined based on the total value.

In this power supply circuit, the total value may be a value obtained by sequentially adding the grayscale data for the number of a part of dots of one scan line.

In this power supply circuit, when the grayscale data of each dot is j bits (j is an integer greater than one), the total value may be a value obtained by sequentially adding higher-order k-bit ($k<j$, k is a natural number) data of each piece of the grayscale data.

In this power supply circuit, k may be one.

The load of the common electrode can be evaluated by using the total value calculated by using a more simplified configuration. Therefore, a power supply circuit which can reduce power consumption without increasing the scale can be provided.

According to one embodiment of the invention, there is provided a display driver comprising:

a driver circuit which supplies a drive voltage corresponding to grayscale data to the data lines electrically connected to the pixel electrodes; and any of the above-described power supply circuits which performs the supply capability control by using a total value corresponding to the grayscale data.

In this embodiment, a display driver including a power supply circuit which supplies voltage to the common electrode without consuming a large amount of power and affecting the image quality, even when the data lines are precharged, can be provided.

According to one embodiment of the invention, there is provided an electro-optical device comprising:

a plurality of scan lines;

a plurality of data lines;

a plurality of pixel electrodes, each of the pixel electrodes being specified by one of the scan lines and one of the data lines;

a common electrode which is opposite to each of the pixel electrodes, an electro-optical substance being interposed between the common electrode and the pixel electrodes;

a display driver which drives the data lines; and any of the above-described power supply circuits which alternately supplies the high-potential-side voltage and the low-potential-side voltage to the common electrode.

In this embodiment, an electro-optical device including a power supply circuit which supplies voltage to the common electrode without consuming a large amount of power and affecting the image quality, even when the data lines are precharged, can be provided.

According to one embodiment of the invention, there is provided an electronic instrument comprising any of the above-described power supply circuits.

In this embodiment, an electronic instrument including a power supply circuit which supplies voltage to the common electrode without consuming a large amount of power and affecting the image quality, even when the data lines are precharged, can be provided.

According to one embodiment of the invention, there is provided a method of controlling a power supply circuit including a high-potential-side voltage generation circuit and a low-potential-side voltage generation circuit, the high-potential-side voltage generation circuit generating a high-potential-side voltage to be supplied to a common electrode which is opposite to each of a plurality of pixel electrodes, an electro-optical substance being interposed between the common electrode and the pixel electrodes, voltages of data lines being respectively supplied to the pixel electrodes, and the low-potential-side voltage generation circuit generating a low-potential-side voltage to be supplied to the common electrode, the method comprising:

alternately supplying the high-potential-side voltage and the low-potential-side voltage to the common electrode as a common electrode voltage so that polarity of the common electrode voltage based on a given voltage is the same in consecutive first and second horizontal scan periods; and when a precharge voltage of the data lines in a precharge period in the first horizontal scan period is higher than an average voltage of the data lines set after the precharge period, performing supply capability control of the common electrode voltage which changes at least one of current drive capability of the high-potential-side voltage generation circuit, an output voltage level of the high-potential-side voltage generation circuit, current drive capability of the low-potential-side voltage generation circuit, and an output voltage level of the low-potential-side voltage generation circuit, in a precharge period of the data lines in the second horizontal scan period to increase an amount of positive electric charge to be removed from the common electrode.

According to one embodiment of the invention, there is provided a method of controlling a power supply circuit including a high-potential-side voltage generation circuit and a low-potential-side voltage generation circuit, the high-potential-side voltage generation circuit generating a high-potential-side voltage to be supplied to a common electrode which is opposite to each of a plurality of pixel electrodes, an electro-optical substance being interposed between the common electrode and the pixel electrodes, voltages of data lines being respectively supplied to the pixel electrodes, and the low-potential-side voltage generation circuit generating a low-potential-side voltage to be supplied to the common electrode, the method comprising:

alternately supplying the high-potential-side voltage and the low-potential-side voltage to the common electrode as a common electrode voltage so that polarity of the common electrode voltage based on a given voltage is the same in consecutive first and second horizontal scan periods; and when an average voltage of the data lines at completion of the first horizontal scan period is lower than a precharge voltage of the data lines, performing supply capability control of the common electrode voltage which changes at least one of current drive capability of the high-potential-side voltage generation circuit, an output voltage level of the high-potential-side voltage generation circuit, current drive capability of the low-potential-side voltage generation circuit, and an output voltage level of the low-potential-side voltage generation circuit to increase an amount of positive electric charge to be supplied to the common electrode.

In this method of controlling a power supply circuit, the supply capability control may be performed in a grayscale output period after the precharge period, based on the precharge voltage and grayscale data for the number of dots of one scan line in the second horizontal scan period.

In this method of controlling a power supply circuit, the supply capability control may be performed based on a total value obtained by sequentially adding grayscale data for the number of dots of one scan line, the grayscale data of each dot corresponding to voltage applied to each of the pixel electrodes.

In this method of controlling a power supply circuit, the supply capability control may be performed in a period determined based on the total value.

In this method of controlling a power supply circuit, the total value may be a value obtained by sequentially adding the grayscale data for the number of a part of dots of one scan line.

In this method of controlling a power supply circuit, when the grayscale data of each dot is j bits (j is an integer greater than one), the total value may be a value obtained by sequentially adding higher-order k-bit ($k<j$, k is a natural number) data of each piece of the grayscale data.

In this method of controlling a power supply circuit, k may be one.

These embodiments of the invention will be described in detail below, with reference to the drawings. Note that the embodiments described below do not in any way limit the scope of the invention laid out in the claims herein. In addition, not all of the elements of the embodiments described below should be taken as essential requirements of the invention.

1. Liquid Crystal Display Device

FIG. 1 shows an outline of a configuration of an active matrix type liquid crystal display device to which a power supply circuit according to one embodiment of the invention is applied.

A liquid crystal display device 10 includes an LCD panel (display panel in a broad sense; electro-optical device in a broader sense) 20. The LCD panel 20 is formed on a glass substrate, for example. A plurality of scan lines (gate lines) GL1 to GLM (M is an integer greater than one), arranged in a direction Y and extending in a direction X, and a plurality of data lines (source lines) DL1 to DLN (N is an integer greater than one), arranged in the direction X and extending in the direction Y, are disposed on the glass substrate. A pixel area (pixel) is provided corresponding to the intersecting position of the scan line GLm ($1 \leqq m \leqq M$, m is an integer; hereinafter the same) and the data line DLn ($1 \leqq n \leqq N$, n is an integer; hereinafter the same). A thin film transistor (hereinafter abbreviated as "TFT") 22*mn* is disposed in the pixel area.

A gate of the TFT 22*mn* is connected with the scan line GLm. A source of the TFT 22*mn* is connected with the data line DLn. A drain of the TFT 22*mn* is connected with a pixel electrode 26*mn*. A liquid crystal (electro-optical substance in a broad sense) is sealed between the pixel electrode 26*mn* and a common electrode 28*mn* (common electrode COM) opposite to the pixel electrode 26*mn* so that a liquid crystal capacitor (liquid crystal element in a broad sense) 24*mn* is formed. The transmissivity of the pixel changes corresponding to the voltage applied between the pixel electrode 26*mn* and the common electrode 28*mn*. A common electrode voltage VCOM is supplied to the common electrode 28*mn*.

The LCD panel 20 is formed by attaching a first substrate, on which the pixel electrode and the TFT are formed, to a second substrate, on which the common electrode is formed, and sealing a liquid crystal as the electro-optical substance between the substrates, for example.

The liquid crystal display device 10 includes a data driver (display driver in a broad sense) 30. The data driver 30 drives the data lines DL1 to DLN of the LCD panel 20 based on grayscale data.

The liquid crystal display device 10 may include a gate driver (display driver in a broad sense) 32. The gate driver 32 sequentially drives (scans) the scan lines GL1 to GLM of the LCD panel 20 within one vertical scan period.

The liquid crystal display device 10 includes a power supply circuit 100. The power supply circuit 100 generates voltages necessary for driving the data lines, and supplies the generated voltages to the data driver 30. The power supply circuit 100 generates power supply voltages VDD and VSS necessary for the data driver 30 to drive the data lines and voltages for a logic section of the data driver 30, for example. The power supply circuit 100 also generates a voltage necessary for driving (scanning) the scan lines, and supplies the generated voltage to the gate driver 32.

The power supply circuit 100 also generates the common electrode voltage VCOM. Specifically, the power supply circuit 100 outputs the common electrode voltage VCOM, which alternately changes between a high-potential-side voltage VCOMH and a low-potential-side voltage VCOML in synchronization with the timing of a polarity inversion signal POL generated by the data driver 30, to the common electrode of the LCD panel 20. The common electrode of each pixel is set at the same potential, for example. In FIG. 1, the common electrode of each pixel is illustrated as the common electrode COM.

The liquid crystal display device 10 may include a display controller 38. The display controller 38 controls the data driver 30, the gate driver 32, and the power supply circuit 100 according to the content set by a host (not shown) such as a central processing unit (hereinafter abbreviated as "CPU"). For example, the display controller 38 sets the operation mode, the polarity inversion drive, and the polarity inversion timing of the data driver 30 and the gate driver 32, and supplies a vertical synchronization signal and a horizontal synchronization signal generated therein to the data driver 30 and the data driver 32.

In FIG. 1, the liquid crystal display device 10 is configured to include the power supply circuit 100 and the display controller 38. However, at least one of the power supply circuit 100 and the display controller 38 may be provided outside the liquid crystal display device 10. Or, the liquid crystal display device 10 may be configured to include the host.

The data driver 30 may include at least one of the gate driver 32 and the power supply circuit 100.

Figure 2:
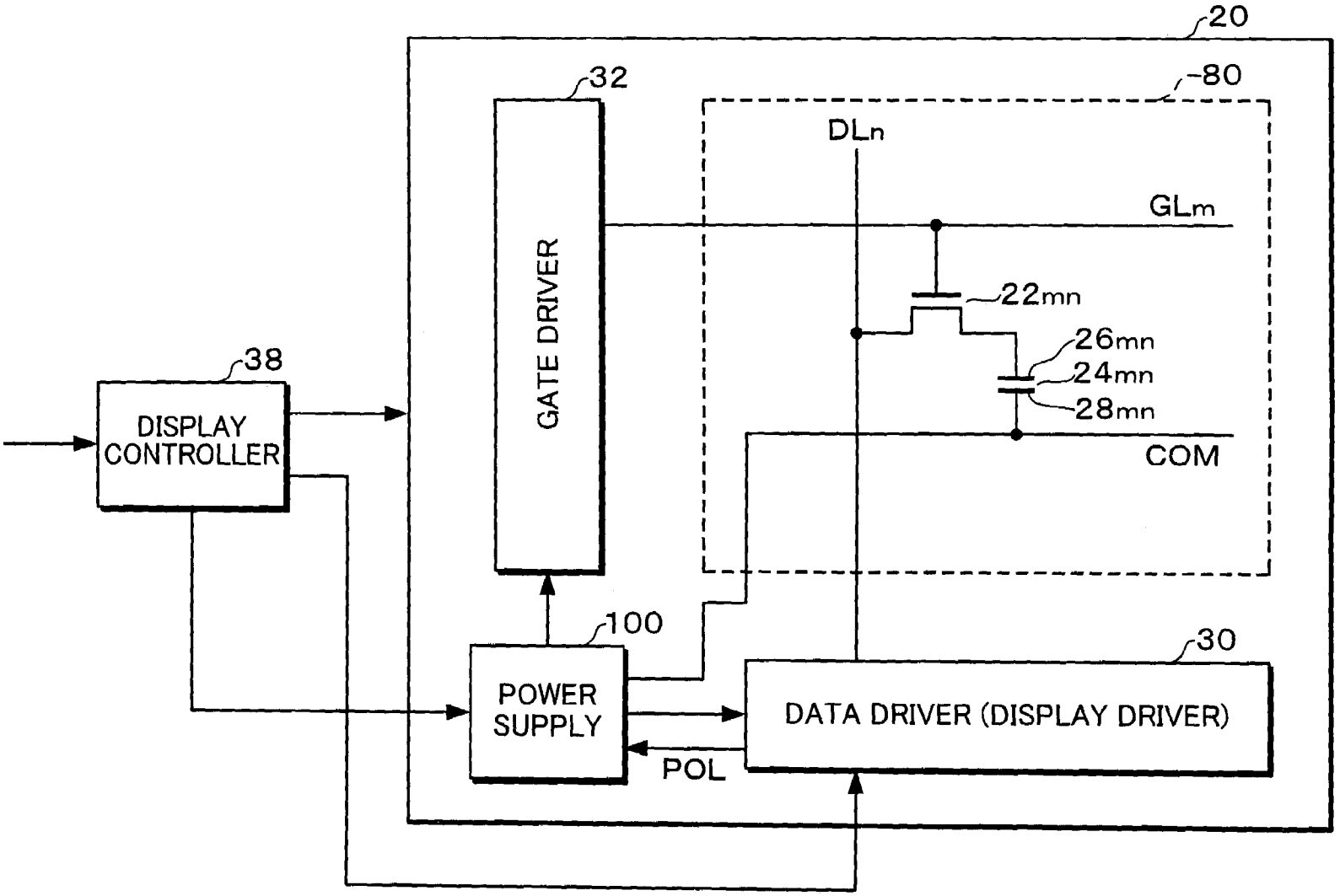
FIG. 2 is a block diagram showing another configuration example of the liquid crystal display device shown in FIG. 1.

Some or all of the data driver 30, the gate driver 32, the display controller 38, and the power supply circuit 100 may be formed on the glass substrate on which the LCD panel 20 is formed. In FIG. 2, the data driver 30, the gate driver 32, and the power supply circuit 100 are formed on the LCD panel 20. Accordingly, the LCD panel 20 may be configured to include a plurality of scan lines, a plurality of data lines, a pixel electrode specified by one of the scan lines and one of the data lines, a common electrode opposite to the pixel electrode through an electro-optical substance, a scan driver which scans the scan lines, a data driver which drives the data lines, and a power supply circuit which supplies a common electrode voltage to the common electrode. A plurality of pixels are formed in a pixel formation region 80 of the LCD panel 20.

1.1 Polarity Inversion Drive Method

When driving a liquid crystal, an electric charge stored in the liquid crystal capacitor must be periodically discharged from the viewpoint of durability of the liquid crystal and contrast. In the liquid crystal display device 10, the polarity of the voltage applied to the liquid crystal is reversed in a given cycle by using a polarity inversion drive. The polarity inversion drive method is divided into a field inversion drive and a line inversion drive depending on the type of polarity inversion cycle, for example.

The field inversion drive utilizes a method in which the polarity of the voltage applied to the liquid crystal is reversed in field units (in units of one vertical scan period). The line inversion drive utilizes a method in which the polarity of the voltage applied to the liquid crystal is reversed in line units (in units of one horizontal scan period). In the line inversion drive, the polarity of the voltage applied to the liquid crystal is reversed in a frame cycle in each line.

Figure 3A:
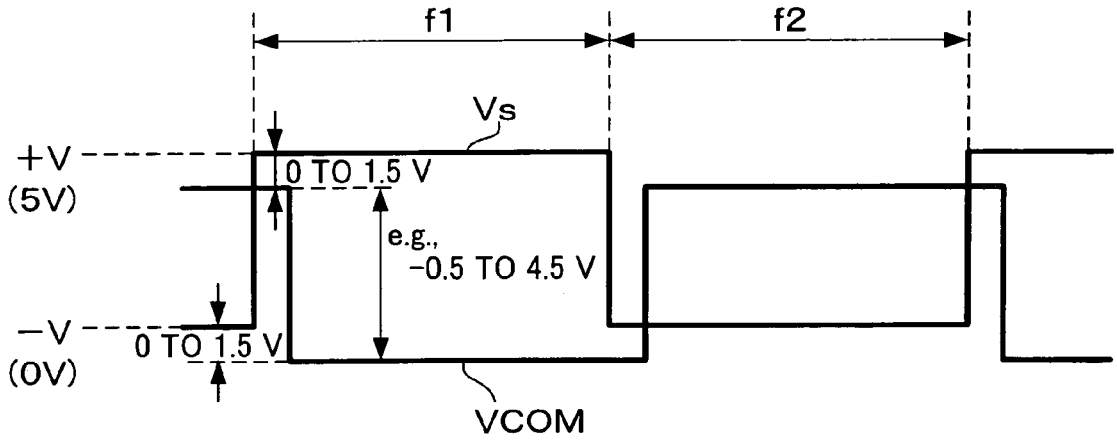
FIGS. 3A and 3B are diagrams illustrative of a polarity inversion drive.
Figure 3B:
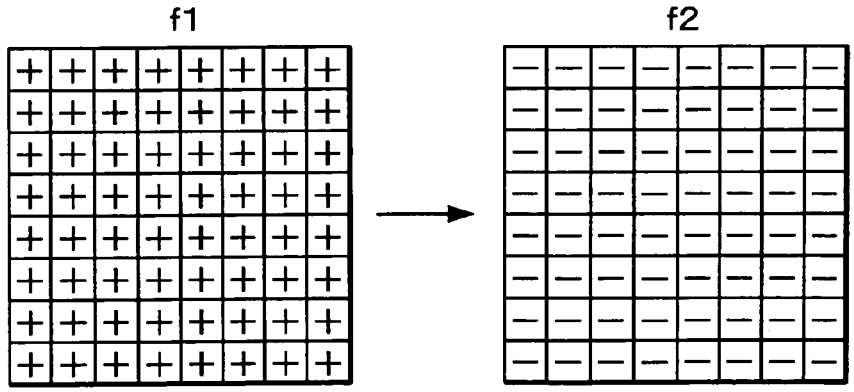

FIGS. 3A and 3B are diagrams illustrative of the operation of the field inversion drive. FIG. 3A schematically shows waveforms of the voltage supplied to the data line and the common electrode voltage VCOM in the field inversion drive. FIG. 3B schematically shows the polarity of the voltage applied to the liquid crystal corresponding to each pixel in units of one vertical scan period when performing the field inversion drive.

In the field inversion drive, the polarity of the voltage supplied to the data line is reversed in units of one vertical scan period, as shown in FIG. 3A. Specifically, a voltage Vs supplied to the source of the TFT connected with the data line is set at "+V" in a frame f1 and is set at "−V" in the subsequent frame f2. The polarity of the common electrode voltage VCOM supplied to the common electrode opposite to the pixel electrode connected with the drain electrode of the TFT is also reversed in synchronization with the polarity inversion timing of the voltage supplied to the data line.

Since the difference in voltage between the pixel electrode and the common electrode is applied to the liquid crystal, the polarity of the voltage is reversed in the frame f1 and the frame f2, as shown in FIG. 3B.

Figure 4A:
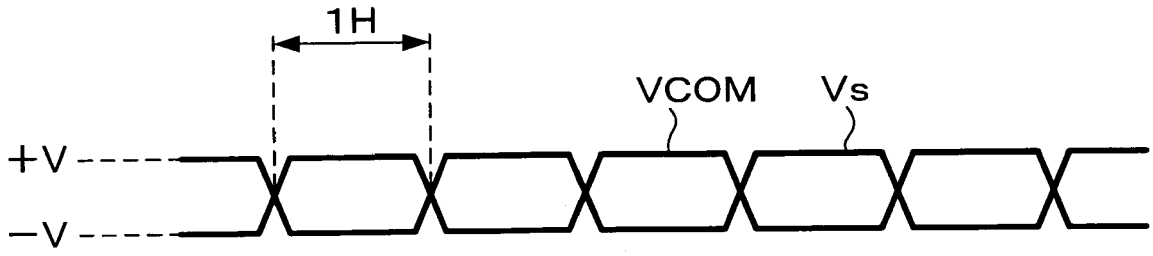
FIGS. 4A and 4B are diagrams illustrative of a polarity inversion drive.
Figure 4B:
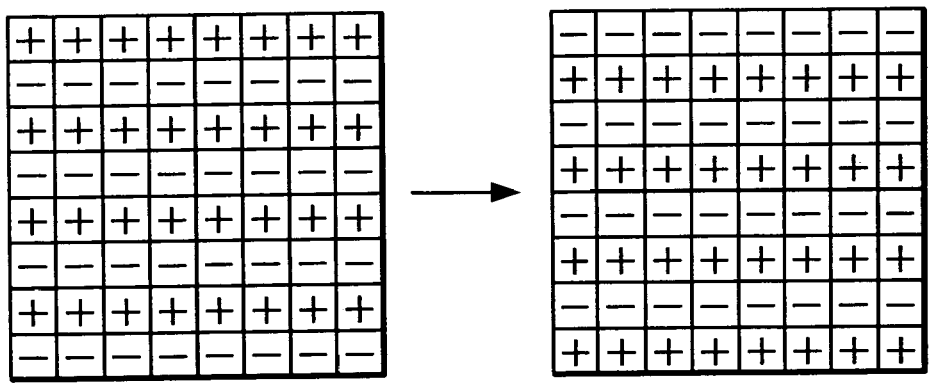

FIGS. 4A and 4B are diagrams illustrative of the operation of the line inversion drive. FIG. 4A schematically shows waveforms of the voltage supplied to the data line and the common electrode voltage VCOM in the line inversion drive. FIG. 4B schematically shows the polarity of the voltage applied to the liquid crystal corresponding to each pixel in units of one vertical scan period when performing the line inversion drive.

In the line inversion drive, the polarity of the voltage supplied to the data line is reversed in units of one horizontal scan period (1H) and in units of one vertical scan period, as shown in FIG. 4A. Specifically, the voltage Vs supplied to the source of the TFT connected with the data line is set at "+V" in 1H (one horizontal scan period) in the frame f1 and is set at "−V" in the next 1H.

An N-line inversion drive differs from the line inversion drive shown in FIGS. 4A and 4B in that the polarity of the common electrode voltage VCOM is reversed in units of two or more horizontal scan periods.

In FIGS. 3A and 4A, the voltage applied to the liquid crystal is reversed by a common inversion drive which changes the voltage level of the common electrode voltage VCOM.

Figure 5:
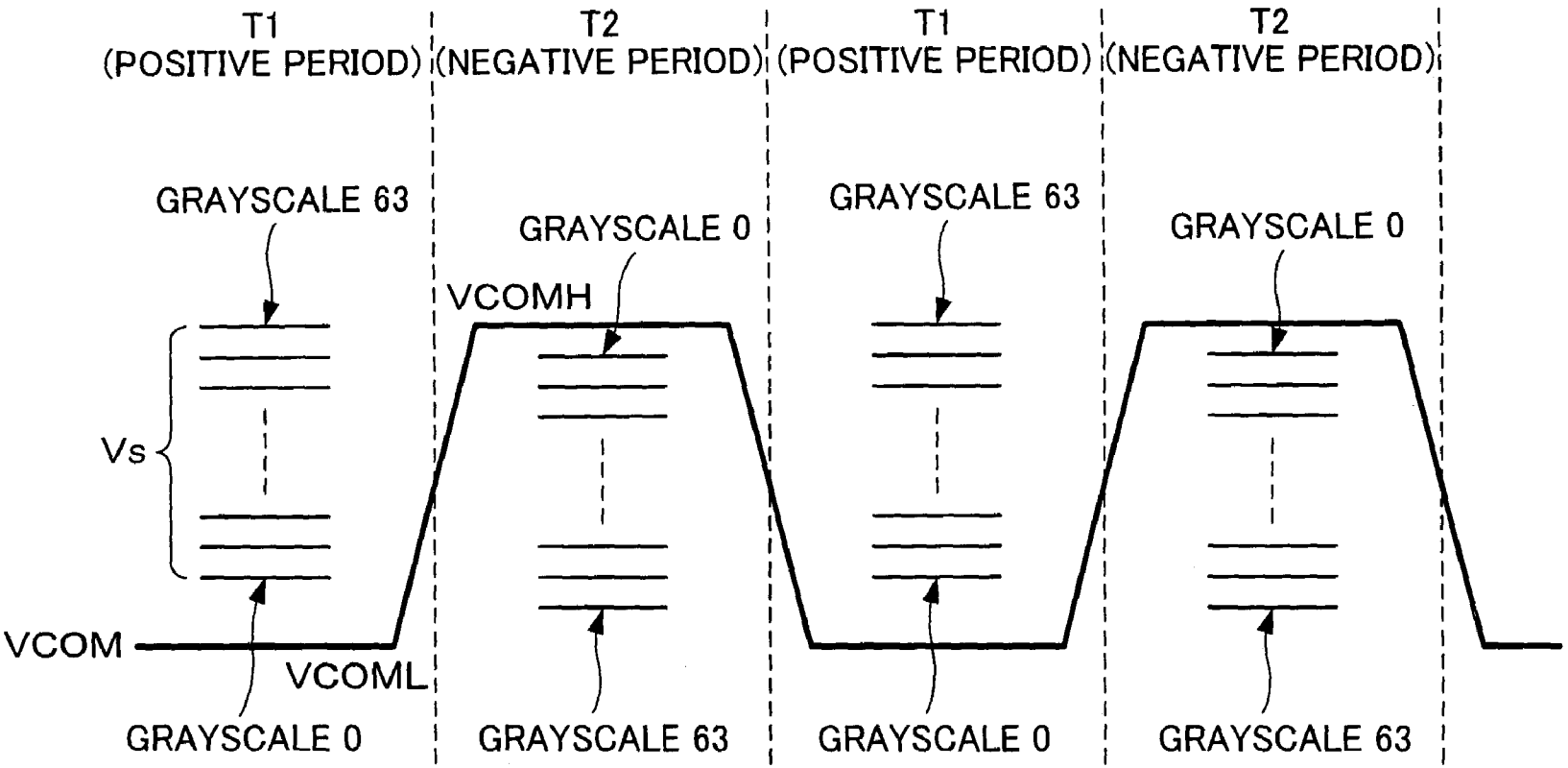
FIG. 5 is a diagram illustrative of the case of combining a line inversion drive and a common inversion drive.

FIG. 5 is a detailed diagram illustrative of the case of combining the line inversion drive and the common inversion drive.

In FIG. 5, a positive voltage is applied to the liquid crystal element in the mth scan period (select period of the scan line GLm), a negative voltage is applied to the liquid crystal element in the (m+1)th scan period, and a positive voltage is applied to the liquid crystal element in the (m+2)th scan period, for example. In the next frame, a negative voltage is applied to the liquid crystal element in the mth scan period, a positive voltage is applied to the liquid crystal element in the (m+1)th scan period, and a negative voltage is applied to the liquid crystal element in the (m+2)th scan period. In the line inversion drive, the polarity of the voltage (common voltage) VCOM of the common electrode COM is reversed in scan period units.

In more detail, the common electrode voltage VCOM is set at the high-potential-side voltage VCOMH in a positive period T1 (first period) and is set at the low-potential-side voltage VCOML in a negative period T2 (second period).

The positive period T1 is a period in which the voltage Vs of the data line (pixel electrode) is higher than the common electrode voltage VCOM. In the period T1, a positive voltage is applied to the liquid crystal element. The negative period T2 is a period in which the voltage Vs of the data line is lower than the common electrode voltage VCOM. In the period T2, a negative voltage is applied to the liquid crystal element. The high-potential-side voltage VCOMH may be referred to as a voltage obtained by reversing the polarity of the low-potential-side voltage VCOML with respect to a given voltage.

The voltage necessary for driving the LCD panel can be decreased by reversing the polarity of the common electrode voltage VCOM in this manner. This allows the breakdown voltage of the driver circuit of the LCD panel to be reduced, whereby the manufacturing process of the driver circuit can be simplified and the manufacturing cost can be reduced.

2. Supply Capability Control

The capability of the power supply circuit to supply the common electrode voltage VCOM is determined depending on the load of the common electrode COM. Since the image quality deteriorates if the power supply capability of the power supply circuit is insufficient, the power supply capability is generally determined taking into consideration the maximum value of the amount of electric charge which must be charged into or discharged from the common electrode COM.

However, the voltage Vs of the data line changes depending on a grayscale value indicated by the grayscale data. Since the grayscale value differs in scan line units, the voltage Vs of the data line also differs in scan line units. Since the pixel electrode and the common electrode are capacitively coupled as described above, the supply capability of the common electrode voltage VCOM is unnecessary depending on the voltage applied to the pixel electrode.

The data voltage supplied to the data line from the data driver 30 is applied to the pixel electrode opposite to the common electrode through the liquid crystal. The data driver according to one embodiment of the invention can precharge the data line before supplying the data voltage to the data line corresponding to the grayscale data. The data line can be promptly set at a desired voltage by precharging the data line, so that deterioration of the image quality can be prevented.

However, since the common electrode is capacitively coupled with the pixel electrode as described above, the voltage level of the common electrode changes corresponding to the voltage applied to the pixel electrode. When the common electrode voltage supplied to the common electrode changes due to the polarity inversion drive, the voltage level of the common electrode cannot follow such a change. Such a change in the voltage level of the common electrode voltage causes deterioration of the image quality.

Figure 6A:
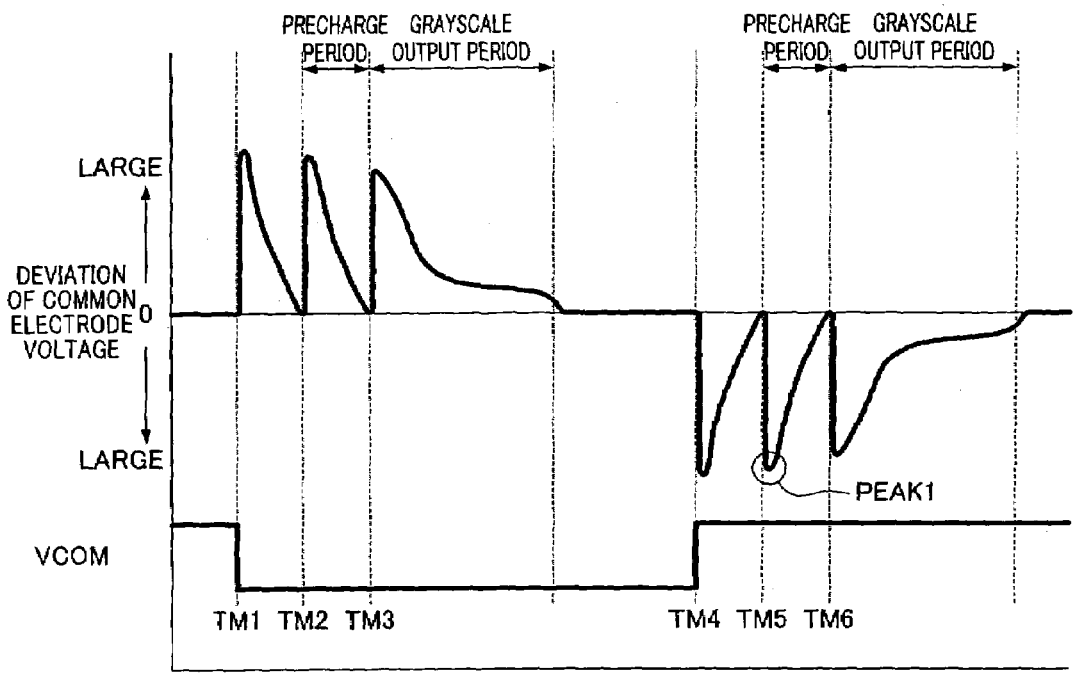
FIGS. 6A and 6B are diagrams illustrative of a change in common electrode voltage.
Figure 6B:
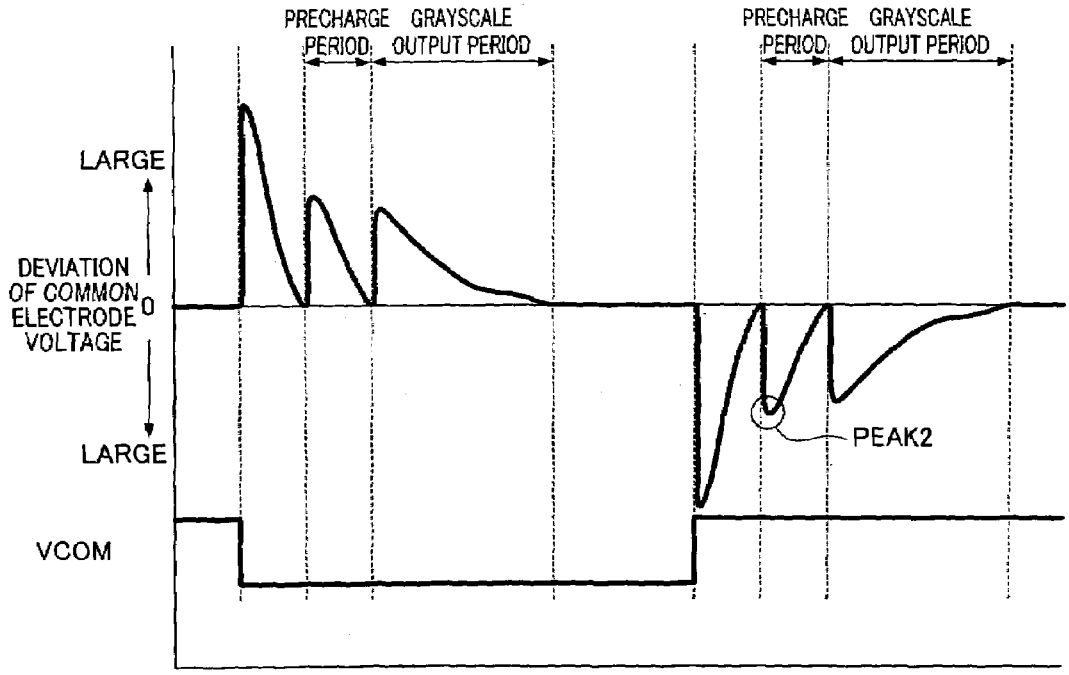

FIGS. 6A and 6B are diagrams illustrative of a change in the common electrode voltage.

FIGS. 6A and 6B show the amount of deviation of the common electrode voltage in two consecutive horizontal scan periods when performing the polarity inversion drive in a general normally-white active matrix type LCD panel. FIGS. 6A and 6B show an ideal common waveform of the common electrode voltage VCOM.

FIG. 6A shows the case of continuously performing a black display in two horizontal scan periods, and FIG. 6B shows the case of continuously performing a gray display in two horizontal scan periods. In a normally-white LCD panel, a black display occurs when the data voltage is the highest, and a gray display occurs by decreasing the data voltage.

At a timing TM1 at which the ideal common waveform changes from the H level to the L level, the voltage level of the capacitive common electrode cannot follow the ideal common waveform, so that the amount of deviation of the common electrode voltage initially increases in the positive direction and gradually returns to zero.

A precharge period of the data line starts after a certain period has elapsed from the timing TM1 (TM2). In the precharge period, the data line is set at a specific precharge voltage. The precharge voltage is applied to the pixel electrode, and the voltage level of the common electrode also changes in the precharge direction. In FIG. 6A, the amount of deviation changes on the positive side in the precharge period.

A grayscale output period starts after the precharge period (TM3). In the grayscale output period, the data driver 30 supplies the data voltage corresponding to the grayscale data to the data line. Therefore, since the data voltage is applied to the pixel electrode in the grayscale output period, the amount of deviation of the common electrode voltage increases in the positive direction and gradually returns to zero in FIG. 6A.

When the next horizontal scan period starts, the ideal common waveform changes from the L level to the H level (TM4). Since the voltage level of the capacitive common electrode cannot follow the ideal common waveform, the amount of deviation of the common electrode voltage initially increases in the negative direction and gradually returns to zero.

The precharge period of the data line starts after a certain period has elapsed from the timing TM4 (TM5). In the precharge period, the precharge voltage is applied to the pixel electrode, and the voltage level of the common electrode also changes in the precharge direction. In the precharge period which starts at the timing TM5, the amount of deviation of the common electrode voltage is determined corresponding to the difference between the data voltage and the precharge voltage in the grayscale output period in the preceding horizontal scan period (preceding scan line).

In the grayscale output period which starts after the precharge period (TM6), the data driver 30 supplies the data voltage corresponding to the grayscale data in the present horizontal scan period (present scan line) to the data line. Therefore, since the data voltage is applied to the pixel electrode in the grayscale output period, the amount of deviation of the common electrode voltage increases in the negative direction and gradually returns to zero in FIG. 6A.

In FIG. 6B, since a gray display is continuously performed in two horizontal scan periods differing from FIG. 6A, the amount of deviation of the common electrode voltage in each precharge period is smaller than that of FIG. 6A (PEAK2<PEAK1).

When the polarity of the common electrode voltage based on a given voltage differs in two consecutive horizontal scan periods as in the line inversion drive, the data voltage (write voltage) applied in the grayscale output period in the preceding horizontal scan period significantly affects the amount of deviation of the common electrode voltage in the data line precharge period in the subsequent horizontal scan period. Since the supply capability of the common electrode voltage is fixed in order to reduce the amount of deviation of the common electrode voltage, unnecessary power consumption occurs when the amount of deviation is small. Therefore, power consumption can be reduced without causing the image quality to deteriorate by controlling the supply capability of the common electrode voltage corresponding to the amount of deviation of the common electrode voltage.

In the field inversion drive, the ideal common waveform does not change in most period.

Figure 7:
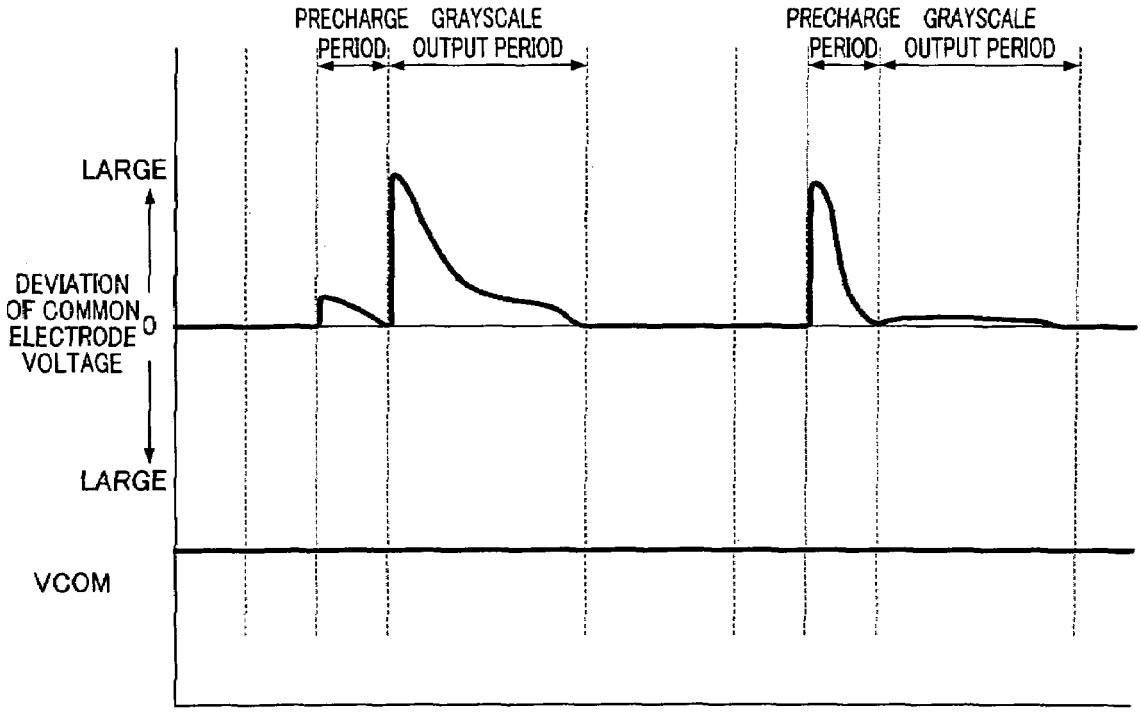
FIG. 7 is a diagram illustrative of a change in common electrode voltage in a field inversion drive.

FIG. 7 is a diagram illustrative of a change in the common electrode voltage in the field inversion drive.

FIG. 7 shows the case of performing a black display and a white display in a normally white LCD panel in two horizontal scan periods in which the ideal common waveform is set at the L level.

In the field inversion drive, the voltage level of the common electrode voltage changes when the data line is set at the precharge voltage in the precharge period in each horizontal scan period. When the polarity of the common electrode voltage based on a given voltage is the same in two consecutive horizontal scan periods as in the field inversion drive, the data voltage (write voltage) applied in the grayscale output period in the preceding horizontal scan period significantly affects the amount of deviation of the common electrode voltage in the data line precharge period in the subsequent horizontal scan period. Therefore, power consumption can be reduced without causing the image quality to deteriorate by controlling the supply capability of the common electrode voltage corresponding to the amount of deviation of the common electrode voltage.

However, the correction direction of the supply capability control of the common electrode voltage differs in the field inversion drive depending on the quantitative relationship between the data voltage and the precharge voltage in the grayscale output period in the preceding horizontal scan period.

Figure 8:
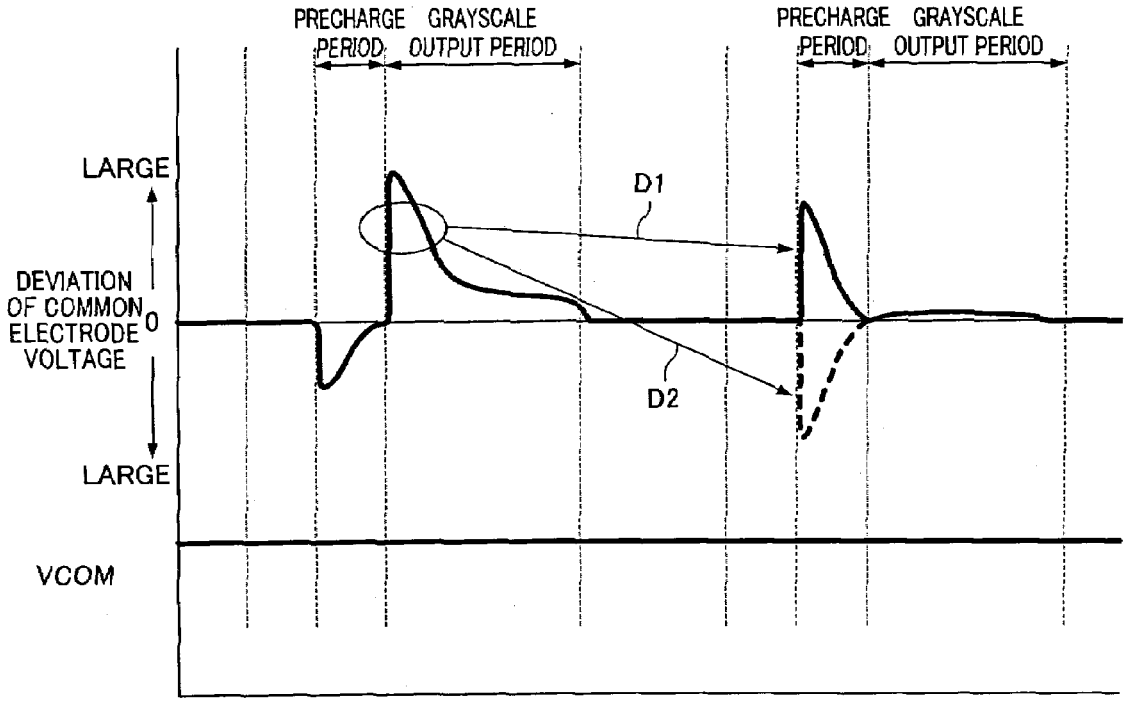
FIG. 8 is a diagram illustrative of a common electrode correction direction in a field inversion drive.

FIG. 8 is a diagram illustrative of the correction direction of the common electrode in the field inversion drive.

For example, when the data voltage is higher than the precharge voltage in the grayscale output period in the preceding horizontal scan period, the potential of the data line is decreased in the precharge period in the subsequent horizontal scan period. Therefore, the amount of deviation of the common electrode voltage is shifted in the negative direction (D2). On the other hand, when the data voltage is lower than the precharge voltage in the grayscale output period in the preceding horizontal scan period, the potential of the data line is increased in the precharge period in the subsequent horizontal scan period. Therefore, the amount of deviation of the common electrode voltage is shifted in the positive direction (D1).

Therefore, it is necessary in the field inversion drive to cause the supply capability control of the common electrode voltage to differ depending on the quantitative relationship between the data voltage and the precharge voltage in the grayscale output period in the preceding horizontal scan period.

FIGS. 7 and 8 illustrate the field inversion drive. However, the above description also applies to the case where the polarity of the common electrode voltage is the same in two consecutive horizontal scan periods in the N-line inversion drive in which the polarity of the common electrode voltage is reversed in units of two or more horizontal scan periods.

Therefore, when the polarity of the common electrode voltage based on a given voltage is the same in two consecutive horizontal scan periods, the power supply circuit according to one embodiment of the invention controls the supply capability of the common electrode voltage depending on the quantitative relationship between the data voltage and the precharge voltage in the grayscale output period in the preceding horizontal scan period.

In more detail, the power supply circuit 100 is provided with a high-potential-side voltage generation circuit which generates the high-potential-side voltage VCOMH of the common electrode voltage VCOM and a low-potential-side voltage generation circuit which generates the low-potential-side voltage VCOML of the common electrode voltage VCOM, and the supply capability of the common electrode voltage is controlled by changing at least one of the current drive capability of the high-potential-side voltage generation circuit, the output voltage level of the high-potential-side voltage generation circuit, the current drive capability of the low-potential-side voltage generation circuit, and the output voltage level of the low-potential-side voltage generation circuit. Specifically, the amount of positive electric charge removed from (amount of negative electric charge supplied to) the common electrode or the amount of positive electric charge supplied to (amount of negative electric charge removed from) the common electrode is changed by changing at least one of the current drive capability of the high-potential-side voltage generation circuit, the output voltage level of the high-potential-side voltage generation circuit, the current drive capability of the low-potential-side voltage generation circuit, and the output voltage level of the low-potential-side voltage generation circuit. This enables the circuit scale and power consumption of the power supply circuit to be reduced without causing deterioration of the image quality of the LCD panel.

Figure 9:
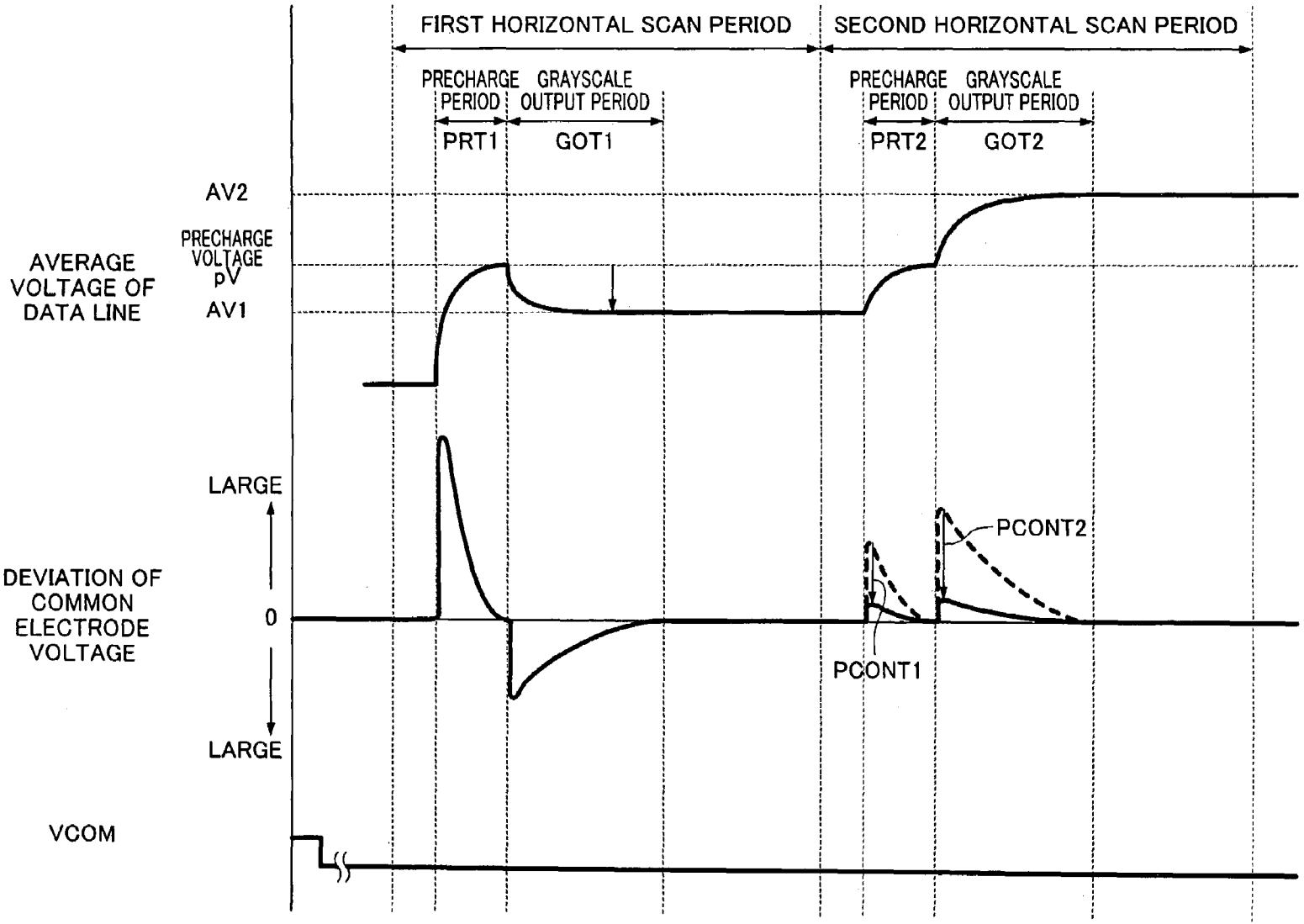
FIG. 9 is a first diagram illustrative of supply capability control of a common electrode voltage performed by the power supply circuit according to one embodiment of the invention.

FIG. 9 is a first diagram illustrative of the supply capability control of the common electrode voltage performed by the power supply circuit according to one embodiment of the invention.

FIG. 9 shows the data voltage supplied to the data line, the amount of deviation of the common electrode voltage, and the ideal common waveform on the same time axis when the polarity of the common electrode voltage based on a given voltage is the same in consecutive first and second horizontal scan periods (a plurality of horizontal scan periods).

In FIG. 9, the average voltage which is the average value of the data voltages supplied to the data lines DL1 to DLN of the LCD panel 20 is employed as the data voltage, and the quantitative relationship between the average voltage and the precharge voltage is examined. This is because the common electrode is opposite to the pixel electrodes of the pixels electrically connected with the data lines DL1 to DLN and is capacitively coupled with these pixel electrodes.

In each horizontal scan period, a precharge period PRT1 or PRT2 for setting the data line at a precharge voltage pV and a grayscale output period GOT1 or GOT2 for supplying the data voltage corresponding to the grayscale data to the data line are provided. The grayscale output period GOT1 or GOT2 may be referred to as the period after the precharge period PRT1 or PRT2.

The data driver 30 sets the data lines DL1 to DLN at the precharge voltage pV in the precharge period PRT1 in the first horizontal scan period, and sets the data lines DL1 to DLN at a voltage AV1 (AV1<pV) as the average voltage of the data lines in the grayscale output period GOT1. In the precharge period PRT1, since the voltage of the pixel electrode electrically connected with the data line increases, the amount of deviation of the common electrode voltage increases in the positive direction and gradually returns to zero. In the grayscale output period GOT1, since the precharge voltage pV is higher than the average voltage AV1 of the data line, the amount of deviation of the common electrode voltage increases in the negative direction accompanying a decrease in the voltage of the data line, and gradually returns to zero.

The data driver 30 may stop driving the data lines and electrically disconnect the output of the data driver 30 from the data lines DL1 to DLN in a period in the first horizontal scan period after the grayscale output period GOT1.

In the precharge period PRT2 in the subsequent second horizontal scan period, the data driver 30 sets the data lines DL1 to DLN at the precharge voltage pV. In the precharge period PRT2, since the potential of the data line is increased from the average voltage AV1 to the precharge voltage pV, the amount of deviation of the voltage of the capacitively coupled common electrode increases in the positive direction and gradually returns to zero. Since it becomes unnecessary to always drive the common electrode at a high supply capability by reducing the amount of deviation of the common electrode voltage (PCONT1), power consumption can be reduced. Therefore, the supply capability control according to one embodiment of the invention increases the amount of positive electric charge removed from the common electrode in the precharge period in the second horizontal scan period.

In the grayscale output period GOT2, the data driver 30 sets a voltage AV2 higher than the precharge voltage pV as the average voltage of the data lines. Therefore, in the grayscale output period GOT2, the amount of deviation of the common electrode voltage increases in the positive direction accompanying an increase in the voltage of the data line, and gradually returns to zero. Power consumption can also be reduced by reducing the amount of deviation of the common electrode voltage (PCONT2). Therefore, in the supply capability control according to one embodiment of the invention, it is preferable to perform the supply capability control of the common electrode voltage which increases the amount of positive electric charge removed from the common electrode corresponding to the precharge voltage and the average voltage when the precharge voltage is lower than the average voltage of the data lines in the grayscale output period in the second horizontal scan period.

The data driver 30 may stop driving the data lines and electrically disconnect the output of the data driver 30 from the data lines DL1 to DLN in a period in the second horizontal scan period after the grayscale output period GOT2.

Figure 10:
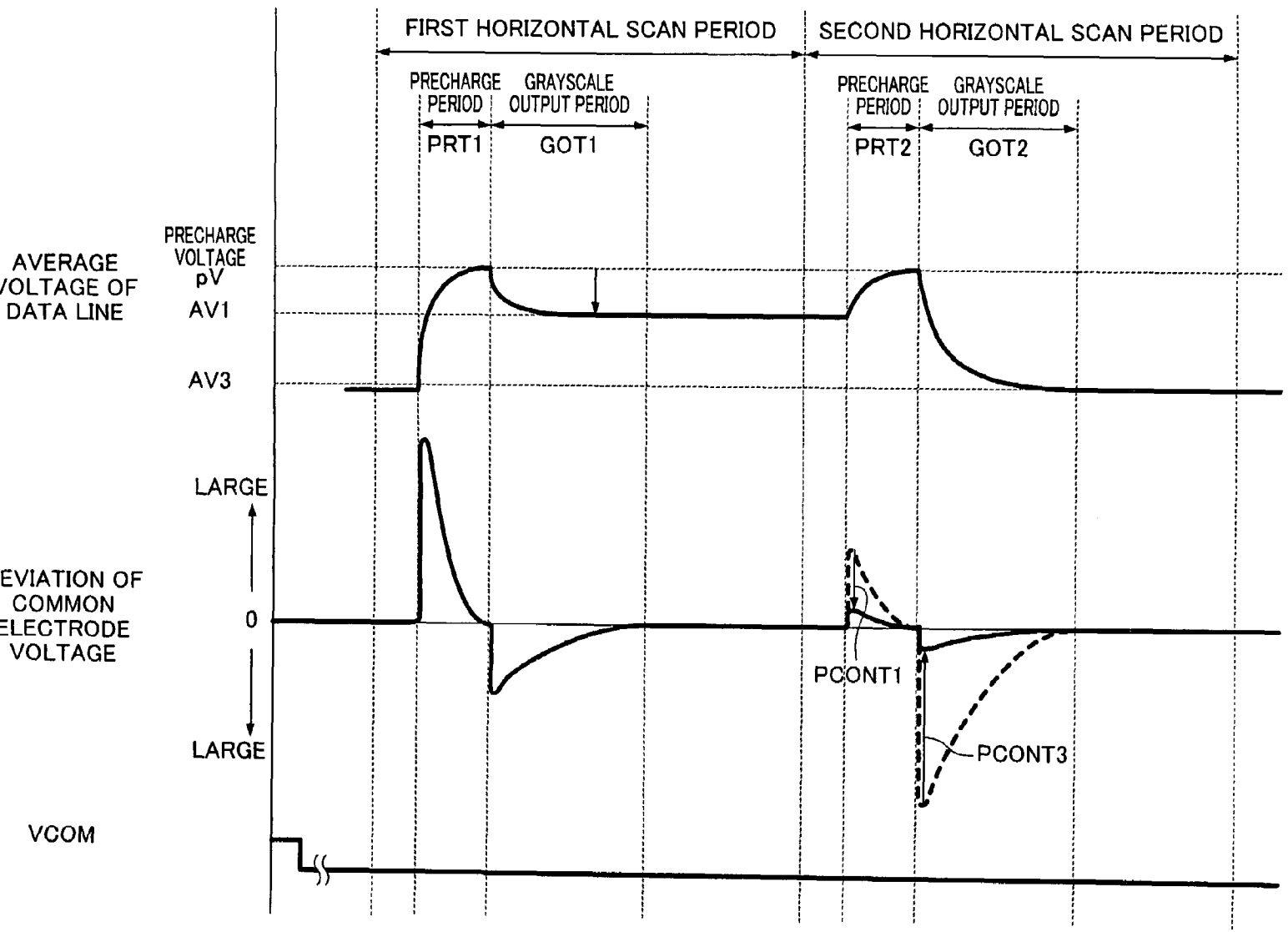
FIG. 10 is a second diagram illustrative of supply capability control of a common electrode voltage performed by the power supply circuit according to one embodiment of the invention.

FIG. 10 is a second diagram illustrative of the supply capability control of the common electrode voltage performed by the power supply circuit according to one embodiment of the invention.

FIG. 10 differs from FIG. 9 as to the state of the grayscale output period GTO2 in the second horizontal scan period. Specifically, while the average voltage AV2 of the data lines is higher than the precharge voltage pV in the grayscale output period GTO2 in the second horizontal scan period in FIG. 9, an average voltage AV3 of the data lines is lower than the precharge voltage pV in the grayscale output period GTO2 in the second horizontal scan period in FIG. 10.

In the grayscale output period GOT2 in the second horizontal scan period, the data driver 30 sets the voltage AV3 lower than the precharge voltage pV as the average voltage of the data lines. Therefore, in the grayscale output period GOT2, the amount of deviation of the common electrode voltage increases in the negative direction accompanying a decrease in the voltage of the data line, and gradually returns to zero. Power consumption can also be reduced by reducing the amount of deviation of the common electrode voltage (PCONT3). Therefore, in the supply capability control according to one embodiment of the invention, it is preferable to perform the supply capability control of the common electrode voltage which increases the amount of positive electric charge supplied to the common electrode corresponding to the precharge voltage and the average voltage when the precharge voltage is higher than the average voltage of the data lines in the grayscale output period in the second horizontal scan period.

Figure 11:
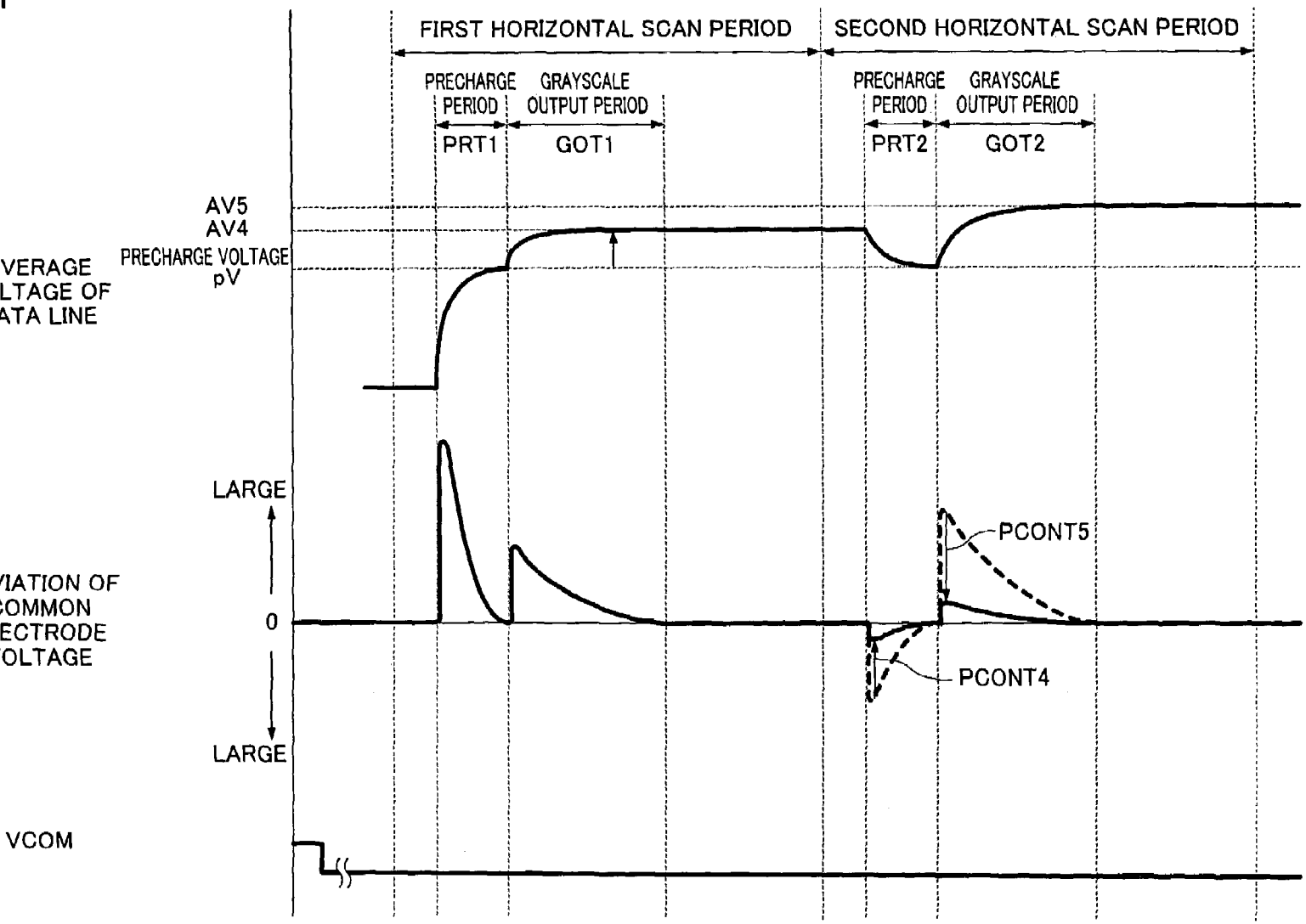
FIG. 11 is a third diagram illustrative of supply capability control of a common electrode voltage performed by the power supply circuit according to one embodiment of the invention.

FIG. 11 is a third diagram illustrative of the supply capability control of the common electrode voltage performed by the power supply circuit according to one embodiment of the invention.

The data driver 30 sets the data lines DL1 to DLN at the precharge voltage pV in the precharge period PRT1 in the first horizontal scan period, and sets the data lines DL1 to DLN at a voltage AV4 (AV4>pV) as the average voltage of the data lines in the grayscale output period GOT1. In the precharge period PRT1, since the voltage of the pixel electrode electrically connected with the data line increases, the amount of deviation of the common electrode voltage increases in the positive direction and gradually returns to zero. In the grayscale output period GOT1, since the precharge voltage pV is lower than the average voltage AV4 of the data lines, the amount of deviation of the common electrode voltage increases in the positive direction accompanying an increase in the voltage of the data lines, and gradually returns to zero.

The data driver 30 may stop driving the data lines and electrically disconnect the output of the data driver 30 from the data lines DL1 to DLN in a period in the first horizontal scan period after the grayscale output period GOT1.

In the precharge period PRT2 in the subsequent second horizontal scan period, the data driver 30 sets the data lines DL1 to DLN at the precharge voltage pV. In the precharge period PRT2, since the potential of the data line is decreased from the average voltage AV4 to the precharge voltage pV, the amount of deviation of the voltage of the capacitively coupled common electrode increases in the negative direction and gradually returns to zero. Since it becomes unnecessary to always drive the common electrode at a high supply capability by reducing the amount of deviation of the common electrode voltage (PCONT4), power consumption can be reduced. Therefore, the supply capability control according to one embodiment of the invention increases the amount of positive electric charge supplied to the common electrode in the precharge period in the second horizontal scan period.

In the grayscale output period GOT2, the data driver 30 sets a voltage AV5 higher than the precharge voltage pV as the average voltage of the data lines. Therefore, in the grayscale output period GOT2, the amount of deviation of the common electrode voltage increases in the positive direction accompanying an increase in the voltage of the data line, and gradually returns to zero. Power consumption can also be reduced by reducing the amount of deviation of the common electrode voltage (PCONT5). Therefore, in the supply capability control according to one embodiment of the invention, it is preferable to perform the supply capability control of the common electrode voltage which increases the amount of positive electric charge removed from the common electrode corresponding to the precharge voltage and the average voltage when the precharge voltage is lower than the average voltage of the data lines in the grayscale output period in the second horizontal scan period.

The data driver 30 may stop driving the data lines and electrically disconnect the output of the data driver 30 from the data lines DL1 to DLN in a period in the second horizontal scan period after the grayscale output period GOT2.

Figure 12:
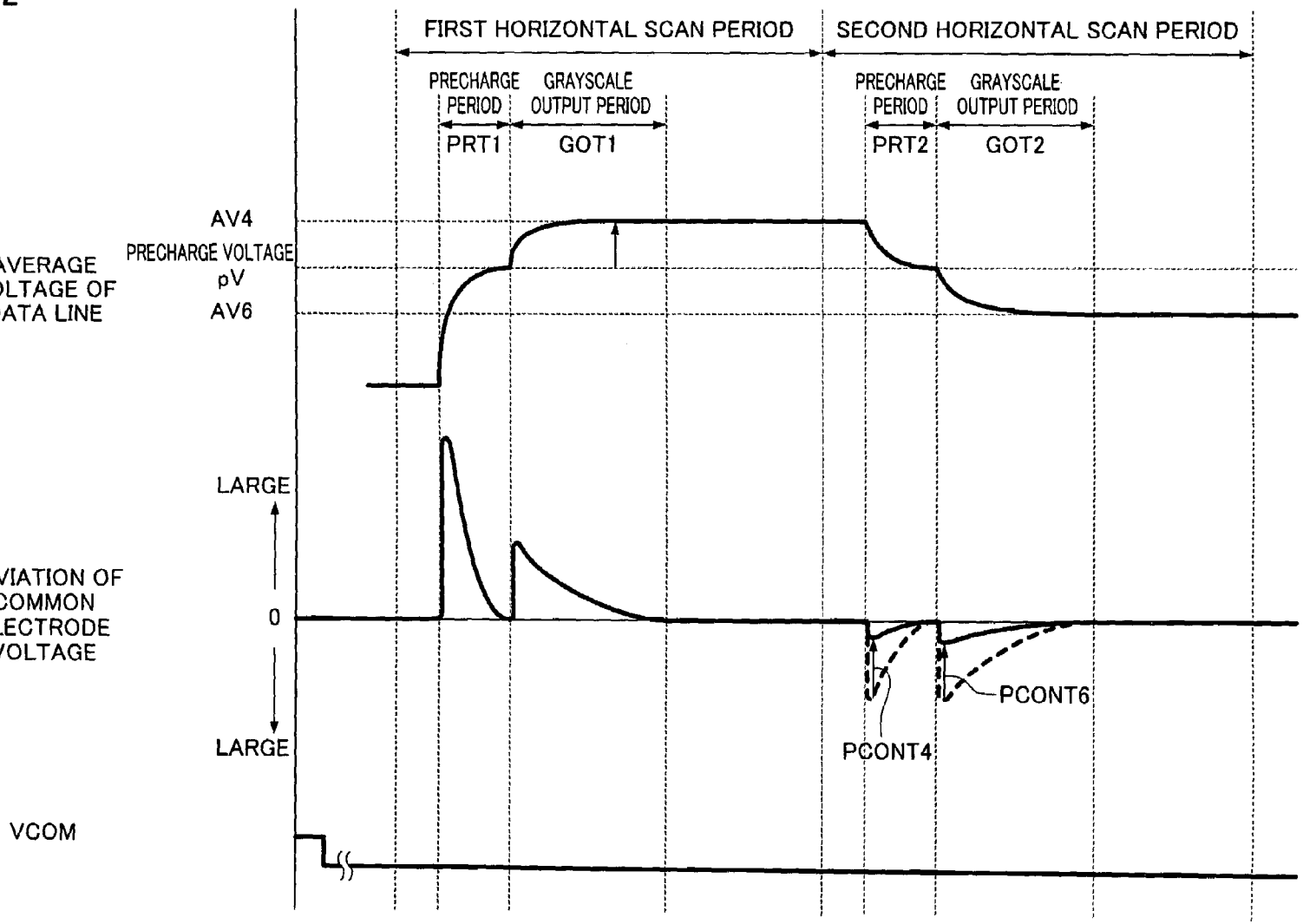
FIG. 12 is a fourth diagram illustrative of supply capability control of a common electrode voltage performed by the power supply circuit according to one embodiment of the invention.

FIG. 12 is a fourth diagram illustrative of the supply capability control of the common electrode voltage performed by the power supply circuit according to one embodiment of the invention.

FIG. 12 differs from FIG. 11 as to the state of the grayscale output period GTO2 in the second horizontal scan period. Specifically, while the average voltage AV5 of the data lines is higher than the precharge voltage pV in the grayscale output period GTO2 in the second horizontal scan period in FIG. 11, an average voltage AV6 of the data lines is lower than the precharge voltage pV in the grayscale output period GTO2 in the second horizontal scan period in FIG. 12.

In the grayscale output period GOT2 in the second horizontal scan period, the data driver 30 sets the voltage AV6 lower than the precharge voltage pV as the average voltage of the data lines. Therefore, in the grayscale output period GOT2, the amount of deviation of the common electrode voltage increases in the negative direction accompanying a decrease in the voltage of the data line, and gradually returns to zero. Power consumption can also be reduced by reducing the amount of deviation of the common electrode voltage (PCONT6). Therefore, in the supply capability control according to one embodiment of the invention, it is preferable to perform the supply capability control of the common electrode voltage which increases the amount of positive electric charge supplied to the common electrode corresponding to the precharge voltage and the average voltage when the precharge voltage is higher than the average voltage of the data lines in the grayscale output period in the second horizontal scan period.

In one embodiment of the invention, the average voltage of the data lines DL1 to DLN in the grayscale output period in each horizontal scan period is associated with an evaluation value calculated by using the grayscale data for the number of dots of one scan line in each horizontal scan period. Since the average voltage of the data lines can be estimated based on the evaluation value, if the voltage level of the precharge voltage pV is known, the supply capability of the common electrode voltage can be controlled as described above. Therefore, one embodiment of the invention allows the supply capability of the common electrode voltage to be controlled as described above based on the evaluation value.

Figure 13:
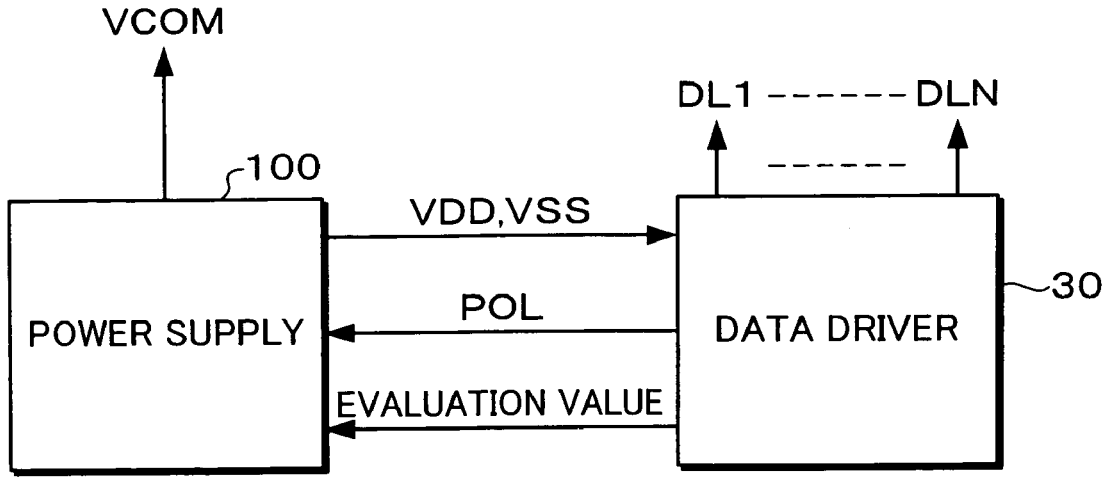
FIG. 13 is a diagram showing a configuration example of a power supply capability control system including the power supply circuit according to one embodiment of the invention.

FIG. 13 shows a configuration example of a power supply capability control system including the power supply circuit according to one embodiment of the invention.

In FIG. 13, sections the same as the sections shown in FIG. 1 or 2 are indicated by the same symbols. Description of these sections is appropriately omitted. In the power supply capability control system, the power supply circuit 100 supplies the power supply voltages VDD and VSS of the data driver 30, for example. The power supply circuit 100 reverses the polarity of the common electrode voltage VCOM in synchronization with the polarity inversion signal POL from the data driver 30. The power supply circuit 100 receives the evaluation value from the data driver 30, and changes the supply capability of the common electrode voltage VCOM based on the evaluation value.

As the evaluation value, a value (line value) calculated based on the grayscale data (line data) for one scan line may be used. For example, the average voltage of the data lines DL1 to DLN is estimated based on the grayscale data for one scan line in the horizontal scan period, and the supply capability of the common electrode voltage VCOM is changed. A value (line value) calculated by using the line data including the grayscale data for the number of part of dots of one scan line instead of the grayscale data for the number of dots of one scan line may be used as the evaluation value.

The data driver 30 and the power supply circuit 100 which realize such control are described below.

2.1 Data Driver

Figure 14:
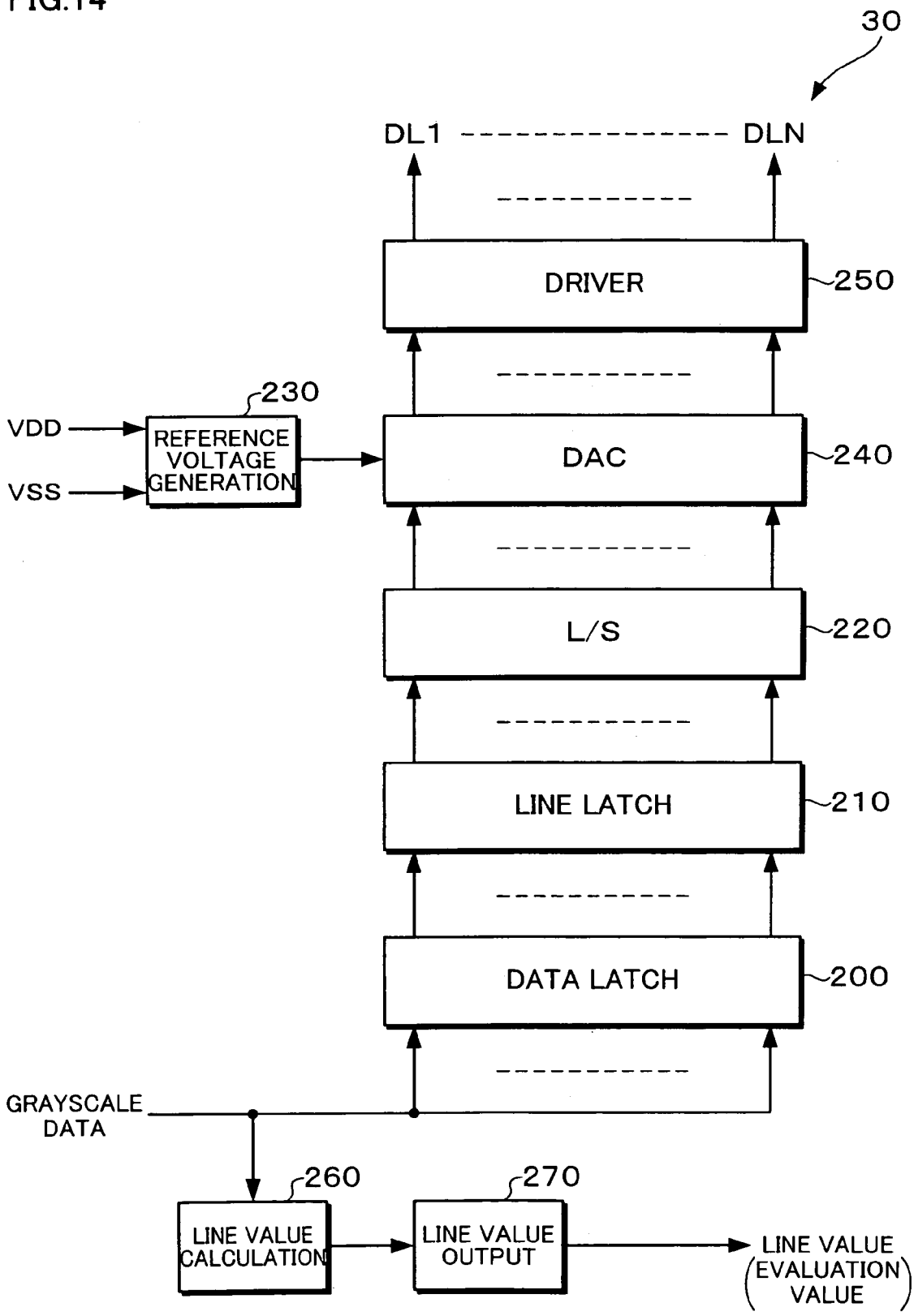
FIG. 14 is a block diagram showing a configuration example of a data driver according to one embodiment of the invention.

FIG. 14 is a block diagram showing a configuration example of the data driver 30 shown in FIG. 1.

The data driver 30 includes a data latch 200, a line latch 210, a level shifter (L/S) 220, a reference voltage generation circuit 230, a digital/analog converter (DAC) (voltage select circuit in a broad sense) 240, and a driver circuit 250.

The data latch 200 includes a plurality of flip-flops connected in series, the flip-flops being provided corresponding to output lines of the data driver 30. The grayscale data is input to each flip-flop, and voltage corresponding to the grayscale data is supplied to each output line. The grayscale data is serially input from the display controller 38 in pixel units (or dot units) in synchronization with a dot clock signal DCK. The data latch 200 acquires the grayscale data for one horizontal scan by shifting the grayscale data in synchronization with the dot clock signal DCK, for example. The dot clock signal DCK is supplied from the display controller 38. When signals for one pixel include a 6-bit R signal, a 6-bit G signal, and a 6-bit B signal, one pixel (=three dots) is made up of 18 bits.

The line latch 210 includes a plurality of flip-flops provided corresponding to the output lines. The line latch 210 latches the grayscale data input to the data latch 200 at the change timing of a horizontal synchronization signal HSYNC.

The L/S 220 includes a plurality of level conversion circuits provided corresponding to the output lines. The level conversion circuit converts the voltage level so that the signal of the grayscale data, which oscillates at a logic voltage of 1.8 V, oscillates at a voltage of 5 V, for example.

The reference voltage generation circuit 230 generates a plurality of reference voltages, each of which corresponds to the grayscale value indicated by the grayscale data. In more detail, the reference voltage generation circuit 230 generates reference voltages V0 to V63, each of which corresponds to 6-bit grayscale data, based on the high-potential-side power supply voltage VDD and the low-potential-side power supply voltage VSS. The high-potential-side power supply voltage VDD and the low-potential-side power supply voltage VSS are generated by the power supply circuit 100, for example.

The DAC 240 includes a plurality of ROM decoder circuits provided corresponding to the output lines. The ROM decoder circuit selects one of the reference voltages V0 to V63 from the reference voltage generation circuit 230 based on the signal of the grayscale data of which the voltage level is converted by the level conversion circuit of the L/S 220. This enables the DAC 240 to generate a data voltage corresponding to the grayscale data in output line units.

The driver circuit 250 drives a plurality of output lines, each of which is connected with the data line of the LCD panel 20. In more detail, the driver circuit 250 includes a plurality of impedance conversion circuits provided corresponding to the output lines. The impedance conversion circuit drives the output line based on the data voltage generated by the DAC 240 in output line units. The impedance conversion circuit is formed by a voltage-follower-connected operational amplifier.

In the data driver 30 having the above-described configuration, the grayscale data for one horizontal scan input to the data latch 200 is latched by the line latch 210, for example. The data voltage is generated in output line units by using the grayscale data latched by the line latch 210. The driver circuit 250 drives each output line based on the data voltage generated by the DAC 240.

Figure 15:
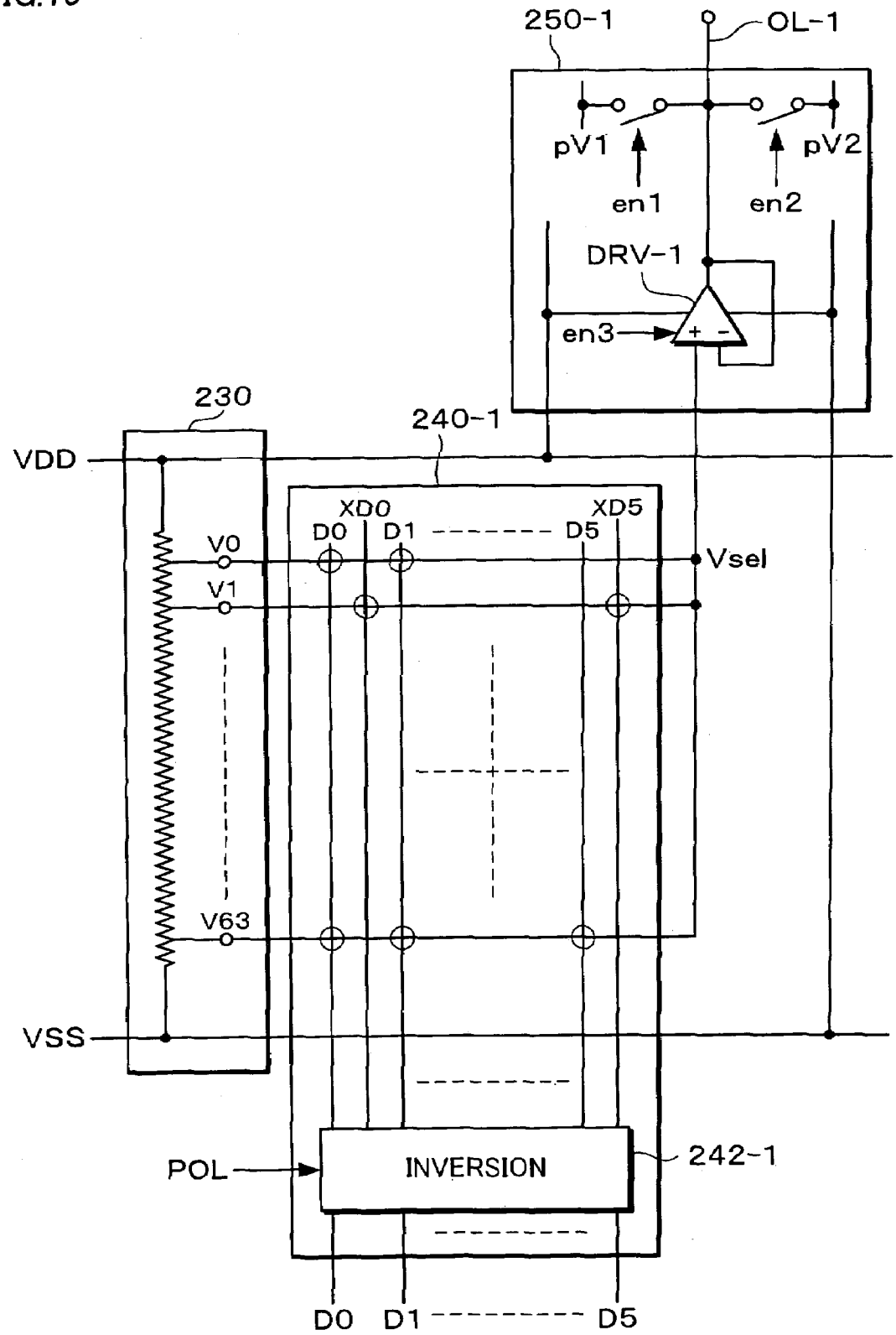
FIG. 15 is a diagram illustrative of the operation of the major portion of the data driver shown in FIG. 14.

FIG. 15 shows an outline of a configuration of the reference voltage generation circuit 230, the DAC 240, and the driver circuit 250. FIG. 9 shows only the configuration corresponding to one output line of the driver circuit 250. However, the same description also applies to other output lines. FIG. 15 shows only the configuration of a driver circuit 250-1 of the driver circuit 250 which drives a data line DL1.

In the reference voltage generation circuit 230, a resistor circuit is connected between the high-potential-side power supply voltage VDD and the low-potential-side power supply voltage VSS. The reference voltage generation circuit 230 generates a plurality of divided voltages obtained by dividing the voltage between the power supply voltages VDD and VSS by using the resistor circuit as the reference voltages V0 to V63. In the polarity inversion drive, since the positive voltage and the negative voltage are not symmetrical in the actual situation, positive reference voltages and negative reference voltages are generated. FIG. 15 shows one of them.

A DAC 240-1 may be realized by a ROM decoder circuit. The DAC 240-1 selects one of the reference voltages V0 to V63 based on the 6-bit grayscale data, and outputs the selected reference voltage to an impedance conversion circuit DRV-1 as a select voltage Vsel. A voltage selected based on the corresponding 6-bit grayscale data is also output to each of the remaining impedance conversion circuits DRV-2 to DRV-N.

The DAC 240-1 includes an inversion circuit 242-1. The inversion circuit 242-1 reverses each bit of the grayscale data based on the polarity inversion signal POL. 6-bit grayscale data D0 to D5 and 6-bit drive inversion grayscale data XD0 to XD5 are input to the ROM decoder circuit. The drive inversion grayscale data XD0 to XD5 is obtained by reversing the logic of the grayscale data D0 to D5, respectively. The ROM decoder circuit selects one of the multi-valued reference voltages V0 to V63 generated by the reference voltage generation circuit 230 based on the grayscale data D0 to D5 and the drive inversion grayscale data XD0 to XD5.

For example, when the polarity inversion signal POL is set at the H level, the reference voltage V2 is selected corresponding to the 6-bit grayscale data D0 to D5 "000010" (=2). When the polarity inversion signal POL is set at the L level, the reference voltage is selected by using the drive inversion grayscale data XD0 to XD5 obtained by reversing the grayscale data D0 to D5. Specifically, the drive inversion grayscale data XD0 to XD5 is "111101" (=61) so that the reference voltage V61 is selected.

The select voltage Vsel selected by the DAC 240-1 is supplied to the impedance conversion circuit DRV-1. The impedance conversion circuit DRV-1 drives the output line OL-1 based on the select voltage Vsel. The power supply circuit 100 changes the common electrode voltage VCOM in synchronization with the polarity inversion signal POL as described above. The polarity of the voltage applied to the liquid crystal is reversed in this manner.

The driver circuit 250-1 includes a precharge circuit. The precharge circuit includes a switch circuit to which the precharge voltage is supplied at one end and which is connected with the output of the impedance conversion circuit DRV-1 at the other end. In FIG. 15, the precharge voltage can be set at either the precharge voltage pV1 or the precharge voltage pV2. However, the precharge voltage may be set at only one of the precharge voltage pV1 and the precharge voltage pV2. Or, the precharge voltage supplied to one end of the switch circuit may be changed.

The switch circuit of the precharge circuit is ON/OFF controlled by using a precharge control signal (not shown). One of the switch circuits is turned ON in the precharge period. In this case, the output of the impedance conversion circuit DRV-1 is set in a high impedance state by using an enable signal en3. In the grayscale output period, the switch circuit of the precharge circuit is turned OF1, and the impedance conversion circuit DRV-1 drives the output line OL-1 in response to the enable signal en3.

The data driver 30 shown in FIG. 14 may include a line value calculation circuit 260 and a line value output section 270. The line value calculation circuit 260 generates a line value as the evaluation value supplied to the power supply circuit 100 based on the grayscale data from the display controller 38. The line value output section 270 includes a buffer. The line value output section 270 adjusts the output timing of the line value generated by the line value calculation circuit 260, and supplies the line value of which the output timing has been adjusted to the power supply circuit 100. By adjusting the output timing the common electrode voltage VCOM of the power supply circuit 100 can be changed while associating the common electrode voltage VCOM with the grayscale data (line data) for one scan line corresponding to the voltage applied to the pixel electrode.

FIG. 14 shows the case where the data driver 30 and the power supply circuit 100 are independently provided. However, the data driver 30 shown in FIG. 14 may include the power supply circuit 100.

2.2 Evaluation Method

In one embodiment of the invention, the common electrode voltage VCOM of the power supply circuit 100 is changed while associating the common electrode voltage VCOM with the grayscale data (line data) for one scan line corresponding to the voltage applied to the pixel electrode.

In one embodiment of the invention described below, the line value calculation circuit 260 shown in FIG. 14 converts the line data into the line value as the evaluation value. The power supply circuit 100 estimates (evaluates) the average voltage of the data lines DL1 to DLN based on the line value, and changes the supply capability of the common electrode voltage VCOM based on the estimation result (evaluation result). This prevents unnecessary current consumption of the power supply circuit 100.

Figure 16:
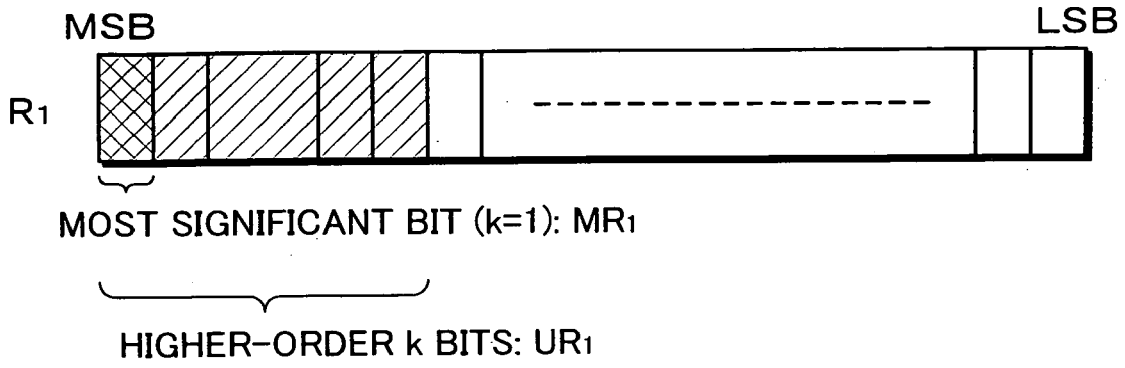
FIG. 16 is a diagram showing a configuration example of grayscale data per dot.

FIG. 16 shows a configuration example of the grayscale data per dot.

FIG. 16 shows a configuration example of the grayscale data corresponding to the voltage supplied to the data line DL1 (output line OL-1). A voltage corresponding to grayscale data $R_1$ of the R component making up one pixel is supplied to the data line DL1.

In this example, the grayscale data $R_1$ is made up of j (j is an integer greater than one) bits. In this case, higher-order k-bit (k<j, k is a natural number) data of the grayscale data $R_1$ includes the most significant bit (MSB) of the grayscale data $R_1$ and is higher-order k-bit data $UR_1$ from the MSB side. When k is "1", the most significant bit of the grayscale data $R_1$ is data $MR_1$ shown in FIG. 16.

Figure 17:
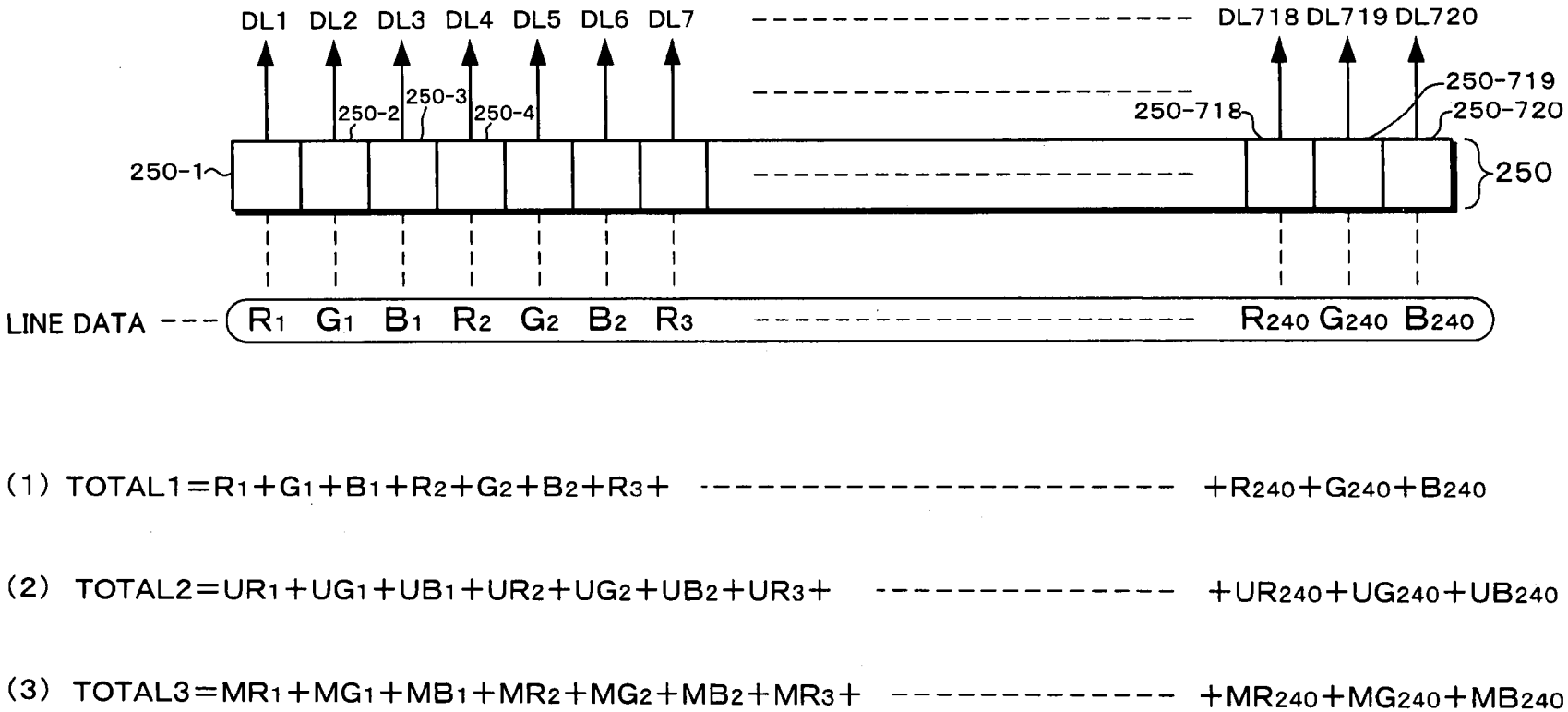
FIG. 17 is a diagram illustrative of an example of calculation processing of a line value calculation circuit shown in FIG. 14.

FIG. 17 is a diagram illustrative of an example of calculation processing of the line value calculation circuit 260 shown in FIG. 14.

In FIG. 17, one pixel is formed by three dots, and the number of pixels for one scan line is 240 (=720 dots).

In one embodiment of the invention, the driver circuit 250-1 drives the data line DL1 based on grayscale data $R_1$ of the R component making up one pixel. The driver circuit 250-2 drives the data line DL2 based on grayscale data $G_1$ of the G component making up one pixel. The driver circuit 250-3 drives the data line DL3 based on grayscale data $B_1$ of the B component making up one pixel. The grayscale data for a pixel $P_1$ is made up of the grayscale data $R_1$, $G_1$, and $B_1$.

Likewise, the driver circuit 2504 drives the data line DL4 based on grayscale data $R_2$ of the R component making up one pixel. +++ The driver circuit 250-5 drives the data line DL5 based on the grayscale data $G_2$ of the G component making up one pixel. The driver circuit 250-6 drives the data line DL6 based on the grayscale data $B_2$ of the B component making up one pixel. The grayscale data for a pixel $P_2$ is made up of the grayscale data $R_2$, $G_2$, and $B_2$.

Likewise, the driver circuit 250-718 drives the data line DL718 based on grayscale data $R_{240}$ of the R component making up one pixel. The driver circuit 250-719 drives the data line DL719 based on the grayscale data $G_{240}$ of the G component making up one pixel. The driver circuit 250-720 drives the data line DL720 based on grayscale data $B_{240}$ of the B component making up one pixel. The grayscale data for a pixel $P_{240}$ is made up of the grayscale data $R_{240}$, $G_{240}$, and $B_{240}$.

For example, the line value calculation circuit 260 calculates a total value TOTAL1, which is obtained by sequentially adding the grayscale data for the number of dots (=720) of one scan line as the line value. For example, the line value calculation circuit 260 includes an adder and a register. The line value calculation circuit 260 sequentially adds serially input grayscale data, stores the result in the register, and adds the value stored in the register and the subsequent grayscale data. The line value calculation circuit 260 repeatedly performs this operation. In this case, the total value TOTAL1 is shown by the following expression.

$$\text{TOTAL1}=R_1+G_1+B_1+R_2+G_2+B_2+\ldots+R_{240}+G_{240}+B_{240} \quad (1)$$

The line value calculation circuit 260 may calculate a total value TOTAL2, which is obtained by sequentially adding higher-order k-bit data of each piece of grayscale data for the number of dots (=720) of one scan line, as the line value. In this case, the total value TOTAL2 is shown by the following expression.

$$\text{TOTAL2}=UR_1+UG_1+UB_1+UR_2+UG_2+UB_2+\ldots+UR_{240}+UG_{240}+UB_{240} \quad (2)$$

The line value calculation circuit 260 may calculate a total value TOTAL3, which is obtained by sequentially adding the most significant bit (k=1) data of each of the grayscale data for the number of dots (=720) of one scan line as the line value. In this case, the total value TOTAL3 is shown by the following expression.

$$\text{TOTAL3}=MR_1+MG_1+MB_1+MR_2+MG_2+MB_2+\ldots+MR_{240}+MG_{240}+MB_{240} \quad (3)$$

The total values TOTAL1, TOTAL2, and TOTAL3 may be associated with the average value of the voltages applied to the pixel electrodes for one scan line, and may be used as a material for determining whether or not it is necessary to increase the supply capability of the common electrode voltage VCOM or the voltage level is not changed even if the supply capability is decreased.

As the total value, the grayscale data for some of the number of dots of one scan line, higher-order bits of the grayscale data, or a value obtained by sequentially adding the most significant bit may also be used.

FIG. 17 shows an example in which the line value calculation circuit 260 calculates the line value when the LCD panel 20 is normally black. When the LCD panel 20 is normally black, the voltage applied to the liquid crystal is increased as the value of the grayscale data of each dot is increased.

On the other hand, when the LCD panel 20 is normally white, the line value calculation circuit 260 may calculate the line value as follows.

Figure 18:
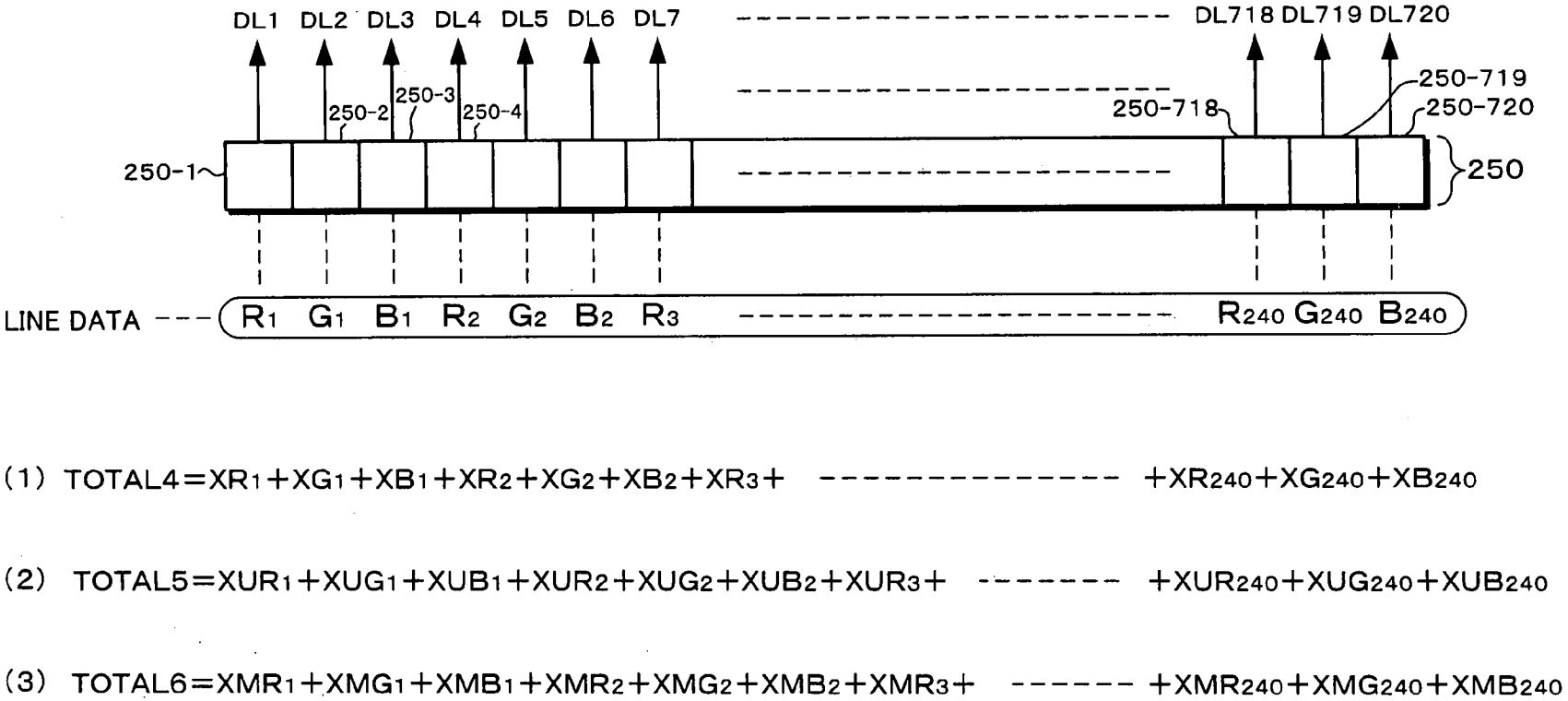
FIG. 18 is a diagram showing another example of the calculation processing of the line value calculation circuit shown in FIG. 14.

FIG. 18 is a diagram showing another example of the calculation processing of the line value calculation circuit 260 shown in FIG. 14.

While FIG. 17 shows a line value processing example when the LCD panel 20 is normally black, FIG. 18 shows a line value processing example when the LCD panel 20 is normally white. In FIG. 18, the one's complement or the two's complement of the grayscale data $R_1$ is indicated as inversion grayscale data $XR_1$, for example.

When the LCD panel 20 is normally white, the voltage applied to the liquid crystal is decreased as the value of the grayscale data of each dot is increased. Therefore, it becomes necessary to increase the supply capability of the common electrode voltage along with an increase in the line value by sequentially adding the one's complement or the two's complement of the grayscale data when the line value calculation circuit 260 sequentially adds at least a part of the grayscale data of each dot. In this case, the line value may also referred to as the value obtained by sequentially adding the grayscale data of each dot.

For example, the line value calculation circuit 260 may calculate a total value TOTAL4, which is obtained by sequentially adding the grayscale data for the number of dots (=720) of one scan line, as the line value. In this case, the total value TOTAL4 is shown by the following expression.

$$\text{TOTAL4}=XR_1+XG_1+XB_1+XR_2+XG_2+XB_2+\ldots+XR_{240}+XG_{240}+XB_{240} \quad (4)$$

The line value calculation circuit 260 may calculate a total value TOTAL5, which is obtained by sequentially adding high-order k-bit data of each of the grayscale data for the number of dots (=720) of one scan line, as the line value. In this case, the one's complement or the two's complement of data of higher-order k bits of the grayscale data R1 is indicated as inversion grayscale data XUR1, and the total value TOTAL5 is shown by the following expression.

$$\text{TOTAL5}=XUR_1+XUG_1+XUB_1+XUR_2+XUG_2+XUB_2+\ldots+XUR_{240}+XUG_{240}+XUB_{240} \quad (5)$$

The line value calculation circuit 260 may calculate a total value TOTAL6, which is obtained by sequentially adding the most significant bit (k=1) data of each of the grayscale data for the number of dots (=720) of one scan line, as the line value. In this case, the one's complement or the two's complement of the most significant bit of the grayscale data $R_1$ is indicated as inversion grayscale data XMR1, and the total value TOTAL6 is shown by the following expression.

$$\text{TOTAL6}=XMR_1+XMG_1+XMB_1+XMR_2+XMG_2+XMB_2+\ldots+XMR_{240}+XMG_{240}+XMB_{240} \quad (6)$$

The total values TOTAL4, TOTAL5, and TOTAL6 may be associated with the average value of the voltages applied to the pixel electrodes for one scan line, and may be used as a material for determining whether or not it is necessary to increase the supply capability of the common electrode voltage VCOM or the voltage level is not changed even if the supply capability is decreased.

2.3 Power Supply Circuit

Figure 19:
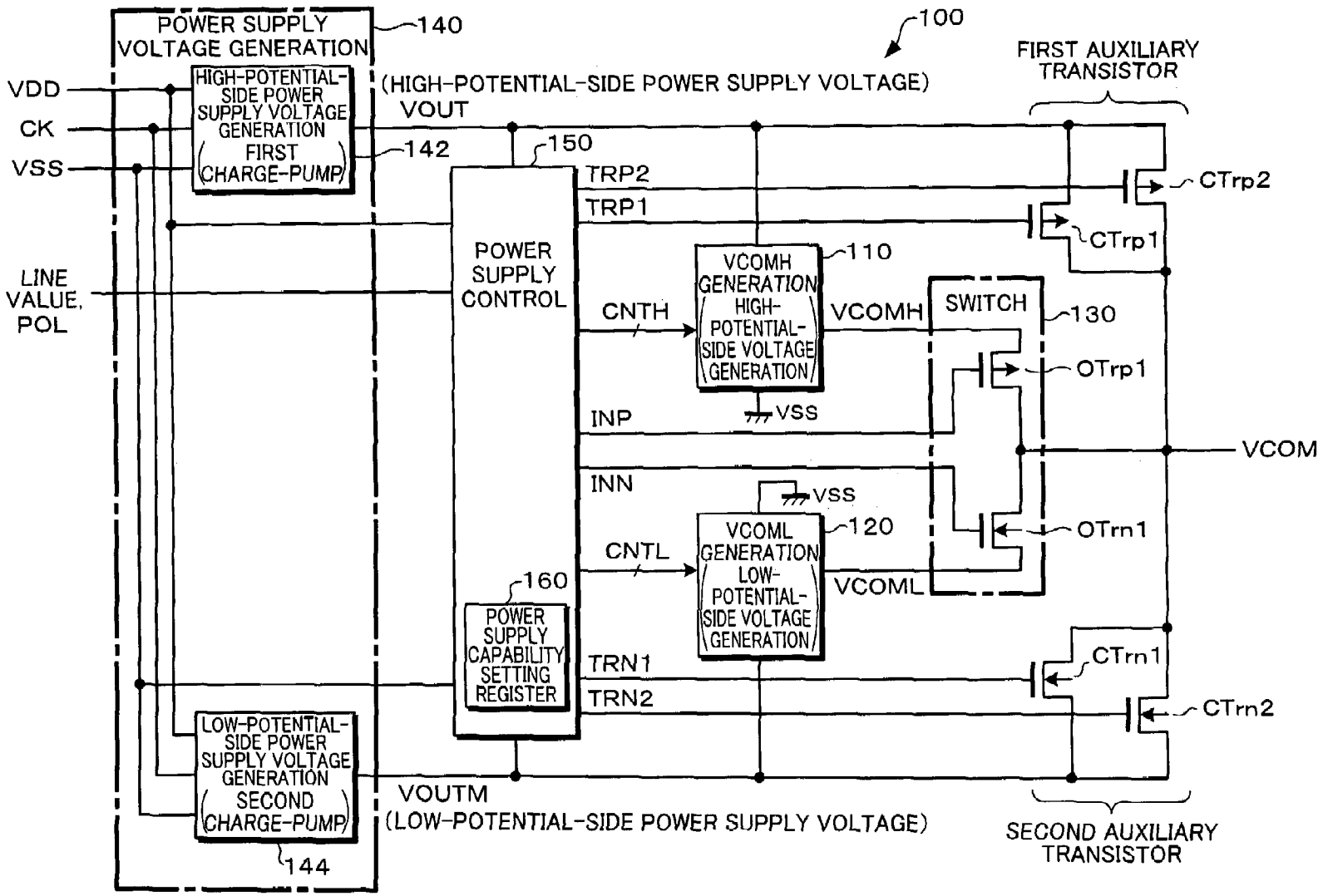
FIG. 19 is a block diagram showing a configuration example of the power supply circuit shown in FIG. 1.

FIG. 19 shows a configuration of the power supply circuit 100 shown in FIG. 1.

The power supply circuit 100 supplies the common electrode voltage VCOM to a common electrode opposite to a pixel electrode through an electro-optical substance. The power supply circuit 100 includes a VCOMH generation circuit (high-potential-side voltage generation circuit) 110 and a VCOML generation circuit (low-potential-side voltage generation circuit) 120. The VCOMH generation circuit 110 generates the high-potential-side voltage VCOMH of the common electrode voltage VCOM. The VCOML generation circuit 120 generates the low-potential-side voltage VCOML of the common electrode voltage VCOM. The power supply circuit 100 alternately supplies the high-potential-side voltage VCOMH and the low-potential-side voltage VCOML to the common electrode COM as the common electrode voltage VCOM.

The power supply circuit 100 may include a switch circuit 130. In this case, the switch circuit 130 alternately supplies the high-potential-side voltage VCOMH and the low-potential-side voltage VCOML to the common electrode COM as the common electrode voltage VCOM. The switch circuit 130 may include a P-type (first conductivity type) output metal-oxide-semiconductor (MOS) transistor (MOS transistor is hereinafter abbreviated as "transistor") OTrp1 and an N-type output transistor OTrn1. The high-potential-side voltage VCOMH is supplied to the source of the output transistor OTrp1, and the drain of the output transistor OTrp1 is connected with the drain of the output transistor OTrn1. A gate signal INP is supplied to the gate of the output transistor OTr1. The low-potential-side voltage VCOML is supplied to the source of the output transistor OTrn1. A gate signal INN is supplied to the gate of the output transistor OTrn1. The drain voltage of the output transistor OTrp1 (drain voltage of the output transistor OTrn1) is output as the common electrode voltage VCOM.

Figure 20:
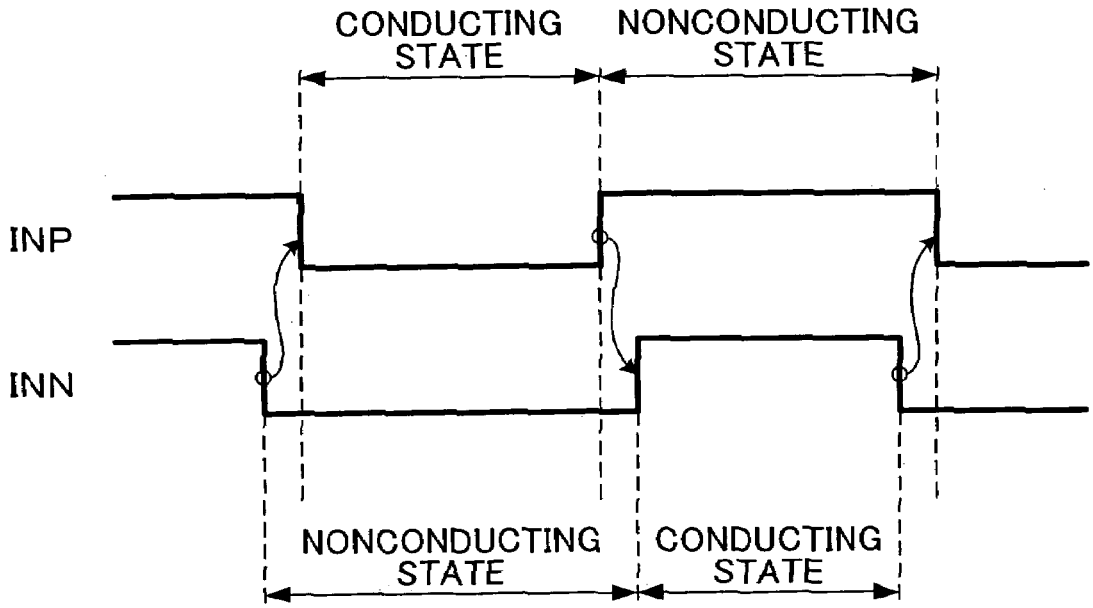
FIG. 20 is a diagram showing a timing example of a gate signal shown in FIG. 19.

FIG. 20 shows an example of the timing of the gate signals INP and INN shown in FIG. 19.

The output transistor OTrp1 is set in a conducting state when the gate signal INP is set at the L level, and set in a nonconducting state when the gate signal INP is set at the H level. The output transistor OTrn1 is set in a nonconducting state when the gate signal INN is set at the L level, and set in a conducting state when the gate signal INN is set at the H level.

The gate signals INP and INN are generated so that the output transistors OTrp1 and OTrn1 are not simultaneously set in a conducting state (one or both of the output transistors OTrp1 and OTrn1 are set in a nonconducting state). The gate signals INP and INN are generated so that the period in which the gate signal INP changes from the H level to the L level does not overlap the period in which the gate signal INN changes from the H level to the L level. The gate signals INP and INN are generated so that the period in which the gate signal IP changes from the L level to the H level does not overlap the period in which the gate signal INN changes from the L level to the H level.

This prevents occurrence of a situation in which the source of the output transistor OTrp1 is electrically connected with the source of the output transistor OTrn1, whereby present consumption can be reduced.

The power supply circuit 100 shown in FIG. 19 controls the supply capability of the common electrode voltage VCOM by changing at least one of the current drive capability and the output voltage level of the VCOMH generation circuit (high-potential-side voltage generation circuit) 110 corresponding to the line value calculated from the line data including the grayscale data of each dot corresponding to the voltage applied to the pixel electrode for the number of dots of one scan line. Or, the power supply circuit 100 controls the supply capability of the common electrode voltage VCOM by changing at least one of the current drive capability and the output voltage level of the VCOML generation circuit (low-potential-side voltage generation circuit) 120 corresponding to the line value calculated from the line data including the grayscale data of each dot corresponding to the voltage applied to the pixel electrode for the number of dots of one scan line. Specifically, the power supply circuit 100 controls the supply capability of the common electrode voltage VCOM by changing at least one of the current drive capability of the VCOMH generation circuit (high-potential-side voltage generation circuit) 110, the output voltage level of the VCOMH generation circuit 110, the current drive capability of the VCOML generation circuit (low-potential-side voltage generation circuit) 120, and the output voltage level of the VCOML generation circuit 120 corresponding to the line value.

The amount of electric charge removed from the common electrode or the amount of electric charge supplied to the common electrode can be changed by changing the current drive capability. The amount of electric charge removed from the common electrode or the amount of electric charge supplied to the common electrode can also be changed by changing the output voltage level.

The power supply circuit 100 may include a power supply control circuit 150. The power supply control circuit 150 controls the supply capability of the common electrode voltage VCOM. The power supply control circuit 150 may generate a supply capability control signal for controlling the supply capability. In more detail, the power supply control circuit 150 may generate the supply capability control signal corresponding to the line value from the data driver 30. The power supply control circuit 150 generates the supply capability control signal based on a value set in a power supply capability setting register 160, for example. Control information such as the supply capability control signal which should be output and the output timing is stored in the power supply capability setting register 160 corresponding to the line value from the data driver 30.

The supply capability control signal of the common electrode voltage VCOM includes gate signals TRP1, TRP2, INP, INN, TRN1, and TRN2 and voltage generation control signals CNTH and CNTL. The voltage generation control signal CNTH includes a high-potential-side input voltage LEVINP, a current drive capability control signal BOOSTP, slew rate control signals VREFN1 and VREFN2, and a drive current source control signal REFN for generating the high-potential-side voltage VCOMH. The voltage generation control signal CNTL includes a low-potential-side input voltage LEVINN, a current drive capability control signal BOOSTN, slew rate control signals VREFP1 and VREFP2, and a drive current source control signal REFP for generating the low-potential-side voltage VCOML.

The power supply circuit 100 may include at least one P-type (first conductivity type) first auxiliary transistor to which a high-potential-side power supply voltage VOUT of the VCOM generation circuit 110 (high-potential-side voltage generation circuit) is supplied at the source and which is electrically connected with the output (signal line electrically connected with the common electrode in a broad sense) of the switch circuit 130 at the drain. The supply capability may be controlled by controlling the gate voltage of the first auxiliary transistor corresponding to the line value. This enables the current drive capability of the power supply circuit 100 to be increased or decreased. In FIG. 19, P-type transistors CTrp1 and CTrp2 are provided in parallel as the first auxiliary transistors, and controlled by the gate signals TRP1 and TRP2.

The power supply circuit 100 may include at least one N-type (second conductivity type) second auxiliary transistor to which a low-potential-side power supply voltage VOUTM of the VCOML generation circuit 120 (low-potential-side voltage generation circuit) is supplied at the source and which is electrically connected with the output (signal line electrically connected with the common electrode in a broad sense) of the switch circuit 130 at the drain. The supply capability may be controlled by controlling the gate voltage of the second auxiliary transistor corresponding to the line value. This enables the current drive capability of the power supply circuit 100 to be increased or decreased. In FIG. 19, N-type transistors CTrn1 and CTrn2 are provided in parallel as the second auxiliary transistors, and controlled by the gate signals TRN1 and TRN2.

The power supply circuit 100 may include a first operational amplifier to which the VCOMH generation circuit 110 (high-potential-side voltage generation circuit) outputs the high-potential-side voltage VCOMH based on the high-potential-side input voltage. When controlling the supply capability of the common electrode voltage VCOM, at least one of the current drive capability and the slew rate of the first operational amplifier may be changed corresponding to the line value. The high-potential-side voltage VCOMH may be changed by changing the high-potential-side input voltage corresponding to the line value. Or, the operating current of the first operational amplifier may be stopped or limited corresponding to the line value, and the input and the output of the first operational amplifier may be electrically connected.

The power supply circuit 100 may include a second operational amplifier to which the VCOML generation circuit 120 (low-potential-side voltage generation circuit) outputs the low-potential-side voltage VCOML based on the low-potential-side input voltage. When controlling the supply capability, at least one of the current drive capability and the slew rate of the second operational amplifier may be changed corresponding to the line value. The low-potential-side voltage VCOML may be changed by changing the low-potential-side input voltage corresponding to the line value. Or, the operating current of the second operational amplifier may be stopped or limited corresponding to the line value, and the input and the output of the second operational amplifier may be electrically connected.

In FIG. 19, the high-potential-side power supply voltage VOUT and the low-potential-side power supply voltage VOUTM are generated by a power supply voltage generation circuit 140 of the power supply circuit 100. In more detail, the power supply voltage generation circuit 140 includes a high-potential-side power supply voltage generation circuit 142 (first charge-pump circuit) and a low-potential-side power supply voltage generation circuit 144 (second charge-pump circuit). The high-potential-side power supply voltage generation circuit 142 generates the high-potential-side power supply voltage VOUT based on the power supply voltages VDD and VSS. The low-potential-side power supply voltage generation circuit 144 generates the low-potential-side power supply voltage VOUTM based on the power supply voltages VDD and VSS.

The high-potential-side power supply voltage generation circuit 142 generates the high-potential-side power supply voltage VOUT by increasing the voltage between the power supply voltages VDD and VSS in the high-potential direction (positive direction) based on the power supply voltage VSS by a charge-pump operation in synchronization with a first charge clock signal. In this case, the supply capability of the common electrode voltage VCOM may be controlled by stopping the first charge clock signal or reducing the frequency of the first charge clock signal corresponding to the line value.

The low-potential-side power supply voltage generation circuit 144 generates the low-potential-side power supply voltage VOUTM by increasing (decreasing) the voltage between the power supply voltages VDD and VSS in the low-potential direction (negative direction) based on the power supply voltage VSS by a charge-pump operation in synchronization with a second charge clock signal. In this case, the supply capability may be controlled by stopping the second charge clock signal or reducing the frequency of the second charge clock signal corresponding to the line value.

Figure 21:
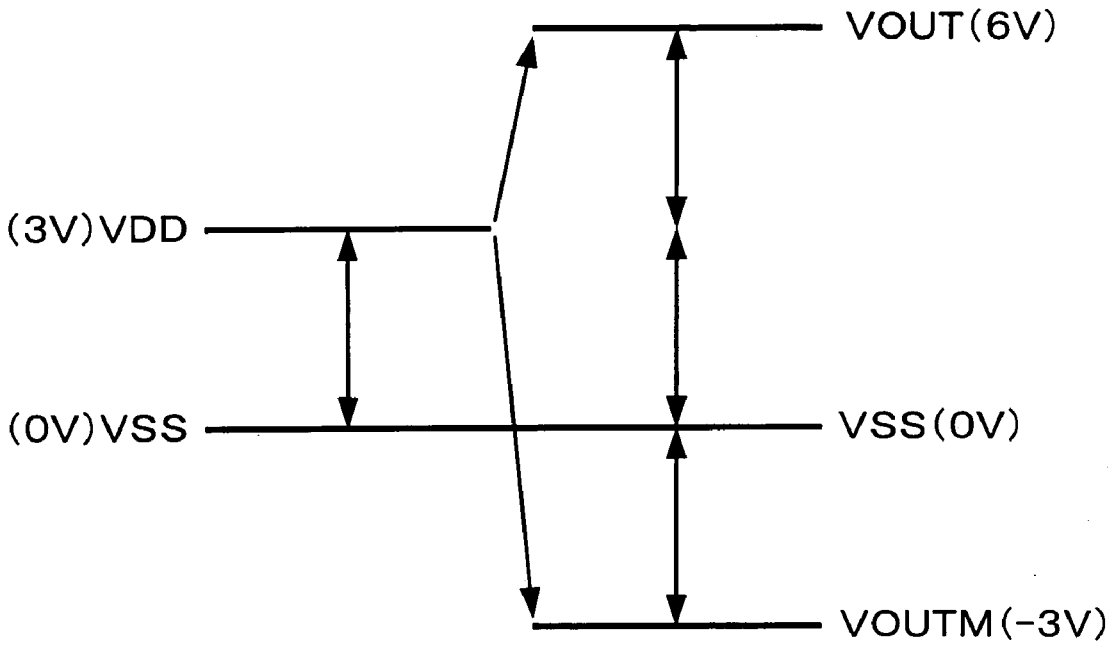
FIG. 21 is a schematic diagram illustrative of an operation example of a power supply voltage generation circuit shown in FIG. 19.

FIG. 21 is a schematic diagram illustrative of an operation example of the power supply voltage generation circuit 140 shown in FIG. 19.

The high-potential-side power supply voltage generation circuit 142 generates the high-potential-side power supply voltage VOUT (6 V) by increasing the voltage (3 V) between the power supply voltages VDD and VSS twice in the high-potential direction based on a potential of 0 V (=VSS) by the charge-pump operation in synchronization with the first charge clock signal.

The low-potential-side power supply voltage generation circuit 144 generates the low-potential-side power supply voltage VOUTM (−3 V) by increasing the voltage (3 V) between the power supply voltages VDD and VSS once (=×−1) in the low-potential direction based on a potential of 0 V (=VSS) by the charge-pump operation in synchronization with the second charge clock signal.

In FIG. 19, one charge clock signal is used as the first and second charge clock signals so that the high-potential-side power supply voltage generation circuit 142 and the low-potential-side power supply voltage generation circuit 144 perform the charge-pump operation in synchronization with one charge clock signal CK.

The line value shown in FIG. 17 or 18 is supplied to the power supply circuit 100 from the data driver 30. In this case, the power supply circuit 100 may change at least one of the current drive capability and the output voltage level of the VCOMH generation circuit 110 or at least one of the current drive capability and the output voltage level of the VCOML generation circuit 120 corresponding to the total value obtained by sequentially adding the grayscale data for the number of dots of one scan line, the grayscale data of each dot corresponding to the voltage applied to the pixel electrode.

The power supply circuit 100 may perform at least one of the above-described supply capability control only in a period calculated based on the line value.

When the grayscale data of each dot is j (j is an integer greater than one) bits, the total value may be a value obtained by sequentially adding higher-order k-bit (k<j, k is a natural number) data of each piece of grayscale data for the number of dots of one scan line. The total value may be a total value in which k is one.

The major portion of the configuration of the power supply circuit 100 shown in FIG. 19 is described below in detail.

Figure 22:
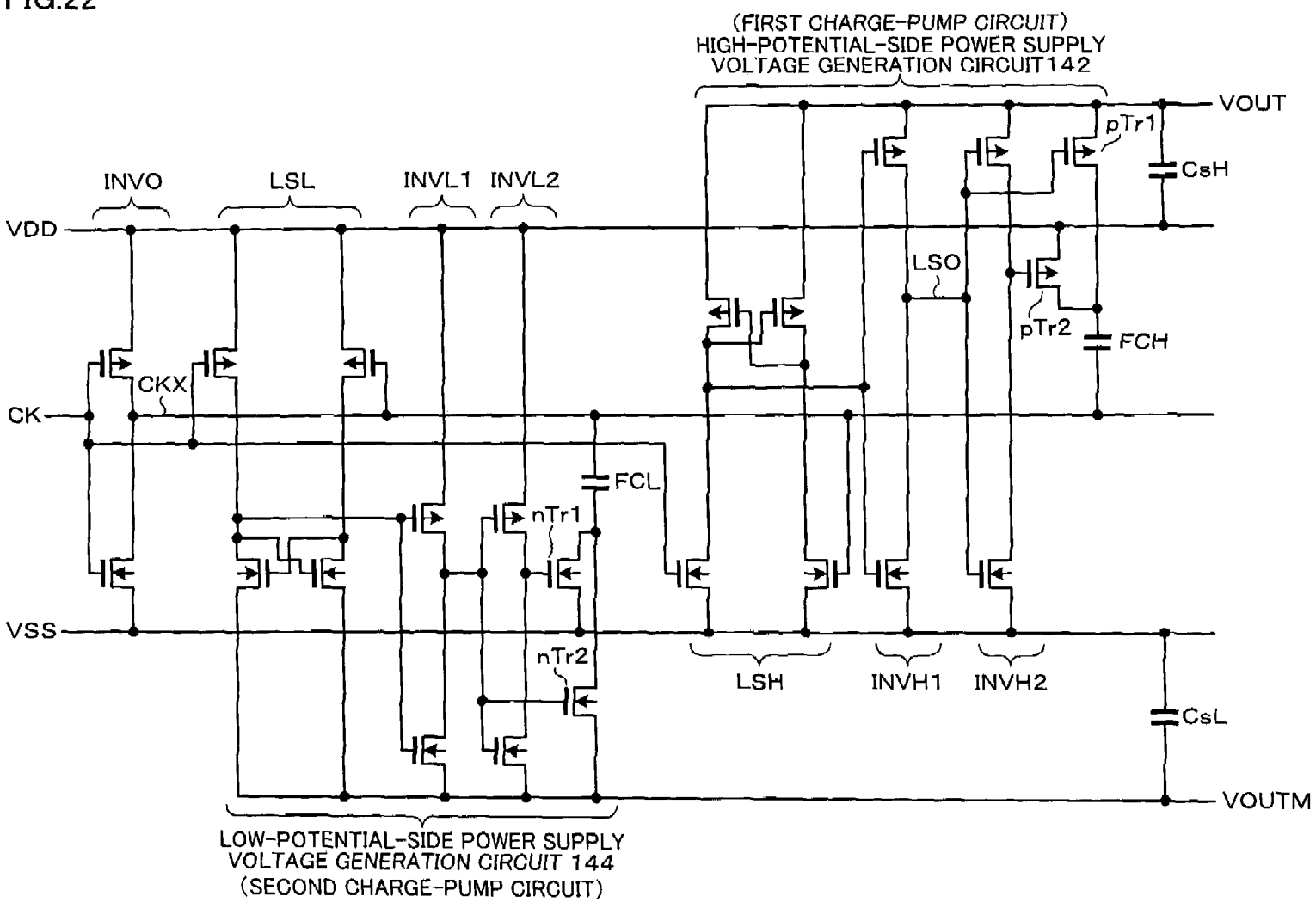
FIG. 22 is a circuit diagram showing a configuration example of the power supply voltage generation circuit shown in FIG. 19.

FIG. 22 is a circuit diagram showing a configuration example of the power supply voltage generation circuit 140 shown in FIG. 19.

The high-potential-side power supply voltage generation circuit 142 includes a level shifter LSH, inverters INVH1 and INVH2, and switching transistors pTr1 and pTr2. In FIG. 22, a flying capacitor FCH and a storage capacitor CsH are connected outside the power supply circuit 100. However, at least one of these capacitors may be provided in the power supply circuit 100 (high-potential-side power supply voltage generation circuit 142).

Figure 23:
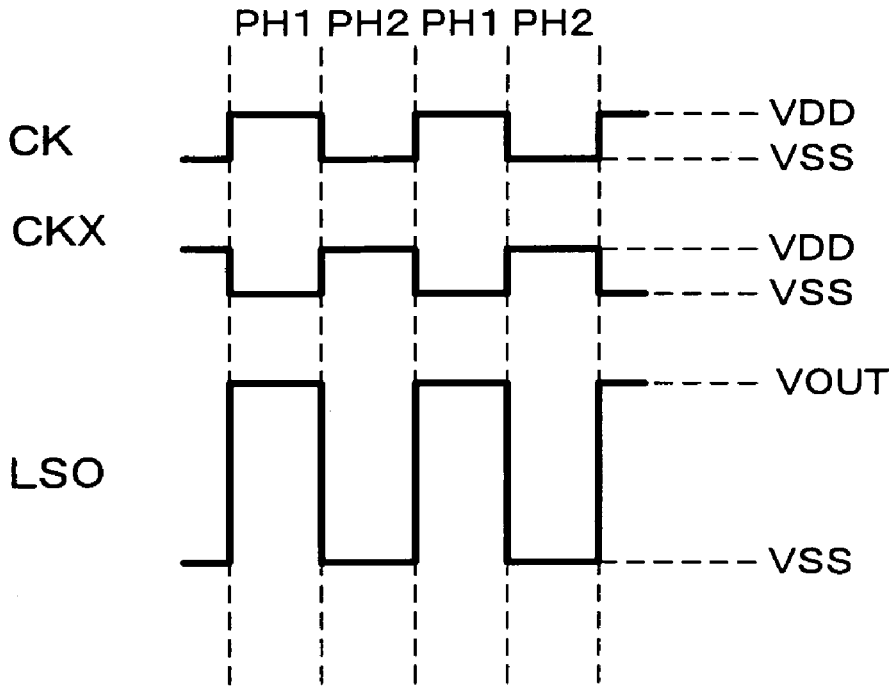
FIG. 23 is a timing diagram illustrative of the operation of a high-potential-side power supply voltage generation circuit.

FIG. 23 is a timing diagram illustrative of the operation of the high-potential-side power supply voltage generation circuit 142.

The charge clock signal CK having the voltage between the power supply voltages VDD and VSS as the amplitude voltage is supplied to the level shifter LSH. When one of two N-type transistors forming the level shifter LSH is set in a conducting state, the other N-type transistor is set in a nonconducting state. For example, the drain voltage of the P-type transistor is determined so that a drain current occurs in the N-type transistor to which the charge clock signal CK is supplied at its gate. The logic level of the output signal of the level shifter LSH is reversed by the inverter INVH1 so that an output signal LSO is obtained. The logic level of the output signal LSO is reversed by the inverter INVH2. The output signal LSO is supplied to the gate of the P-type transistor pTr1. The inversion signal of the output signal LSO is supplied to the gate of the P-type transistor pTr2.

The period in which the logic level of the output signal LSO is set at the H level is called a period PH1, and the period in which the logic level of the output signal LSO is set at the L level is called a period PH2. In the period PH1, the transistor pTr1 is set in a nonconducting state, and the transistor pTr2 is set in a conducting state. Therefore, the voltage VSS of an inversion charge clock signal CKX is supplied to one end of the flying capacitor FCH, and the voltage VDD is supplied to the other end of the flying capacitor FCH. In the period PH2, the transistor pTr1 is set in a conducting state, and the transistor pTr2 is set in a nonconducting state. Therefore, the voltage VDD of the inversion charge clock signal CKX is supplied to one end of the flying capacitor FCH, and the other end is electrically connected with the high-potential-side output power supply line. Since an electric charge corresponding to the voltage between the power supply voltage VDD and VSS has been stored in the flying capacitor FCH in the period PH1, the voltage of the high-potential-side output power supply line is set at a voltage "VDD×2" in the period PH2. The voltage of the high-potential-side output power supply line is output as the voltage VOUT. The voltage level of the high-potential-side output power supply line is retained by the storage capacitor CsH in the period PH1.

The low-potential-side power supply voltage generation circuit 144 includes a level shifter LSL, inverters INVL1 and INVL2, and switching transistors nTr1 and nTr2. In FIG. 22, a flying capacitor FCL and a storage capacitor CsL are connected outside the power supply circuit 100. However, at least one of these capacitors may be provided in the power supply circuit 100 (low-potential-side power supply voltage generation circuit 144).

The operation of the low-potential-side power supply voltage generation circuit 144 is a charge-pump operation similar to that of the high-potential-side power supply voltage generation circuit 142. Therefore, detailed description is omitted. Since an electric charge corresponding to the voltage between the power supply voltages VDD and VSS has been stored in the flying capacitor FCL, the low-potential-side power supply voltage generation circuit 144 supplies a voltage VOUTM in the negative direction with respect to the voltage VSS to the low-potential-side output power supply line. The voltage of the low-potential-side output power supply line is the voltage VOUTM, and the voltage level of the low-potential-side output power supply line is held by the storage capacitor CsL.

In the high-potential-side power supply voltage generation circuit 142 and the low-potential-side power supply voltage generation circuit 144 having such a configuration, the charge clock signal is stopped or the frequency of the charge clock signal is reduced corresponding to the line value. This enables the supply capability of the common electrode voltage VCOM to be controlled by changing the voltage supply capability of the high-potential-side voltage VCOMH or the low-potential-side voltage VCOML.

Figure 24A:
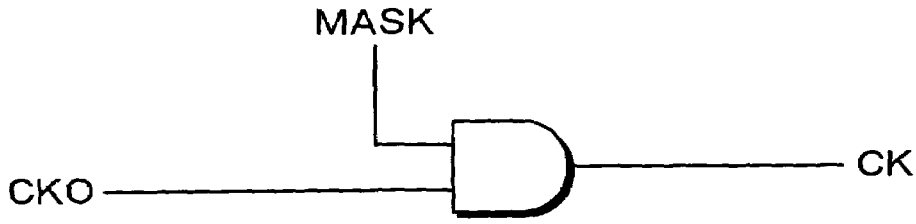
FIGS. 24A and 24B are diagrams showing configuration examples which realize control of a charge clock signal of the power supply voltage generation circuit shown in FIG. 22.
Figure 24B:
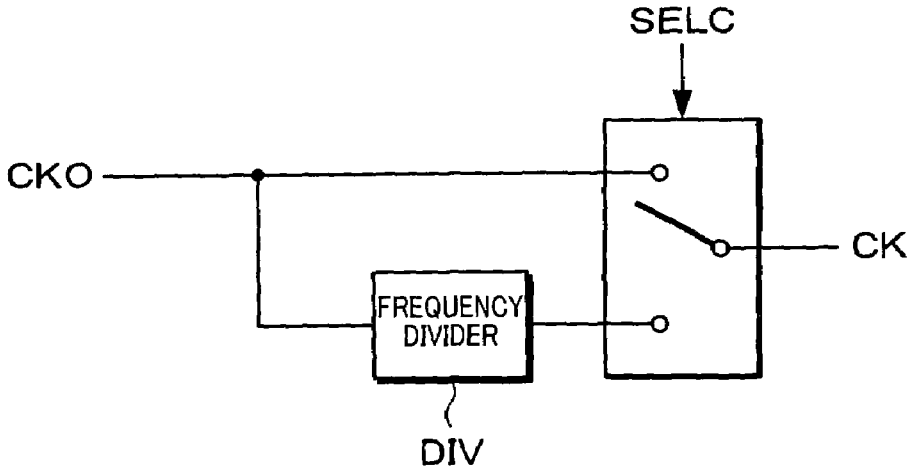

FIGS. 24A and 24B show configuration examples which realize control of the charge clock signal of the power supply voltage generation circuit 140 shown in FIG. 22.

FIG. 24A shows a configuration of masking an original clock signal CKO by using a mask signal MASK generated based on the line value. In this case, the operation or suspension of the charge clock signal CK is controlled by using the mask signal MASK.

FIG. 24B shows a configuration of reducing the frequency of the charge clock signal CK by using a select signal SELC generated based on the line value. A frequency divider DIV divides the frequency of the original clock signal CKO by S (S is a number of two or more). One of the original clock signal CKO and the output of the frequency divider DIV selected based on the select signal SELC is output as the charge clock signal CK.

A configuration example of the VCOMH generation circuit 110 and the VCOML generation circuit 120 is described below.

Figure 25:
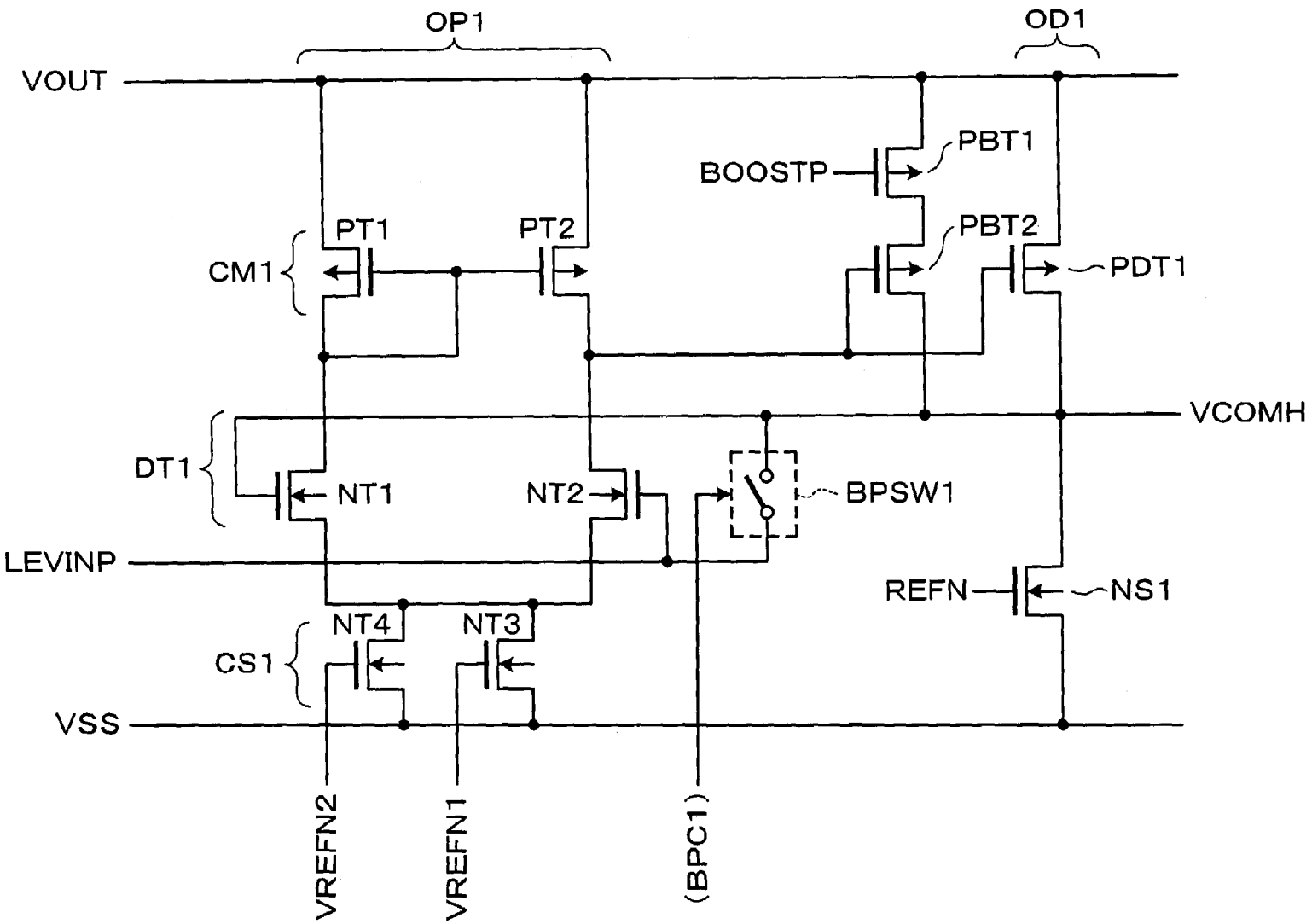
FIG. 25 is a circuit diagram showing a configuration example of a VCOMH generation circuit shown in FIG. 19.

FIG. 25 is a circuit diagram showing a configuration example of the VCOMH generation circuit 110 shown in FIG. 19.

The VCOMH generation circuit 110 includes a differential section OP1 forming the first operational amplifier and an output section OD1.

The differential section OP1 includes a current mirror circuit CM1, a differential transistor pair DT1, and a current source CS1. The current mirror circuit CM1 includes P-type transistors PT1 and PT2 to which the power supply voltage VOUT is supplied at the source. The gates of the transistors PT1 and PT2 are connected, and the gate and the drain of the transistor PT1 are connected.

The differential transistor pair DT1 includes N-type transistors NT1 and NT2. The output voltage VCOMH of the output section OD1 is supplied to the gate of the transistor NT1. A high-potential-side input voltage LEVINP is supplied to the gate of the transistor NT2. The drain of the transistor NT1 is connected with the drain of the transistor PT1. The drain of the transistor NT2 is connected with the drain of the transistor PT2.

The current source CS1 is inserted between the sources of the N-type transistors NT1 and NT2 and the power supply line to which the power supply voltage VSS is supplied. In the current source CS1, two N-type transistors NT3 and NT4 are connected in parallel. The slew rate control signals VREFN1 and VREFN2 are respectively supplied to the gates of the N-type transistors NT3 and NT4. Therefore, the current value of the current source CS1 is controlled corresponding to the slew rate control signals VREFN1 and VREFN2.

The output section OD1 includes a P-type driver transistor PDT1 and an N-type current source transistor NS1. The high-potential-side power supply voltage VOUT is supplied to the source of the P-type driver transistor PDT1. The low-potential-side power supply voltage VSS is supplied to the source of the N-type current source transistor NS1. The voltage of the connection node between the transistor NT2 and the transistor PT2 is supplied to the gate of the P-type driver transistor PDT1. The drive current source control signal REFN is supplied to the gate of the N-type current source transistor NS1. The drain of the P-type driver transistor PDT1 is connected with the drain of the N-type current source transistor NS1. This drain voltage is the output voltage VCOMH.

The output section OD1 includes boost P-type driver transistors PBT1 and PBT2 connected in series and provided in parallel with the P-type driver transistor PDT1. In more detail, the boost P-type driver transistors PBT1 and PBT2 are connected in parallel with the P-type driver transistor PDT1 when a current drive capability control signal BOOSTP is set at the L level. This enables the capability of causing current to flow toward the output to be increased corresponding to the current drive capability control signal BOOSTP.

The VCOMH generation circuit 110 may include a bypass switch BPSW1 which bypasses the input and the output of the differential section OP1. The high-potential-side voltage VCOMH can be set at the high-potential-side input voltage LEVINP by setting the bypass switch BPSW1 in a conducting state by using a bypass control signal BPC1 which ON/OFF controls the bypass switch BPSW1. In this case, it is preferable to stop the current of the current source CS1 and the N-type current source transistor NS1 by using the slew rate control signals VREFN1 and VREFN2 and the drive current source control signal REFN.

The high-potential-side input voltage LEVINP, the slew rate control signals VREFN1 and VREFN2, the current drive capability control signal BOOSTP, the drive current source control signal REFN, and the bypass control signal BPC1 input to the VCOMH generation circuit 110 are supplied from the power supply control circuit 150 shown in FIG. 19.

In the VCOMH generation circuit 110 having such a configuration, suppose that the bypass switch BPSW1 is set in a nonconducting state, the boost P-type driver transistor PBT1 is set in a nonconducting state, and the high-potential-side input voltage LEVINP is higher than the output voltage VCOMH. In this case, since the impedance of the transistor NT1 becomes higher than that of the transistor NT2, the gate voltage of the transistors PT1 and PT2 is increased, so that the impedance of the transistor PT2 is increased. Therefore, the gate voltage of the P-type driver transistor PDT1 is decreased, so that the P-type driver transistor PDT1 approaches the ON state. Therefore, the output voltage VCOMH is increased.

On the other hand, consider the case where the high-potential-side input voltage LEVINP is lower than the output voltage VCOMH. In this case, since the impedance of the transistor NT1 becomes lower than that of the transistor NT2, the gate voltage of the transistors PT1 and PT2 is decreased, so that the impedance of the transistor PT2 is decreased. Therefore, the gate voltage of the P-type driver transistor PDT1 is increased, so that the P-type driver transistor PDT1 approaches the OFF state. Therefore, the output voltage VCOMH is decreased.

As a result of the above-described operation, the VCOMH generation circuit 110 transitions to an equilibrium in which the high-potential-side input voltage LEVINP becomes approximately equal to the output voltage VCOMH.

In the differential section OP1, the reaction rate of each transistor forming the current mirror circuit CM1 and the differential transistor pair DT1 can be increased as the current value of the current source CS1 is increased. Therefore, the slew rate of the VCOMH generation circuit 110 can be increased. The slew rate used herein is the value indicating the maximum inclination of the output voltage per unit time.

In the output section OD1, the capability of causing current to flow toward the node to which the output voltage VCOMH is supplied can be increased by setting the boost P-type driver transistor PBT1 in a conducting state.

Figure 26:
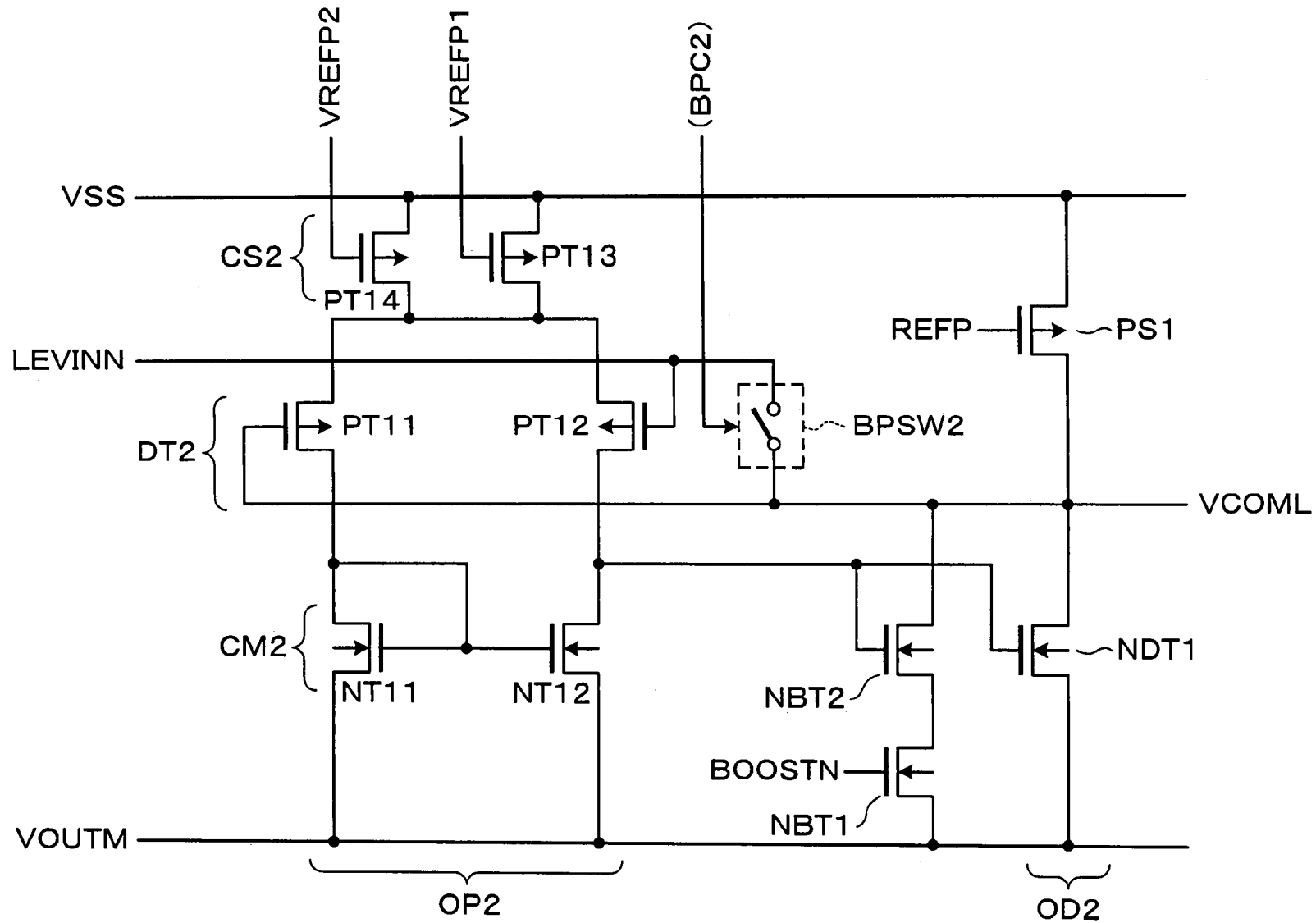
FIG. 26 is a circuit diagram showing a configuration example of a VCOML generation circuit shown in FIG. 19.

FIG. 26 is a circuit diagram showing a configuration example of the VCOML generation circuit 120 shown in FIG. 19.

The VCOML generation circuit 120 includes a differential section OP2 forming the second operational amplifier and an output section OD2.

The differential section OP2 includes a current mirror circuit CM2, a differential transistor pair DT2, and a current source CS2. The current mirror circuit CM2 includes N-type transistors NT1 and NT2 to which the power supply voltage VOUTM is supplied at the source. The gates of the transistors NT1 and NT2 are connected, and the gate and the drain of the transistor NT1 are connected.

The differential transistor pair DT2 includes P-type transistors PT11 and PT12. The output voltage VCOML of the output section OD2 is supplied to the gate of the transistor PT11. A low-potential-side input voltage LEVINN is supplied to the gate of the transistor PT12. The drain of the transistor PT11 is connected with the drain of the transistor NT11. The drain of the transistor PT12 is connected with the drain of the transistor NT12.

The current source CS2 is inserted between the sources of the P-type transistors PT11 and PT12 and the power supply line to which the power supply voltage VSS is supplied. In the current source CS2, two P-type transistors PT13 and PT14 are connected in parallel. The slew rate control signals VREFP1 and VREFP2 are respectively supplied to the gates of the P-type transistors PT13 and PT14. Therefore, the current value of the current source CS2 is controlled corresponding to the slew rate control signals VREFP1 and VREFP2.

The output section OD2 includes an N-type driver transistor NDT1 and a P-type current source transistor PS1. The power supply voltage VOUTM is supplied to the source of the N-type driver transistor NDT1. The power supply voltage VSS is supplied to the source of the P-type current source transistor PS1. The voltage of the connection node between the transistor PT12 and the transistor NT12 is supplied to the gate of the N-type driver transistor NDT1. The drive current source control signal REFP is supplied to the gate of the P-type current source transistor PS1. The drain of the N-type driver transistor NDT1 is connected with the drain of the P-type current source transistor PS1. This drain voltage is the output voltage VCOML.

The output section OD2 includes boost N-type driver transistors NBT1 and NBT2 connected in series and provided in parallel with the N-type driver transistor NDT1. In more detail, the boost N-type driver transistors NBT1 and NBT2 are connected in parallel with the N-type driver transistor NDT1 when a current drive capability control signal BOOSTN is set at the H level. This enables the capability of drawing current from the output to be increased corresponding to the current drive capability control signal BOOSTN.

The VCOML generation circuit 120 may include a bypass switch BPSW2 which bypasses the input and the output of the differential section OP2. The low-potential-side voltage VCOML can be set at the low-potential-side input voltage LEVINN by setting the bypass switch BPSW2 in a conducting state by using a bypass control signal BPC2 which ON/OFF controls the bypass switch BPSW2. In this case, it is preferable to stop the current of the current source CS2 and the P-type current source transistor PS1 by using the slew rate control signals VREFP1 and VREFP2 and the drive current source control signal REFP.

The high-potential-side input voltage LEVINN, the slew rate control signals VREFP1 and VREFP2, the current drive capability control signal BOOSTN, the drive current source control signal REFP, and the bypass control signal BPC2 input to the VCOML generation circuit 120 are supplied from the power supply control circuit 150 shown in FIG. 19.

In the VCOML generation circuit 120 having such a configuration, suppose that the bypass switch BPSW2 is set in a nonconducting state, the boost N-type driver transistor NBT1 is set in a nonconducting state, and the low-potential-side input voltage LEVINN is higher than the output voltage VCOML. In this case, since the impedance of the transistor PT11 becomes higher than that of the transistor PT12, the gate voltage of the transistors NT11 and NT12 is increased, so that the impedance of the transistor NT12 is increased. Therefore, the gate voltage of the N-type driver transistor NDT1 is decreased, so that the N-type driver transistor NDT1 approaches the OFF state. Therefore, the output voltage VCOML is increased.

On the other hand, suppose the case where the low-potential-side input voltage LEVINN is lower than the output voltage VCOML. In this case, since the impedance of the transistor PT11 becomes higher than that of the transistor PT12, the gate voltage of the transistors NT11 and NT12 is decreased, so that the impedance of the transistor NT12 is increased. Therefore, the gate voltage of the N-type driver transistor NDT1 is increased, so that the N-type driver transistor NDT1 approaches the ON state. Therefore, the output voltage VCOML is decreased.

As a result of the above-described operation, the VCOML generation circuit 120 transitions to an equilibrium in which the low-potential-side input voltage LEVINN becomes approximately equal to the output voltage VCOML.

In the differential section OP2, the reaction rate of each transistor forming the current mirror circuit CM2 and the differential transistor pair DT2 can be increased as the current value of the current source CS2 is increased. Therefore, the slew rate of the VCOML generation circuit 120 can be increased.

In the output section OD2, the capability of drawing current from the node to which the output voltage VCOML is supplied can be increased by setting the boost N-type driver transistor NBT1 in a conducting state.

2.3.1 Power Supply Capability Setting Register

The power supply control circuit 150 controls the supply capability of the common electrode voltage VCOM as described above based on the value set in the power supply capability setting register 160. The correction direction of the common electrode voltage VCOM in the supply capability control described with reference to FIG. 8 and the correction amount of the common electrode voltage VCOM described with reference to FIGS. 9 to 12 can be designated by the value set in the power supply capability setting register 160 in the supply capability control of the common electrode voltage VCOM.

FIG. 27 shows an example of the power supply capability setting register 160 shown in FIG. 19.

FIG. 27 shows an example of controlling the gate signals of the first and second auxiliary transistors CTrp1, CTrp2, CTrn1, and CTrn2, the slew rate control signals VREFN1 and VREFN2, positive (+) offset which corrects the voltage level of one of the high-potential-side input voltage LEVINP and the low-potential-side input voltage LEVINN in the positive direction, negative (−) offset which corrects the voltage level of one of the high-potential-side input voltage LEVINP and the low-potential-side input voltage LEVINN in the negative direction, and the charge clock signal CK. The same description also applies to other control signals and the like. All of or only some of the control signals may be controlled as described below.

In FIG. 27, the positive offset which corrects the voltage level of at least one of the high-potential-side input voltage LEVINP and the low-potential-side input voltage LEVINN in the positive direction and the negative offset which corrects the voltage level of at least one of the high-potential-side input voltage LEVINP and the low-potential-side input voltage LEVINN in the negative direction are determined in advance, and information which designates whether to enable (ON) or disable (OFF) each offset is set in the power supply capability setting register 160.

FIG. 27 shows the case where the data voltage corresponding to the grayscale 32 which is in the middle of the 64 grayscales 0 to 63 is the precharge voltage. Therefore, the supply capability of the common electrode voltage VCOM is controlled so that power consumption becomes minimum when the line value is a value corresponding to the grayscale 32.

The power supply capability setting register 160 stores the control information for which generates the control signal for controlling the supply capability of the common electrode voltage VCOM while associating the supply capability with the line value from the data driver 30. The control information is set by the host or the display controller.

FIG. 28 shows another example of the power supply capability setting register 160.

In FIG. 28, the control information set in the power supply capability setting register 160 is information which designates the ON timing and the OFP timing of the control signal for controlling the supply capability of the common electrode voltage VCOM.

Figure 29:
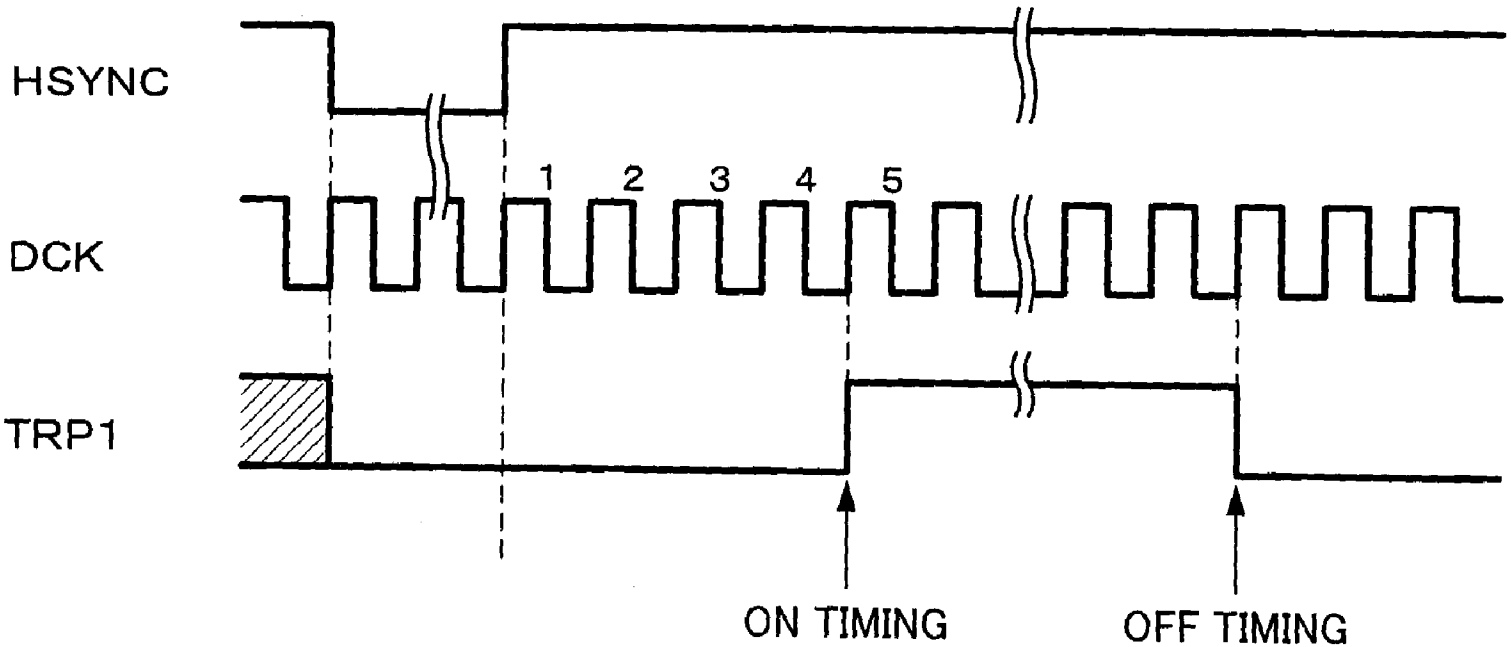
FIG. 29 is a diagram illustrative of control information set in the power supply capability setting register shown in FIG. 28.

FIG. 29 is a diagram illustrative of the control information set in the power supply capability setting register shown in FIG. 28.

For example, the control information may include the ON timing specified by the number of dot clock signals DCK with respect to the falling edge of the horizontal synchronization signal HSYNC, and the OFF timing specified by the number of dot clock signals DCK with respect to the falling edge.

This enables the supply capability of the common electrode voltage VCOM to be controlled only in a period determined based on the line value.

In the above-described power supply capability setting register, the control information including the type and time of control signal which should be controlled is determined depending on the load of the common electrode of the LCD panel 20 and the output configuration of the data driver 30.

2.4 Configuration Example of Power Supply Control Circuit

A configuration example of the power supply control circuit is described below. The following configuration example illustrates the case of controlling the supply capability of the common electrode voltage VCOM when performing a field inversion drive. However, the supply capability of the common electrode voltage VCOM can be similarly controlled when the polarity of the common electrode voltage VCOM is the same in the consecutive first and second horizontal scan periods in an N-line inversion drive.

Figure 30:
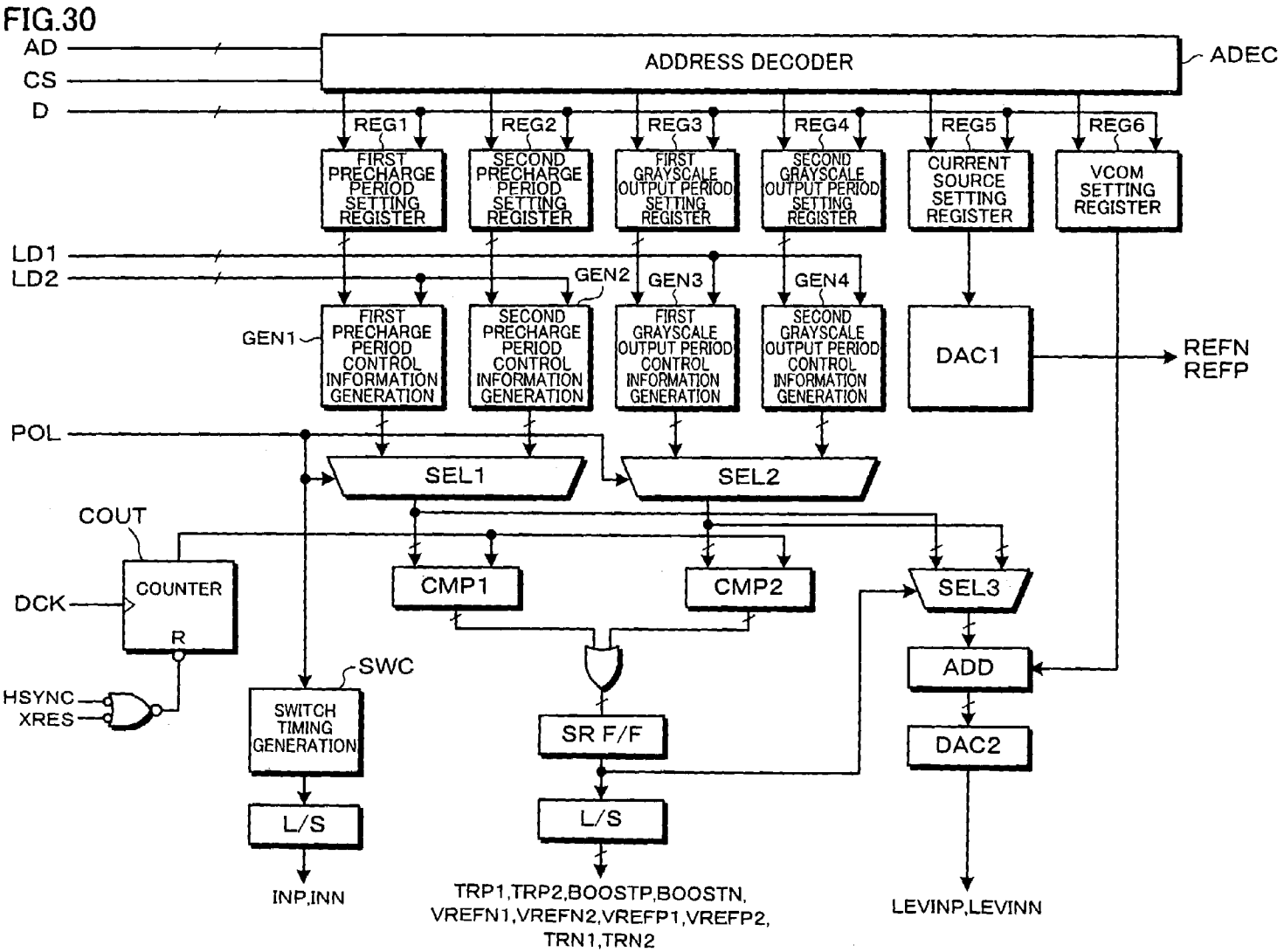
FIG. 30 is a block diagram showing a configuration example of the power supply control circuit shown in FIG. 19.

FIG. 30 is a block diagram showing a configuration example of the power supply control circuit shown in FIG. 19.

In one embodiment of the invention, the supply capability control of the common electrode voltage VCOM corresponding to the line value is caused to differ between the precharge period and the grayscale output period after the precharge period in each horizontal scan period.

Therefore, the power supply capability setting register stores control information for the positive precharge period and grayscale output period and control information for the negative precharge period and grayscale output period. The power supply control circuit acquires a precharge period line value and a grayscale output period line value from the data driver 30, and controls the supply capability of the common electrode voltage VCOM based on the acquired line value.

In FIG. 30, the power supply capability setting register includes first and second precharge period setting registers REG1 and REG2, first and second grayscale output period setting registers REG3 and REG4, a current source setting register REG5, and a VCOM setting register REG6. Information set in the first precharge period setting register REG1 is used for the positive precharge period. Information set in the first grayscale output period setting register REG3 is used for the positive grayscale output period. Information set in the second precharge period setting register REG2 is used for the negative precharge period. Information set in the second grayscale output period setting register REG3 is used for the negative grayscale output period.

The current source setting register REG5 stores control information for generating the drive current source control signals REFN and REFP. Specifically, a digital/analog converter DAC1 generates signals at voltage levels corresponding to the control information set in the current source setting register REG5, and outputs the generated signals as the drive current source control signals REFN and REFP.

The VCOM setting register REG6 stores control information for generating the high-potential-side input voltage LEVINP and the low-potential-side input voltage LEVINN. The high-potential-side input voltage LEVINP and the low-potential-side input voltage LEVINN are generated after an offset value has been added to the control information. The offset value is generated corresponding to the line value as shown in FIG. 27 or 28.

The information is set in the first and second precharge period setting registers REG1 and REG2, the first and second grayscale output period setting registers REG3 and REG4, the current source setting register REG5, and the VCOM setting register REG6 by the host or the display controller. The host or the display controller outputs address data AD which specifies one of the registers and a chip select CS. When the chip select CS is set to active, an address decoder ADEC sets access data D from the host or the display controller in one of the registers specified based on the address data AD. The access data D is the control information.

In FIG. 30, a precharge period line value LD2 and a grayscale output period line value LD1 are independently supplied from the data driver 30.

The precharge period line value LD2 is supplied to first and second precharge period control information generation sections GEN1 and GEN2. The first precharge period control information generation section GEN2 extracts the control information corresponding to the line value LD2 from the control information set in the first precharge period setting register REG1. The second precharge period control information generation section GEN2 extracts the control information corresponding to the line value LD2 from the control information set in the second precharge period setting register REG2.

Based on the polarity inversion signal POL from the data driver 30, a selector SEL1 selects the output of the first precharge period control information generation section GEN1 in the positive period and selects the output of the second precharge period control information generation section GEN2 in the negative period.

The grayscale output period line value LD1 is supplied to the first and second grayscale output period control information generation sections GEN3 and GEN4. The first grayscale output period control information generation section GEN3 extracts the control information corresponding to the line value LD1 from the control information set in the first grayscale output period setting register REG3. The second grayscale output period control information generation section GEN4 extracts the control information corresponding to the line value LD1 from the control information set in the second grayscale output period setting register REG4.

Based on the polarity inversion signal POL, a selector SEL2 selects the output of the first grayscale output period control information generation section GEN3 in the positive period and selects the output of the second grayscale output period control information generation section GEN4 in the negative period.

A counter COUT increments a counter value, which is initialized at the edge of the horizontal synchronization signal HSYNC or the edge of a reset signal XRES, in synchronization with the dot clock signal DCK.

A comparator CMP1 compares the control information selected by the selector SEL1 with the counter value, and outputs a pulse when the control information coincides with the counter value. A comparator CMP2 compares the control information selected by the selector SEL2 with the counter value, and outputs a pulse when the control information coincides with the counter value. A set-reset flip-flop is set or reset by the logical OR result of these pulses. The output of the set-reset flip-flop is converted in the voltage level by a level shifter, and output as various control signals which realize the supply capacity control of the common electrode voltage VCOM.

FIG. 30 shows only the configuration of generating one control signal. A similar configuration is provided in units of control signals which realize the supply capacity control of the electrode voltage VCOM.

In FIG. 30, period designation information which designates the precharge period and the grayscale output period in polarity units is stored in one of the first and second precharge period setting registers REG1 and REG2 and the first and second grayscale output period setting registers REG3 and REG4. The period designation information output from the set-reset flip-flop is supplied to a selector SEL3. Control information for changing the offset value which changes the high-potential-side voltage VCOMH and the low-potential-side voltage VCOML is supplied to the selector SEL3 from the selectors SEL1 and SEL2. The selector SEL3 outputs one of the control information based on the period designation information.

An adder ADD adds the control information and the control information set in the VCOM setting register REG6. A digital/analog converter DAC2 generates signals at voltage levels corresponding to the addition result of the adder ADD, and output the generated signals as the high-potential-side input voltage LEVINP and the low-potential-side input voltage LEVINN. This enables the high-potential-side input voltage LEVINP or the low-potential-side input voltage LEVINN to be changed corresponding to the line value, so that the voltage level of the common electrode voltage VCOM can be changed.

The polarity inversion signal POL is supplied to a switch timing generation circuit SWC. The switch timing generation circuit SWC generates the gate signals. INP and INN which change at the timing shown in FIG. 20 based on the polarity inversion signal POL, and outputs the gate signals INP and INN to the switch circuit 130 after voltage level conversion.

3. Electronic Instrument

Figure 31:
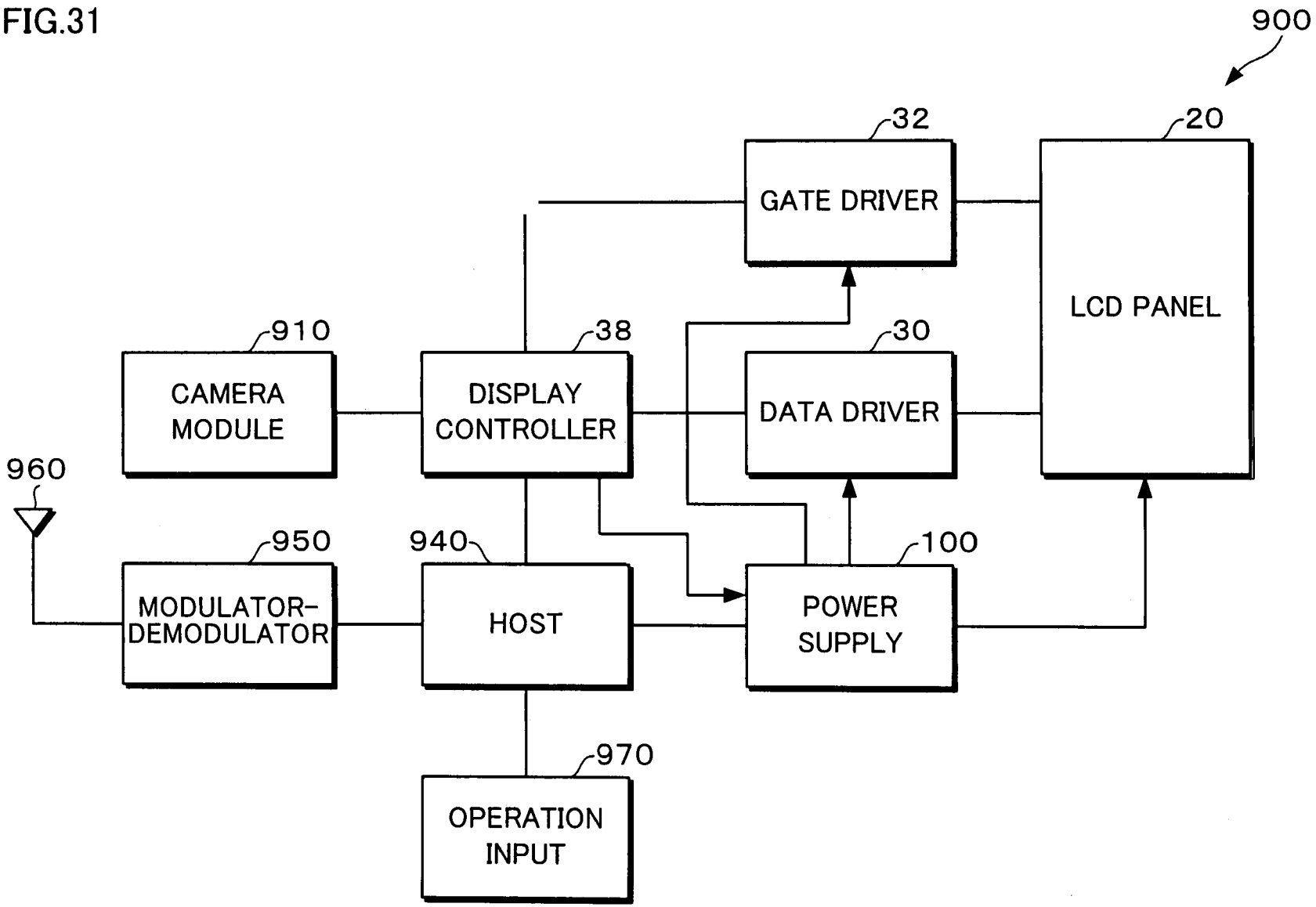
FIG. 31 is a block diagram showing a configuration example of an electronic instrument according to one embodiment of the invention.

FIG. 31 is a block diagram showing a configuration example of an electronic instrument according to one embodiment of the invention. FIG. 31 is a block diagram showing a configuration example of a portable telephone as an example of the electronic instrument. In FIG. 31, sections the same as the sections shown in FIG. 1 or 2 are indicated by the same symbols. Description of these sections is appropriately omitted.

A portable telephone 900 includes a camera module 910. The camera module 910 includes a CCD camera, and supplies data of an image captured by using the CCD camera to the display controller 38 in a YUV format.

The portable telephone 900 includes the display panel 20. The LCD panel 20 is driven by the data driver 30 and the gate driver 32. The LCD panel 20 includes scan lines, data lines, and pixels.

The display controller 38 is connected with the data driver 30 and the gate driver 32, and supplies grayscale data to the data driver 30 in an RGB format.

The power supply circuit 100 is connected with the data driver 30 and the gate driver 32, and supplies drive power supply voltages to the data driver 30 and the gate driver 32. The power supply circuit 100 supplies the common electrode voltage VCOM to the common electrode of the LCD panel 20.

A host 940 is connected with the display controller 38. The host 940 controls the display controller 38. The host 940 demodulates grayscale data received through an antenna 960 using a modulator-demodulator section 950, and supplies the demodulated grayscale data to the display controller 38. The display controller 38 causes the data driver 30 and the gate driver 32 to display an image in the LCD panel 20 based on the grayscale data.

The host 940 modulates grayscale data generated by the camera module 910 using the modulator-demodulator section 950, and directs transmission of the modulated data to another communication device through the antenna 960.

The host 940 performs transmission/reception processing of grayscale data, imaging using the camera module 910, and display processing of the LCD panel 20 based on operational information from an operation input section 970.

The invention is not limited to the above-described embodiments. Various modifications and variations may be made within the spirit and scope of the invention. The above-described embodiments illustrate the power supply circuit which supplies voltage to the common electrode. However, the invention is not limited to the power supply circuit which supplies voltage to the common electrode.

Part of requirements of any claim of the invention could be omitted from a dependent claim which depends on that claim. Moreover, part of requirements of any independent claim of the invention could be made to depend on any other independent claim.

Although only some embodiments of the invention have been described in detail above, those skilled in the art will readily appreciate that many modifications are possible in the embodiments without departing from the novel teachings and advantages of this invention. Accordingly, all such modifications are intended to be included within the scope of this invention.

What is claimed is:

1. A power supply circuit which supplies voltage to a common electrode which is opposite to each of a plurality of pixel electrodes, an electro-optical substance being interposed between the common electrode and the pixel electrodes, voltages of data lines being respectively supplied to the pixel electrodes, the power supply circuit comprising:

a high-potential-side voltage generation circuit which generates a high-potential-side voltage to be supplied to the common electrode; and a low-potential-side voltage generation circuit which generates a low-potential-side voltage to be supplied to the common electrode, the high-potential-side voltage and the low-potential-side voltage being alternately supplied to the common electrode as a common electrode voltage so that polarity of the common electrode voltage based on a given voltage is the same in consecutive first and second horizontal scan periods; and when a precharge voltage of the data lines in a first precharge period in the first horizontal scan period is higher than an average voltage of the data lines set after the first precharge period, the power supply circuit performing supply capability control of the common electrode voltage in a second precharge period of the data lines in the second horizontal scan period, the supply capability control changing at least one of:

second current drive capability of the high-potential-side voltage generation circuit in the second precharge period compared with first current drive capability of the high-potential-side voltage generation circuit in the first precharge period, a second output voltage level of the high-potential-side voltage generation circuit in the second precharge period compared with a first output voltage level of the high-potential-side voltage generation circuit in first second precharge period, second current drive capability of the low-potential-side voltage generation circuit in the second precharge period compared with first current drive capability of the low-potential-side voltage generation circuit in the first precharge period and a second output voltage level of the low-potential-side voltage generation circuit in the second precharge period compared with a first output voltage level of the low-potential-side voltage generation circuit in the first precharge period.

2. The power supply circuit as defined in claim 1, wherein the supply capability control increases an amount of positive electric charge to be removed from the common electrode.

3. A power supply circuit which supplies voltage to a common electrode which is opposite to each of a plurality of pixel electrodes, an electro-optical substance being interposed between the common electrode and the pixel electrodes, voltages of data lines being respectively supplied to the pixel electrodes, the power supply circuit comprising:

a high-potential-side voltage generation circuit which generates a high-potential-side voltage to be supplied to the common electrode; and a low-potential-side voltage generation circuit which generates a low-potential-side voltage to be supplied to the common electrode, the high-potential-side voltage and the low-potential-side voltage being alternately supplied to the common electrode as a common electrode voltage so that polarity of the common electrode voltage based on a given voltage is the same in consecutive first and second horizontal scan periods; and when a precharge voltage of the data lines in a first precharge period in the first horizontal scan period is lower than an average voltage of the data lines set after the first precharge period, the power supply circuit performing supply capability control of the common electrode voltage in a second precharge period of the data lines in the second horizontal scan period, the supply capability control changing at least one of:

second current drive capability of the high-potential-side voltage generation circuit in the second precharge period compared with first current drive capability of the high-potential-side voltage generation circuit in the first precharge period, a second output voltage level of the high-potential-side voltage generation circuit in the second precharge period compared with a first output voltage level of the high-potential-side voltage generation circuit in first second precharge period, second current drive capability of the low-potential-side voltage generation circuit in the second precharge period compared with first current drive capability of the low-potential-side voltage generation circuit in the first precharge period and a second output voltage level of the low-potential-side voltage generation circuit in the second precharge period compared with a first output voltage level of the low-potential-side voltage generation circuit in the first precharge period.

4. The power supply circuit as defined in claim 3, wherein the supply capability control increases an amount of positive electric charge to be supplied to the common electrode.

5. The power supply circuit as defined in claim 1, wherein, in a grayscale output period in the second horizontal scan period after the second precharge period, when the average voltage in the grayscale output period is higher than the precharge voltage, an amount of positive electric charge to be removed from the common electrode is increased by the supply capability control.

6. The power supply circuit as defined in claim 3, wherein, in a grayscale output period in the second horizontal scan period after the second precharge period, when the average voltage in the grayscale output period is higher than the precharge voltage, an amount of positive electric charge to be removed from the common electrode is increased by the supply capability control.

7. The power supply circuit as defined in claim 1, wherein, in a grayscale output period in the second horizontal scan period after the second precharge period, when the average voltage in the grayscale output period is lower than the precharge voltage, an amount of positive electric charge to be supplied to the common electrode is increased by the supply capability control.

8. The power supply circuit as defined in claim 3, wherein, in a grayscale output period in the second horizontal scan period after the second precharge period, when the average voltage in the grayscale output period is lower than the precharge voltage, an amount of positive electric charge to be supplied to the common electrode is increased by the supply capability control.

9. The power supply circuit as defined in claim 5, wherein the supply capability control is performed based on grayscale data for the number of dots of one scan line.

10. The power supply circuit as defined in claim 6, wherein the supply capability control is performed based on grayscale data for the number of dots of one scan line.

11. The power supply circuit as defined in claim 7, wherein the supply capability control is performed based on grayscale data for the number of dots of one scan line.

12. The power supply circuit as defined in claim 8, wherein the supply capability control is performed based on grayscale data for the number of dots of one scan line.

13. The power supply circuit as defined in claim 1, wherein the supply capability control is performed based on a total value obtained by sequentially adding grayscale data for the number of dots of one scan line, the grayscale data of each dot corresponding to voltage applied to each of the pixel electrodes.

14. The power supply circuit as defined in claim 3, wherein the supply capability control is performed based on a total value obtained by sequentially adding grayscale data for the number of dots of one scan line, the grayscale data of each dot corresponding to voltage applied to each of the pixel electrodes.

15. The power supply circuit as defined in claim 13, comprising:

a first conductivity type first auxiliary transistor having a source and a drain, a high-potential-side power supply voltage of the high-potential-side voltage generation circuit being supplied to the source, and the drain being connected to a signal line which is electrically connected to the common electrode, wherein the supply capability control is performed by controlling a gate voltage of the first auxiliary transistor according to the total value.

16. The power supply circuit as defined in claim 14, comprising:

a first conductivity type first auxiliary transistor having a source and a drain, a high-potential-side power supply voltage of the high-potential-side voltage generation circuit being supplied to the source, and the drain being connected to a signal line which is electrically connected to the common electrode, wherein the supply capability control is performed by controlling a gate voltage of the first auxiliary transistor according to the total value.

17. The power supply circuit as defined in claim 13, comprising:

a second conductivity type second auxiliary transistor having a source and a drain, a low-potential-side power supply voltage of the low-potential-side voltage generation circuit being supplied to the source, and the drain being connected to a signal line which is electrically connected to the common electrode, wherein the supply capability control is performed by controlling a gate voltage of the second auxiliary transistor according to the total value.

18. The power supply circuit as defined in claim 14, comprising:

a second conductivity type second auxiliary transistor having a source and a drain, a low-potential-side power supply voltage of the low-potential-side voltage generation circuit being supplied to the source, and the drain being connected to a signal line which is electrically connected to the common electrode, wherein the supply capability control is performed by controlling a gate voltage of the second auxiliary transistor according to the total value.

19. The power supply circuit as defined in claim 13, wherein the high-potential-side voltage generation circuit includes a first operational amplifier which outputs the high-potential-side voltage based on a high-potential-side input voltage.

20. The power supply circuit as defined in claim 14, wherein the high-potential-side voltage generation circuit includes a first operational amplifier which outputs the high-potential-side voltage based on a high-potential-side input voltage.

21. The power supply circuit as defined in claim 19, wherein the supply capability control is performed by changing at least one of current drive capability and a slew rate of the first operational amplifier according to the total value.

22. The power supply circuit as defined in claim 20, wherein the supply capability control is performed by changing at least one of current drive capability and a slew rate of the first operational amplifier according to the total value.

23. The power supply circuit as defined in claim 19, wherein the supply capability control is performed by changing the high-potential-side input voltage according to the total value.

24. The power supply circuit as defined in claim 20, wherein the supply capability control is performed by changing the high-potential-side input voltage according to the total value.

25. The power supply circuit as defined in claim 19, wherein the supply capability control is performed by stopping or limiting an operating current of the first operational amplifier and electrically connecting an input and an output of the first operational amplifier according to the total value.

26. The power supply circuit as defined in claim 20, wherein the supply capability control is performed by stopping or limiting an operating current of the first operational amplifier and electrically connecting an input and an output of the first operational amplifier according to the total value.

27. The power supply circuit as defined in claim 13, comprising:

a first charge-pump circuit which generates a high-potential-side power supply voltage of the high-potential-side voltage generation circuit by a charge-pump operation in synchronization with a first charge clock signal, wherein the supply capability control is performed by stopping the first charge clock signal or reducing frequency of the first charge clock signal according to the total value.

28. The power supply circuit as defined in claim 14, comprising:

a first charge-pump circuit which generates a high-potential-side power supply voltage of the high-potential-side voltage generation circuit by a charge-pump operation in synchronization with a first charge clock signal, wherein the supply capability control is performed by stopping the first charge clock signal or reducing frequency of the first charge clock signal according to the total value.

29. The power supply circuit as defined in claim 13, wherein the low-potential-side voltage generation circuit includes a second operational amplifier which outputs the low-potential-side voltage based on a low-potential-side input voltage.

30. The power supply circuit as defined in claim 14, wherein the low-potential-side voltage generation circuit includes a second operational amplifier which outputs the low-potential-side voltage based on a low-potential-side input voltage.

31. The power supply circuit as defined in claim 29, wherein the supply capability control is performed by changing at least one of current drive capability and a slew rate of the second operational amplifier according to the total value.

32. The power supply circuit as defined in claim 30, wherein the supply capability control is performed by changing at least one of current drive capability and a slew rate of the second operational amplifier according to the total value.

33. The power supply circuit as defined in claim 29, wherein the supply capability control is performed by changing the low-potential-side input voltage according to the total value.

34. The power supply circuit as defined in claim 30, wherein the supply capability control is performed by changing the low-potential-side input voltage according to the total value.

35. The power supply circuit as defined in claim 33, wherein the supply capability control is performed by stopping or limiting an operating current of the second operational amplifier and electrically connecting an input and an output of the second operational amplifier according to the total value.

36. The power supply circuit as defined in claim 34, wherein the supply capability control is performed by stopping or limiting an operating current of the second operational amplifier and electrically connecting an input and an output of the second operational amplifier according to the total value.

37. The power supply circuit as defined in claim 13, comprising:

a second charge-pump circuit which generates a low-potential-side power supply voltage of the low-potential-side voltage generation circuit by a charge-pump operation in synchronization with a second charge clock signal, wherein the supply capability control is performed by stopping the second charge clock signal or reducing frequency of the second charge clock signal according to the total value.

38. The power supply circuit as defined in claim 14, comprising:

a second charge-pump circuit which generates a low-potential-side power supply voltage of the low-potential-side voltage generation circuit by a charge-pump operation in synchronization with a second charge clock signal, wherein the supply capability control is performed by stopping the second charge clock signal or reducing frequency of the second charge clock signal according to the total value.

39. The power supply circuit as defined in claim 13, wherein the supply capability control is performed in a period determined based on the total value.

40. The power supply circuit as defined in claim 14, wherein the supply capability control is performed in a period determined based on the total value.

41. The power supply circuit as defined in claim 13, wherein the total value is a value obtained by sequentially adding the grayscale data for the number of a part of dots of one scan line.

42. The power supply circuit as defined in claim 14, wherein the total value is a value obtained by sequentially adding the grayscale data for the number of a part of dots of one scan line.

43. The power supply circuit as defined in claim 13, wherein, when the grayscale data of each dot is j bits, the total value is a value obtained by sequentially adding higher-order k-bit data of each piece of the grayscale data, j being an integer of two or more, and k being a natural number smaller than j.

44. The power supply circuit as defined in claim 14, wherein, when the grayscale data of each dot is j bits, the total value is a value obtained by sequentially adding higher-order k-bit data of each piece of the grayscale data j being an integer of two or more, and k being a natural number smaller than j.

45. The power supply circuit as defined in claim 43, wherein k is one.

46. The power supply circuit as defined in claim 44, wherein k is one.

47. A display driver comprising:

a driver circuit which supplies a drive voltage corresponding to grayscale data to the data lines electrically connected to the pixel electrodes; and the power supply circuit as defined in claim 1 which performs the supply capability control by using a total value corresponding to the grayscale data.

48. A display driver comprising:

a driver circuit which supplies a drive voltage corresponding to grayscale data to the data lines electrically connected to the pixel electrodes; and the power supply circuit as defined in claim 3 which performs the supply capability control by using a total value corresponding to the grayscale data.

49. An electro-optical device comprising:

a plurality of scan lines;

a plurality of data lines;

a plurality of pixel electrodes, each of the pixel electrodes being specified by one of the scan lines and one of the data lines;

a common electrode which is opposite to each of the pixel electrodes, an electro-optical substance being interposed between the common electrode and the pixel electrodes;

a display driver which drives the data lines; and the power supply circuit as defined in claim 1 which alternately supplies the high-potential-side voltage and the low-potential-side voltage to the common electrode.

50. An electro-optical device comprising:

a plurality of scan lines;

a plurality of data lines;

a plurality of pixel electrodes, each of the pixel electrodes being specified by one of the scan lines and one of the data lines;

a common electrode which is opposite to each of the pixel electrodes, an electro-optical substance being interposed between the common electrode and the pixel electrodes;

a display driver which drives the data lines; and the power supply circuit as defined in claim 3 which alternately supplies the high-potential-side voltage and the low-potential-side voltage to the common electrode.

51. An electronic instrument comprising the power supply circuit as defined in claim 1.

52. An electronic instrument comprising the power supply circuit as defined in claim 3.

53. A method of controlling a power supply circuit including a high-potential-side voltage generation circuit and a low-potential-side voltage generation circuit, the high-potential-side voltage generation circuit generating a high-potential-side voltage to be supplied to a common electrode which is opposite to each of a plurality of pixel electrodes, an electro-optical substance being interposed between the common electrode and the pixel electrodes, voltages of data lines being respectively supplied to the pixel electrodes, and the low-potential-side voltage generation circuit generating a low-potential-side voltage to be supplied to the common electrode, the method comprising:

alternately supplying the high-potential-side voltage and the low-potential-side voltage to the common electrode as a common electrode voltage so that polarity of the common electrode voltage based on a given voltage is the same in consecutive first and second horizontal scan periods; and when a precharge voltage of the data lines in a first precharge period in the first horizontal scan period is higher than an average voltage of the data lines set after the first precharge period, performing supply capability control of the common electrode voltage in a second precharge period of the data lines in the second horizontal scan period, the supply capability control changing at least one of:

second current drive capability of the high-potential-side voltage generation circuit in the second precharge period compared with first current drive capability of the high-potential-side voltage generation circuit in the first precharge period, a second output voltage level of the high-potential-side voltage generation circuit in the second precharge period compared with a first output voltage level of the high-potential-side voltage generation circuit in first second precharge period, second current drive capability of the low-potential-side voltage generation circuit in the second precharge period compared with first current drive capability of the low-potential-side voltage generation circuit in the first precharge period and a second output voltage level of the low-potential-side voltage generation circuit in the second precharge period compared with a first output voltage level of the low-potential-side voltage generation circuit in the first precharge period to increase an amount of positive electric charge to be removed from the common electrode.

54. A method of controlling a power supply circuit including a high-potential-side voltage generation circuit and a low-potential-side voltage generation circuit, the high-potential-side voltage generation circuit generating a high-potential-side voltage to be supplied to a common electrode which is opposite to each of a plurality of pixel electrodes, an electro-optical substance being interposed between the common electrode and the pixel electrodes, voltages of data lines being respectively supplied to the pixel electrodes, and the low-potential-side voltage generation circuit generating a low-potential-side voltage to be supplied to the common electrode, the method comprising:

alternately supplying the high-potential-side voltage and the low-potential-side voltage to the common electrode as a common electrode voltage so that polarity of the common electrode voltage based on a given voltage is the same in consecutive first and second horizontal scan periods; and when an average voltage of the data lines at completion of the first horizontal scan period is lower than a precharge voltage of the data lines, performing supply capability control of the common electrode voltage, the supply capability control changing at least one of:

second current drive capability of the high-potential-side voltage generation circuit in a second precharge period of the second horizontal scan period compared with first current drive capability of the high-potential-side voltage generation circuit in a first precharge period of the first horizontal scan period, a second output voltage level of the high-potential-side voltage generation circuit in the second precharge period compared with a first output voltage level of the high-potential-side voltage generation circuit in first second precharge period, second current drive capability of the low-potential-side voltage generation circuit in the second precharge period compared with first current drive capability of the low-potential-side voltage generation circuit in the first precharge period and a second output voltage level of the low-potential-side voltage generation circuit in the second precharge period compared with a first output voltage level of the low-potential-side voltage generation circuit in the first precharge period to increase an amount of positive electric charge to be supplied to the common electrode.

55. The method of controlling a power supply circuit as defined in claim 53, wherein the supply capability control is performed in a grayscale output period after the second precharge period, based on the precharge voltage and grayscale data for the number of dots of one scan line in the second horizontal scan period.

56. The method of controlling a power supply circuit as defined in claim 54, wherein the supply capability control is performed in a grayscale output period after the second precharge period, based on the precharge voltage and grayscale data for the number of dots of one scan line in the second horizontal scan period.

57. The method of controlling a power supply circuit as defined in claim 53, wherein the supply capability control is performed based on a total value obtained by sequentially adding grayscale data for the number of dots of one scan line, the grayscale data of each dot corresponding to voltage applied to each of the pixel electrodes.

58. The method of controlling a power supply circuit as defined in claim 54, wherein the supply capability control is performed based on a total value obtained by sequentially adding grayscale data for the number of dots of one scan line, the grayscale data of each dot corresponding to voltage applied to each of the pixel electrodes.

59. The method of controlling a power supply circuit as defined in claim 57, wherein the supply capability control is performed in a period determined based on the total value.

60. The method of controlling a power supply circuit as defined in claim 58, wherein the supply capability control is performed in a period determined based on the total value.

61. The method of controlling a power supply circuit as defined in claim 57, wherein the total value is a value obtained by sequentially adding the grayscale data for the number of a part of dots of one scan line.

62. The method of controlling a power supply circuit as defined in claim 58, wherein the total value is a value obtained by sequentially adding the grayscale data for the number of a part of dots of one scan line.

63. The method of controlling a power supply circuit as defined in claim 57, wherein, when the grayscale data of each dot is j bits, the total value is a value obtained by sequentially adding higher-order k-bit data of each piece of the grayscale data, j being an integer of two or more, and k being a natural number smaller than j.

64. The method of controlling a power supply circuit as defined in claim 58, wherein, when the grayscale data of each dot is j bits, the total value is a value obtained by sequentially adding higher-order k-bit data of each piece of the grayscale data, j being an integer of two or more, and k being a natural number smaller than j.

65. The method of controlling a power supply circuit as defined in claim 63, wherein k is one.

66. The method of controlling a power supply circuit as defined in claim 64, wherein k is one.

* * * * *